US007207151B2

(12) United States Patent
Swiszcz et al.

(10) Patent No.: US 7,207,151 B2
(45) Date of Patent: Apr. 24, 2007

(54) STRUCTURAL PANEL WITH COMPRESSIBLE DIVIDERS

(75) Inventors: Paul G. Swiszcz, Niwot, CO (US); Ko Kuperus, Den Haag (NL); Wendell B. Colson, Weston, MA (US); Jason T. Throne, Rockport, MA (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 11/475,780

(22) Filed: Jun. 27, 2006

(65) Prior Publication Data

US 2006/0260271 A1 Nov. 23, 2006

Related U.S. Application Data

(63) Continuation of application No. 10/309,939, filed on Dec. 3, 2002, which is a continuation-in-part of application No. 09/970,008, filed on Sep. 27, 2001, now abandoned, which is a continuation of application No. 09/839,373, filed on Apr. 23, 2001, now abandoned.

(60) Provisional application No. 60/199,208, filed on Apr. 24, 2000.

(51) Int. Cl.
*E04C 2/36* (2006.01)

(52) U.S. Cl. ..... 52/793.11; 52/783.19; 52/783.14; 52/782.14; 52/506.06; 52/144; 428/116; 428/178

(58) Field of Classification Search ..... 52/783.1, 52/782.1, 793.1, 793.11, 783.19, 783.14, 52/783.15, 506.01, 506.06, 144–145; 428/77, 428/116, 174, 178, 188, 190; 156/200, 203, 156/217, 222, 226–227; 160/84.04, 84.05, 160/136, 166.1
See application file for complete search history.

(56) References Cited

U.S. PATENT DOCUMENTS

| | | | |
|---|---|---|---|
| 1,651,539 | A | 12/1927 | Olson |
| 2,101,836 | A | 12/1937 | Benedict |
| 2,220,596 | A | 11/1940 | Bernhardt |

(Continued)

FOREIGN PATENT DOCUMENTS

| | | |
|---|---|---|
| AU | A-80 566/82 | 8/1982 |

(Continued)

OTHER PUBLICATIONS

Gubenko, A.B., "Building Structures Wherein Plastics Are Used", Building Structures With the Use of Plastic Materials, Moscow, Publishing House for Literature on the Civil Engineering, pp. 35, 38, 39, and 46, (1970).

*Primary Examiner*—Jeanette Chapman
(74) *Attorney, Agent, or Firm*—Dorsey & Whitney LLP

(57) ABSTRACT

A structural panel for use in building structures or in the formation, finish or decoration thereof includes an outer sheet and a connector sheet with a plurality of collapsible or compressible dividers therebetween. The panel in a rest condition is expanded and of a desired thickness for final use but can be compressed into a relatively thin thickness or profile for shipping purposes. The panel is very lightweight but structurally strong and can be selectively bent in one transverse direction if desired. The panel can be easily cut or formed into any predetermined size or shape.

12 Claims, 47 Drawing Sheets

U.S. PATENT DOCUMENTS 2,333,343 A 11/1943 Sendzimir
2,419,971 A 5/1947 Rumpf et al.
2,779,851 A 1/1957 Vogt
2,786,004 A 3/1957 Schwartz et al.
2,879,554 A 3/1959 Wheeler
3,024,879 A 3/1962 Kandra
3,112,533 A 12/1963 Hauer
3,314,846 A 4/1967 Niwa
3,381,438 A 5/1968 Bohnsack
3,384,519 A 5/1968 Froget
3,390,034 A 6/1968 Hull
3,413,765 A 12/1968 Williams
3,432,379 A 3/1969 Anderson
3,461,632 A 8/1969 Kuhne
3,542,636 A 11/1970 Wandel
3,669,820 A 6/1972 Fredericks
3,689,345 A 9/1972 Figge
3,738,083 A 6/1973 Shimano
3,741,859 A 6/1973 Wandel
3,749,636 A 7/1973 Tranquillitsky
3,762,977 A 10/1973 Langfeldt
3,789,567 A 2/1974 Rae et al.
3,819,465 A 6/1974 Parsons et al.
3,819,466 A 6/1974 Winfield et al.
3,892,898 A 7/1975 Yasui
3,974,607 A 8/1976 Balinski
4,020,205 A 4/1977 Haselbauer
4,034,135 A 7/1977 Passmore
4,086,739 A 5/1978 Hall
4,103,467 A 8/1978 Lindal
4,137,111 A 1/1979 Hansen
4,197,151 A 4/1980 Muzik
4,221,373 A 9/1980 Hans
4,223,053 A 9/1980 Brogan
4,237,663 A 12/1980 Storer
4,315,962 A 2/1982 Skoien
4,353,947 A 10/1982 Northcutt
4,384,178 A 5/1983 Nagai et al.
4,412,687 A 11/1983 Andre
4,438,613 A 3/1984 Hintsa et al.
4,530,197 A 7/1985 Rainville
4,546,584 A 10/1985 Mieyal et al.
4,595,187 A 6/1986 Bober
4,672,780 A 6/1987 Lockwood
4,709,435 A 12/1987 Steimier et al.
4,738,083 A 4/1988 Kawai et al.
4,838,380 A 6/1989 Lassiter
4,840,828 A 6/1989 Bottger et al.
4,852,316 A 8/1989 Webb
4,909,003 A 3/1990 Hennigan
4,916,027 A 4/1990 DelMundo
4,921,744 A 5/1990 Mitsui et al.
4,991,373 A 2/1991 Shaub
5,024,131 A 6/1991 Weidman
5,028,474 A 7/1991 Czaplicki
5,128,195 A 7/1992 Hegedus
5,147,710 A 9/1992 Bopp et al.
5,182,158 A 1/1993 Schaeffer
5,228,936 A 7/1993 Goodhue
5,240,533 A 8/1993 Bottger et al.
5,256,467 A 10/1993 Kato
5,270,092 A 12/1993 Griffith et al.
5,270,095 A 12/1993 Ito et al.
5,366,787 A 11/1994 Yasui et al.
5,424,113 A 6/1995 Ray et al.
5,433,053 A 7/1995 Tulloch
5,452,830 A 9/1995 Hopkins et al.
5,459,291 A 10/1995 Haines et al.
5,482,750 A 1/1996 Colson et al.
5,485,704 A 1/1996 Sandor, Sr.
5,543,204 A 8/1996 Ray
5,567,504 A 10/1996 Schakel et al.
5,670,220 A 9/1997 Skoien
5,685,124 A 11/1997 Jandl, Jr.
5,715,644 A 2/1998 Yasui
5,768,851 A 6/1998 Nagaoka
5,791,118 A 8/1998 Jordan
5,792,539 A 8/1998 Hunter
5,824,973 A 10/1998 Haines et al.
5,830,548 A 11/1998 Andersen et al.
5,832,685 A 11/1998 Hermanson
5,833,332 A 11/1998 Marshall et al.
5,840,413 A 11/1998 Kajander
5,846,038 A 12/1998 Bostelman
5,875,609 A 3/1999 Quinif
5,876,835 A 3/1999 Noble et al.
5,942,080 A 8/1999 Mortellite et al.
5,942,288 A 8/1999 Kajander
5,972,434 A 10/1999 Kajander
5,992,127 A 11/1999 Quinif
6,052,966 A 4/2000 Colson et al.
6,067,764 A 5/2000 Johansen
6,079,172 A 6/2000 Chenel
6,080,495 A 6/2000 Wright
6,103,336 A 8/2000 Swiszcz
6,158,179 A 12/2000 Ackerly et al.
6,171,654 B1 1/2001 Salsman et al.
6,199,337 B1 3/2001 Colson et al.
6,209,273 B1 4/2001 Jeffers et al.
6,296,469 B1 10/2001 Suzuki
6,345,486 B1 2/2002 Colson et al.
6,416,842 B1 7/2002 Swiszcz et al.
6,443,257 B1 9/2002 Wiker et al.
6,461,464 B1 10/2002 Swiszcz
6,511,730 B1 1/2003 Blair et al.
6,550,622 B2 4/2003 Koslow
6,656,858 B1 12/2003 Cahill
6,662,503 B2 12/2003 Cowell et al.
6,673,057 B1 1/2004 Ehrnsperger et al.
6,673,136 B2 1/2004 Gillingham et al.
6,712,747 B1 3/2004 Ballard
6,740,279 B2 5/2004 West et al.
6,797,167 B2 9/2004 Koslow
6,870,092 B2 3/2005 Lambert et al.
6,878,433 B2 4/2005 Curro et al.
6,946,528 B2 9/2005 Domine et al.
6,982,020 B2 1/2006 Swiszcz et al.
7,047,705 B2 5/2006 Foster
7,051,489 B1 5/2006 Swiszcz et al.
2002/0020142 A1 2/2002 Swiszcz et al.
2002/0053176 A1 5/2002 Colson et al.
2003/0154679 A1 8/2003 Swiszcz et al.
2004/0103980 A1 6/2004 Swiszcz et al.
2005/0095936 A1 5/2005 Jones et al.
2006/0112655 A1 6/2006 Swiszcz et al.
2006/0254178 A1 11/2006 Swiszcz et al.
2006/0254179 A1 11/2006 Swiszcz et al.
2006/0254204 A1 11/2006 Swiszcz et al.
2006/0254205 A1 11/2006 Swiszcz et al.
2006/0254206 A1 11/2006 Swiszcz et al.
2006/0260269 A1 11/2006 Swiszcz et al.
2006/0260270 A1 11/2006 Swiszcz et al.
2006/0260272 A1 11/2006 Swiszcz et al.

FOREIGN PATENT DOCUMENTS

CA 595285 3/1958
CA 920763 2/1973
CH 362824 8/1962
CH 383429 1/1965
CH 466538 1/1969
DE 525 253 5/1931
DE 684202 11/1939
DE 1 123 100 2/1962

| | | |
|---|---|---|
| DE | 1941054 | 6/1966 |
| DE | 1 609 661 | 5/1970 |
| DE | 2 243 528 | 3/1974 |
| DE | 23 53 927 | 5/1975 |
| DE | 92 05 226.6 | 9/1993 |
| DE | 196 01 172 A1 | 1/1997 |
| DE | 197 36 839 | 2/1999 |
| EP | 0 211 172 | 2/1987 |
| EP | 0 265 562 | 5/1988 |
| EP | 0 335 321 | 10/1989 |
| EP | 0 418 968 | 3/1991 |
| EP | 0 459 938 | 12/1991 |
| EP | 0 465 712 | 1/1992 |
| EP | 0 602 334 | 6/1994 |
| EP | 0 512 431 | 12/1996 |
| EP | 0 551 415 | 1/1997 |
| EP | 0 786 331 | 7/1997 |
| FI | 23939 | 5/1950 |
| FR | 874.638 | 8/1942 |
| FR | 1.116.248 | 5/1956 |
| FR | 1294807 | 4/1962 |
| FR | 2 164 463 | 8/1973 |
| FR | 2 509 223 | 1/1983 |
| FR | 2 626 599 | 8/1989 |
| FR | 2 630 478 | 10/1989 |
| FR | 2727711 | 6/1996 |
| GB | 1 318 693 | 5/1973 |
| GB | 1 384 577 | 2/1975 |
| GB | 1481980 | 8/1977 |
| GB | 2050547 | 1/1981 |
| NL | 272341 | 8/1964 |
| NL | 7007693 | 12/1970 |
| NL | 7315664 | 5/1974 |
| NL | 7402604 | 8/1974 |
| SU | 102898 | 3/1953 |
| SU | 1822898 | 6/1993 |
| WO | WO 89/00897 | 2/1989 |
| WO | WO 90/12934 | 11/1990 |
| WO | WO 91/19866 | 12/1991 |
| WO | WO 97/11825 | 4/1997 |
| WO | WO 98/52744 | 11/1998 |
| WO | WO 01/12911 | 2/2001 |

STRUCTURAL PANEL WITH COMPRESSIBLE DIVIDERS

CROSS REFERENCE TO RELATED APPLICATIONS

This application is a continuation of U.S. application Ser. No. 10/309,939 filed Dec. 3, 2002, which is a continuation-in-part of U.S. application Ser. No. 09/970,008, filed Sep. 27, 2001, now abandoned which is a continuation of U.S. application Ser. No. 09/839,373, filed Apr. 23, 2001, now abandoned which application claims the benefit of U.S. provisional application No. 60/199,208, filed Apr. 24, 2000. This application also relates to co-pending application Ser. No. 10/309,944 filed Dec. 3, 2002 entitled "Method and Apparatus For Fabricating Cellular Structural Panels". All of the above-identified applications are hereby incorporated by reference as if fully disclosed herein.

BACKGROUND OF THE INVENTION

1. Field of the Invention

A structural panel which finds particular uses as a ceiling panel or wall panel, includes an outer sheet having a plurality of spaced dividers protruding from one face thereof and a connecting sheet, or the like, parallel to and spaced from the outer sheet connecting the dividers together along their sides distal the outer sheet. The dividers are compressible for at least some period of time when pressure is applied thereto to reduce the thickness of the panel when desired, for example, for shipping purposes.

2. Description of the Relevant Art

Structural panels used in the finish or decoration of building structures have taken numerous forms from drywall to decorative or acoustical ceiling panels. While such panels obviously have different characteristics, the panels have had numerous shortcomings, such as from a weight standpoint, a shipping standpoint, a lack of aesthetic or acoustical variety, and the like.

Some of these panels are used, for example, in drop ceiling systems wherein a gridwork of inverted T-shaped support members define rectangular openings in which acoustical panels or the like are placed. Such acoustical panels are typically rigid in nature and somewhat brittle. As a result, they are difficult to insert or remove from the supporting gridwork and in many cases are easily damaged during such process. Further, the ceiling panels are relatively heavy and are of a fixed thickness so that their shipping dimensions are the same as their installation dimensions. Due in part to their weight and bulk during shipping, the cost per square foot of such panels is relatively high.

Drywall is also relatively heavy, difficult to work with and has a shipping size identical to that of its installation size. The shipping cost for drywall is, therefore, also relatively high.

It will be appreciated from the above that structural panels used in the construction, finish and decoration of building structures suffer numerous shortcomings. A panel that would overcome such shortcomings would, therefore, be desirable.

SUMMARY OF THE INVENTION

The structural panel of the present invention can be used for a number of different purposes as will be evident to those skilled in the art upon a reading of the present disclosure. Fundamentally, however, the panel would typically include an outer sheet of semi-rigid material with a plurality of dividers protruding from one face thereof. A connector in the form of a sheet or similar interconnecting system is secured to the distal edges of the dividers. The connector could take the form of another sheet of material, strands of connective fibers, or the like.

The dividers are compressible in nature and could take numerous forms. In some of the described embodiments, the dividers are elongated cells having foldable sides so that when lateral, i.e. transverse pressure is applied to the cell in predetermined directions it will compress into a shallow space. The dividers can be formed from folding a strip of semi-rigid material such that the longitudinal sides or partitions fold inwardly or outwardly when the divider is compressed laterally. The dividers are constructed so as to normally assume an expanded or extended position of predetermined configuration and are resilient so as to return to that configuration after having been compressed. The dividers are secured to the outer sheet and the connector so as to remain in position relative thereto.

As will be appreciated, with a panel so formed, it will assume an expanded form in its normal at rest condition, but by applying pressure, with a perpendicular component, to the outer sheet or the connector, the dividers are caused to compress allowing the entire panel to assume a very thin thickness or profile. When compressing, the outer sheet is moved perpendicularly toward the connector sheet with the dividers being compressed therebetween, i.e. there is minimal, if any, sliding movement between the outer and connector sheets. This, of course, is very advantageous for shipping purposes as a greater number of panels can be confined in a container than is possible with prior art panels that have a uniform thickness during shipping and use. The panels are also predominantly air filled and, therefore, are very lightweight.

It will further be appreciated from the more detailed description hereafter that the panels can be bent at least in one direction to facilitate installation in a drop ceiling or the like but are resilient to resume their normal at rest position. Further, the panels are not brittle and do not damage easily. They can, further, be cut very simply into any predetermined size and/or configuration.

Decorative sheets can also be overlaid onto the outer sheet, the connector sheet or the like of the panel to give the panel a desired aesthetic look. For example, a sheet of wood veneer, vinyl, patterned or contoured paper, colored paper, thin metal, polyester, other synthetic material, fabric, non-woven, or the like, can be overlaid so that the panel, when in use, has any desired appearance. Further, the panel can be interiorly or exteriorly lined with metal foil to change acoustical or other properties of the panel.

Other aspects, features and details of the present invention can be more completely understood by reference to the following detailed description of a preferred embodiment, taken in conjunction with the drawings and from the appended claims.

BRIEF DESCRIPTION OF THE DRAWINGS

FIGS. 92A–95A are views identical to FIGS. 92–95, respectively, showing an alternative system for mounting a clip to the end of a panel with the end of the panel being compressed in a manner to replace the stiffener strip used in FIGS. 92–95.

DESCRIPTION OF THE PREFERRED EMBODIMENTS

Figure 1:
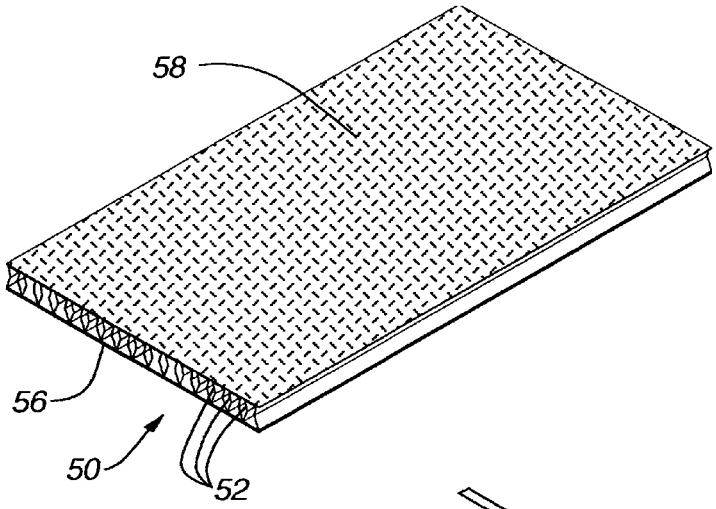
FIG. 1 is an isometric view of a panel formed in accordance with the present invention.
Figure 12:
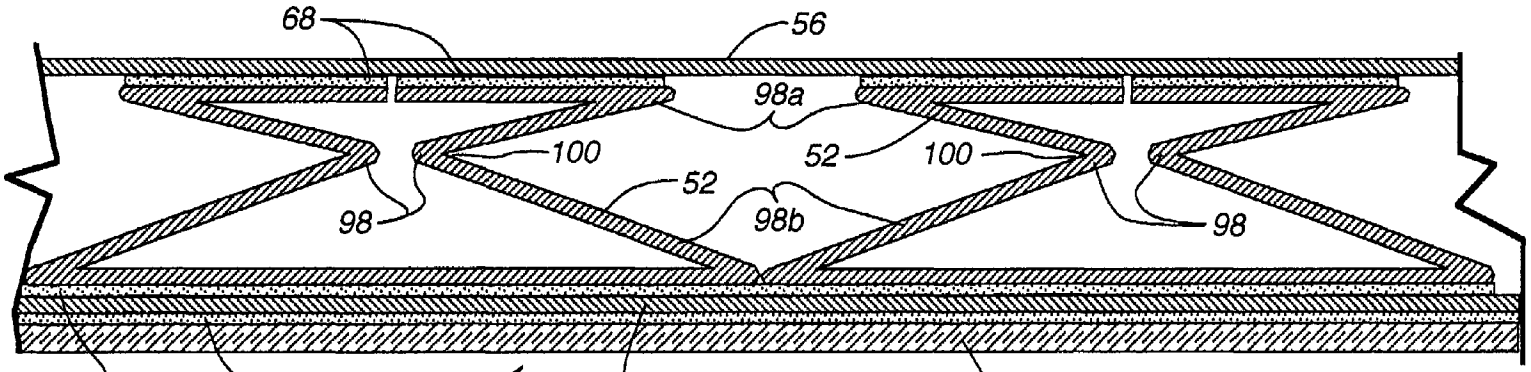
FIG. 12 is a fragmentary end elevation of a panel formed in accordance with the present invention and with a decorative layer of material being adhesively secured to the outer sheet of the panel.
Figure 17:
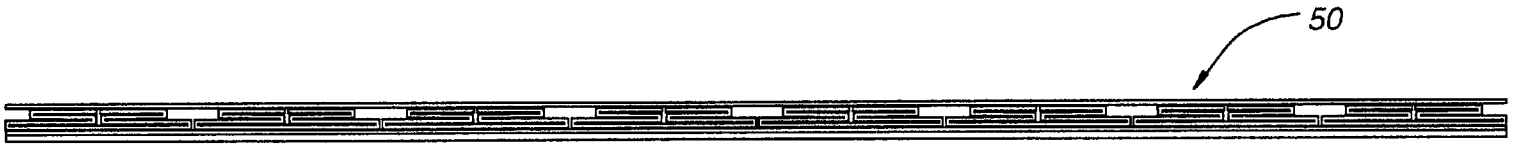
FIG. 17 is an end elevation similar to FIG. 16 with the panel being fully compressed.

The compressible structural panel 50 of the present invention is probably best shown in FIGS. 1 and 12 to include a plurality of compressible preferably parallel dividers or beams 52 extending between an outer sheet 54 (not seen in FIG. 1) and a connector sheet 56. A decorative sheet 58, as seen in FIGS. 1 and 12, may be provided to overlie in face-to-face relationship the outer sheet 54. As will be explained in more detail later, the panel is compressible from its normal expanded condition shown in FIGS. 1 and 12 to a fully compressed condition as shown in FIG. 17. The panel is also bendable in one transverse direction, as will be described in more detail later, but can be rigidified to inhibit bending in any direction. The panel is further comprised mostly of air and is, therefore, very light and easy to handle.

The panel 50 has many possible uses in building structures, such as, for example, it might be used as a wall panel, fixed ceiling panel, as panels for a drop ceiling, or the like. It will also be appreciated from the description that follows that the panels could be made of different sizes some of which might be inordinately large in comparison to conventional panels used in building structures. For purposes of the present disclosure, however, the panel is illustrated of conventional size and for use in a drop ceiling as shown in FIG. 2.

Figure 2:
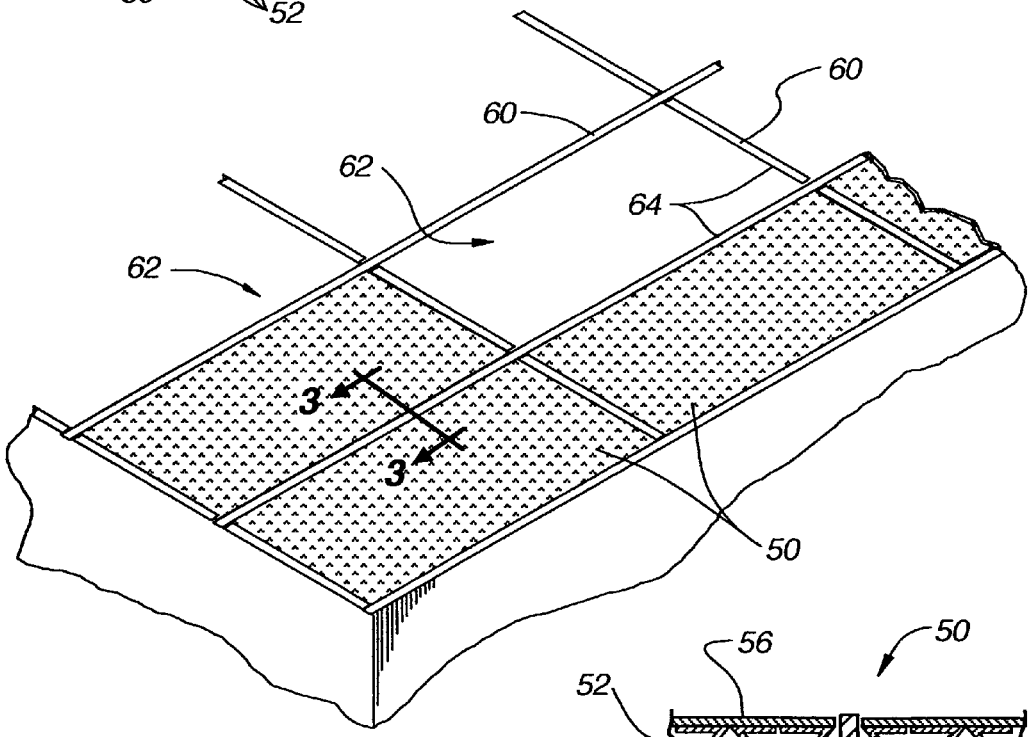
FIG. 2 is a fragmentary isometric view looking upwardly at a drop ceiling in a building structure, with the panels of FIG. 1 incorporated therein.
Figure 3:
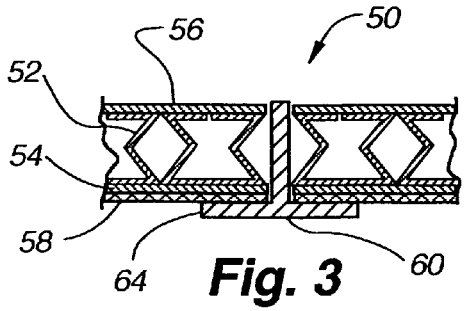
FIG. 3 is an enlarged fragmentary section taken along line 3—3 of FIG. 2.

In a typical drop ceiling system, a gridwork of elongated inverted T-shaped support members 60, as seen in FIGS. 2 and 3, are conventionally supported from a ceiling thereby defining rectangular openings 62 and peripheral support edges 64 around those openings on which a ceiling tile or panel 50 can be positioned. Traditional ceiling panels, not being bendable or otherwise pliable, are difficult to insert into the rectangular openings 62 and due to the fact that they are also brittle, they are many times damaged or broken when being inserted. The panel of the present invention, as will be appreciated with the description that follows, is inherently bendable so as to facilitate its insertion into the rectangular opening of a drop ceiling system and once in place will resume a desired flat planar orientation.

As probably best seen in FIG. 12, the dividers 52 are formed from individual strips 66 (FIG. 4) of material which have been pre-creased and folded into a desired configuration so that when incorporated into the panel 50 are transversely compressible allowing the panel to be compressed if desired. The dividers are secured along top portions thereof to the connector sheet 56 and along bottom portions thereof to the outer sheet 54 with the connections desirably being made with adhesive 68, but other systems for connecting the components would be evident to those skilled in the art. The outer sheet is, in turn, adhesively or otherwise secured in face-to-face relationship to the decorative sheet 58, which is the sheet that is exposed to the interior of the building structure in which the panel is incorporated. A sheet may be defined as one or more pieces of material interlocked, bonded, welded, or otherwise joined to define a broad expansive surface. The decorative sheet could be any material such as real or synthetic wood, vinyl, patterned or contoured paper, foil, polyester, other synthetic material, fabric, non-woven, or the like. Of course, this material would normally be selected for the desired decor of the room in which the ceiling panel is being incorporated but might also be selected for its acoustical properties.

In the disclosed embodiment, the outer sheet 54, the connector sheet 56 and the dividers 52 may be, but would not necessarily be, made from the same material. That material might be a fiberglass sheet composed of randomly oriented glass fibers bonded together in a resin. As will be explained in more detail later, the resin could be a thermosetting resin or a thermoplastic resin depending upon the desired characteristics of the panel. The adhesive 68 used to join the various components of the panel might typically be a thermosetting adhesive, which bonds the adjacent components upon attaining a predetermined temperature. Illustrations or examples of suitable adhesives would include polyurethane resins, copolyester hot melts, hot melt polyurethane reactive adhesives, two part epoxies, two part urethanes and RTV silicones.

The dividers 52, as best illustrated in cross-section in FIG. 12, might, in combination, be formed from one continuous strip of material but in the disclosed embodiment are each individual dividers of an elongated cellular or tubular configuration. Each divider is formed from the strip 66 of material such as fiberglass in a manner as shown in FIGS. 4–11. The strip material could be any color which is the same as or different from the color of the connector sheet 56, decorative sheet 58, or outer sheet 54.

Figure 4:
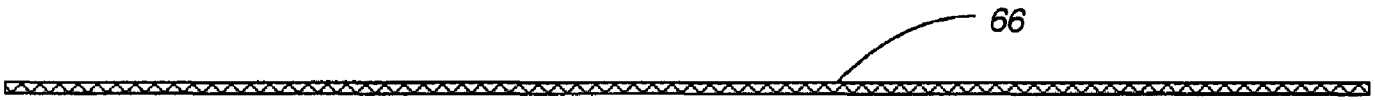
FIG. 4 is a front elevation of a strip of material from which a divider of the panel of the present invention is made.
Figure 5:
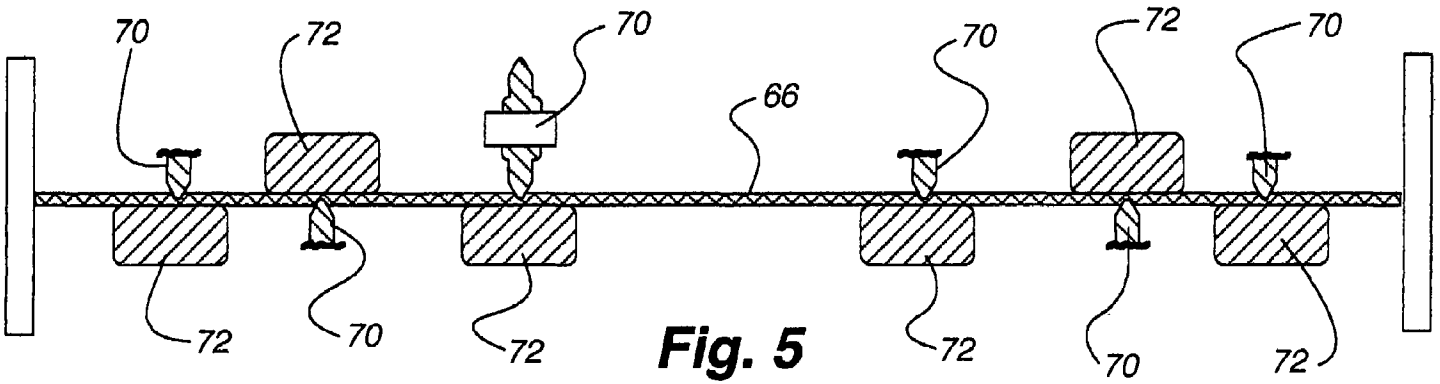
FIG. 5 is a front elevation of the strip of material shown in FIG. 4 being creased to form pre-fold lines.
Figure 6:
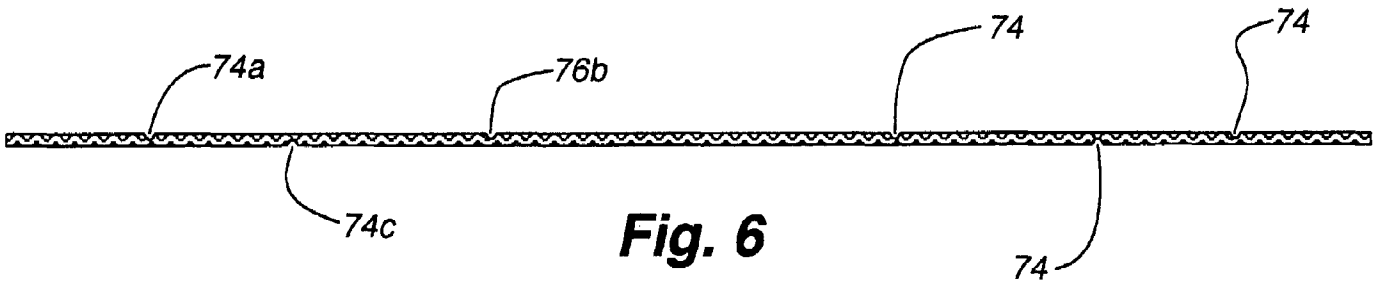
FIG. 6 is a front elevation of the strip of material shown in FIG. 4 after having been creased as shown in FIG. 5.
Figure 7:
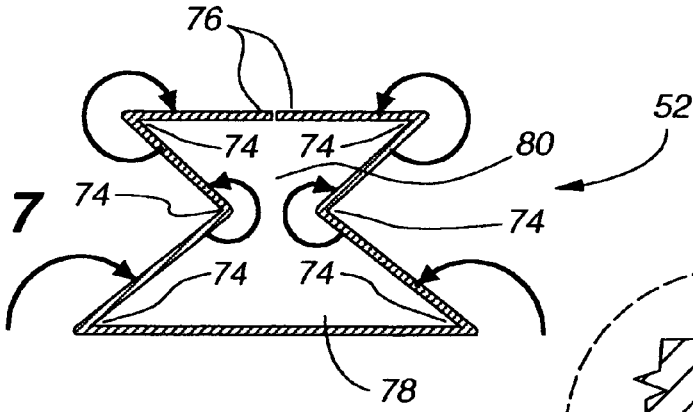
FIG. 7 is a front elevation of the strip of material shown in FIG. 6 having been folded along the preformed fold lines.
Figure 8:
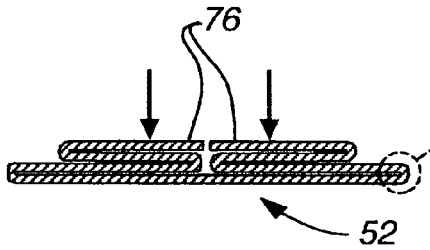
FIG. 8 is a front elevation of the divider as shown in FIG. 7 having been compressed.
Figure 8A:
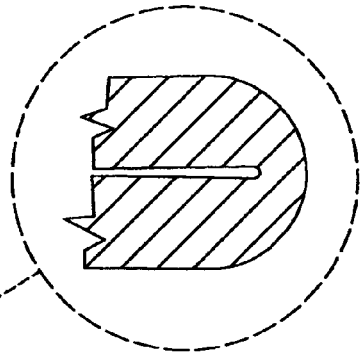
FIG. 8A is an enlarged section of the circled area of FIG. 8.

In FIG. 4, a front view of the flat strip 66 is illustrated before it is passed into a creaser. In the creaser, as seen in FIG. 5, the material is passed between rotary creasing wheels 70 and back up rollers 72 so that longitudinally extending creases 74 are formed in the material at predetermined laterally spaced locations. In the preferred system, the creasing wheels have an arcuate creasing edge approximately {fraction (1/32)} inch in diameter and the back-up rollers are of 90-durometer hardness. With this apparatus, an efficient fold line is created without cutting the material or at least without damaging many, if any, of the glass fibers so that a spring force is retained in the material. As will be appreciated, starting at the left of the strip of material as shown in FIG. 5, a crease 74*a* is placed near the left edge in the top surface and another crease 74*b* is placed in the top surface at a location spaced slightly to the left of center. Between these two locations a crease 74*c* is placed in the bottom surface of the strip. Corresponding creases are placed on the right side of the strip so that the strip upon exiting the creaser has six creases formed therein as illustrated in FIG. 6. The strip 66 of material is then folded over and along the longitudinal creases as illustrated in FIGS. 7, 8 and 8A bringing the side edges 76 of the strip together at a centered location on the top of the divider 52. Preferably, the breaking diameter of the fibers in the material is less than the combined thickness of the folded material so that minimal, if any, damage occurs to the fibers during folding. In other words, the fibers in the material will not break when the material is folded upon itself. When so formed, the divider forms an elongated tube or cell comprised of two truncated triangles 78 and 80 that are inverted relative to each other. The lower triangle 78 has a broader base than the upper triangle 80. The fiberglass material from which the divider is made is semi-rigid so that it can be flexed and folded along crease lines 74 but remains substantially flat between such folds. Applying pressure to the cell as configured in FIG. 7 in a vertical direction causes the components of the cell to compress so that the divider assumes a compressed configuration as shown in FIG. 8. In the compressed configuration, the adhesive 68 can be applied across the top and bottom of the divider with the adhesive preferably being a thermosetting or thermoplastic adhesive applied in any of various different ways, which would be readily known to those skilled in the art.

Figure 10:
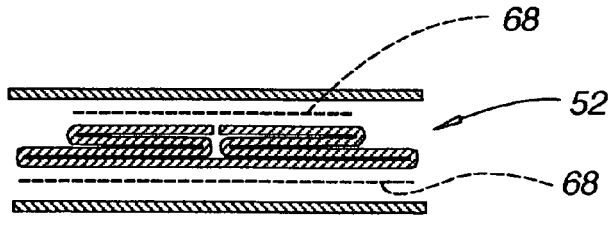
FIG. 10 is a front elevation similar to FIG. 9 with an outer sheet and a connector sheet being positioned above and below the layers of adhesive.
Figure 11:
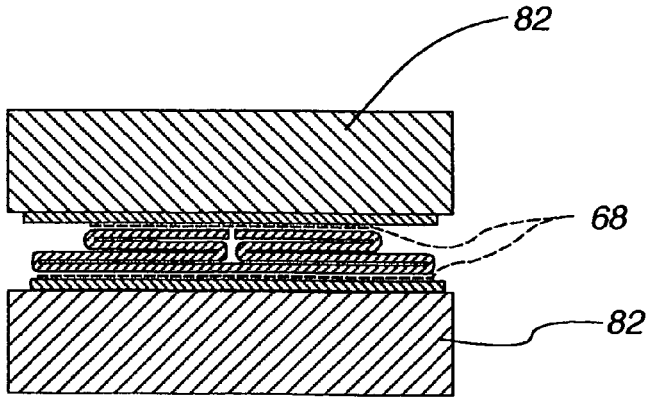
FIG. 11 is a front elevation showing the composite illustrated in FIG. 10 being heat compressed between heating elements.

As seen in FIG. 10, the divider 52 with adhesive 68 applied to its upper and lower faces is then passed between the outer sheet 54 and the connector sheet 56 and as seen in FIG. 11, the entire laminate is then compressed between heated plates 82 which activate the adhesive 68 in the case of thermoplastic adhesives or act as a catalyst in the case of thermosetting adhesives. Subsequent heat may be used to increase the curing rate of a thermosetting adhesive if selected.

If a thermosetting resin is used in bonding the glass fibers within the strips 66 and sheets 54 and 56 of material, the panel 50 will naturally expand to its preformed condition, as shown in FIG. 12, after having been compressed and bonded together. If the resin bonding the glass fibers is a thermoplastic resin, it will remain compressed but need only be reheated and the strips will inherently expand under the heat, which might be applied, for example, with a hair dryer. Under any circumstance, the panel can either inherently expand or be selectively expanded to a desired height or thickness.

While it would be evident to one skilled in the art to modify the material from which the dividers 52, outer sheet 54 and connector sheet 56 are made, and in fact they could each be made of different materials, for purposes of the present disclosure, the following materials have been found satisfactory for each of the outer and connector sheets as well as the dividers:

JM type 8802-100GSM (Glass Mat with thermoplastic resin) or JM type MF5020GSM (Glass Matt with thermosetting resin), each made by Johns-Manville Corp. of Denver, Colo.; or Ahistrom type 51 50 GSM (Glass Tissue with thermosetting resin) made by Ahlstrom of Karhula, Finland.

There are other materials that might work well, for example, for the outer sheet or the connector sheet but not for the dividers and, conversely, there are some materials that might work well for the dividers but not for the outer and connector sheets. For example, the outer and connector sheets could be one of many different sheet types of material, such as paper, cardboard, metal, plastic, polyester, other synthetic material, or the like. It does not even need to have structural stability as such stability is given to the panel by the dividers. The dividers, on the other hand, while preferably being made of fiberglass, could be made of a carbon fiber mat, some papers, cardboards, woven materials, films, or combinations thereof, with the important feature being that they have some predetermined modulus of resiliency, similar to the specific materials identified above, which allows them to be folded but remain resilient. If the materials are to be creased to define fold lines as discussed above in connection with fiberglass material, it is important that the material retain the modulus of resiliency after having been creased, which, of course, is true with fiberglass or carbon fiber materials.

Figure 13:
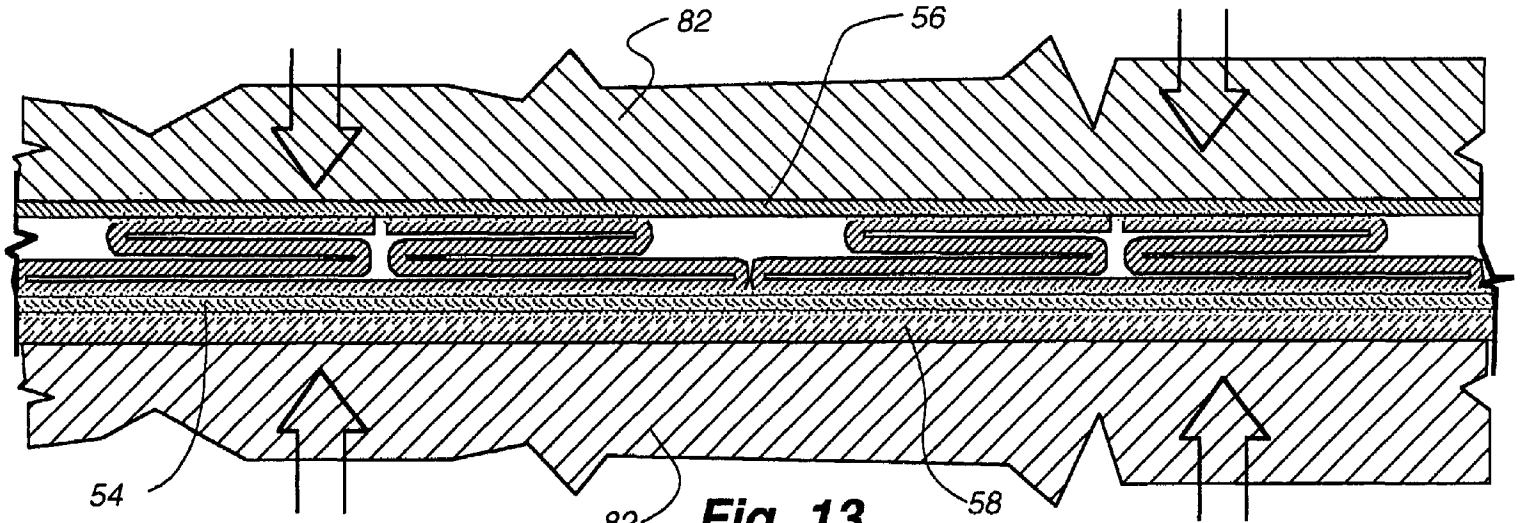
FIG. 13 is a fragmentary end elevation of the panel as shown in FIG. 12 being compressed between heated press elements.

As seen in FIG. 13, the decorative sheet 58 could also be positioned between the outer sheet 54 and the heat press 82 with a suitable adhesive 66 therebetween to bond the decorative sheet in face-to-face relationship to the outer sheet. The resulting panel, of course, is illustrated in FIG. 12. When bonding the decorative sheet to the outer sheet, in addition to the alternatives mentioned above, a porous decorative sheet can be used which is bonded to the outer sheet with adhesive in a grid or printed dot pattern. This would allow the lamination to more freely pass or transmit sound therethrough. Conversely, if a continuous layer of adhesive were used to join the decorative sheet and the outer sheet, the transmission of sound through the laminate would be decreased. Through the lamination process, a relatively unstable decorative sheet can be rendered flat and stable with the resultant flat surface possibly also providing impact and puncture resistance superceding that of the outer sheet. It will be appreciated that the acoustics of the panel can be changed by varying the outer sheet material, the strip material, the adhesive, the connector sheet, the spacing between the sheets, the manner in which the assembly is joined together, or the like.

Other materials could cover or be laminated to the connector sheet 56 as well. For example, films could be applied over the connector sheet or an additional sheet of non-fiberglass material laminated thereto. The panel in such case could be handled without gloves in that fiberglass can be abrasive and otherwise harmful to exposed skin. Further, the film or laminate for the connector sheet 56 could be printed with a manufacturer's identification or with a measuring grid to facilitate cutting the panel to desired sizes. Further, and as mentioned previously with regard to the outer sheet 54, porous laminates or films could also be overlaid onto the connector sheet for acoustical purposes.

As mentioned, numerous materials might have applicability in the present invention, but in a first preferred mode, the connector sheet and the dividers are made of the same material, which is a fiberglass mat made by Johns-Manville Corporation and the mat may be one designated No. 5802 or one designated No. 5803 by Johns-Manville. The 5802 is a 120 g/m.sup.2 mat composed of 10% PET/65% 16-micron glass/25% MF. The 5803 is a 100 g/m.sup.2 mat composed of 12% PET/68% 16-micron glass/20% MF. MF is an abbreviation for melamine formaldehyde resin, which exhibits the characteristics of a thermoset resin. PET is an abbreviation for a polyethylene terephthalate. Dividers made from either of the 5802 or 5803 material have the ability to expand with little or no addition of heat after having been creased and folded as described previously and after having been fully compressed. A more complete description of the Johns-Manville products and related products can be found in U.S. Pat. Nos. 5,840,413, 5,942,288, and 5,972,434, which are herein incorporated by reference.

The preferred outer sheet for the first preferred mode is a composite lamination of an aesthetically pleasing textile material, which has been laminated to a glass non-woven base using a co-polyester hot-melt adhesive. Several such laminates can be equally desirable. The first such laminate utilizes an aesthetically pleasing textile material in the nature of a thermal bond polyester non-woven having a basis weight in the range of 45 to 75 g/m.sup.2 and can be purchased from Hollingsworth and Vose of Floyd, West Va. The adhesive pattern used to thermally bond the polyester fibers in the non-woven material becomes the visual pattern upon the bottom surface of the outer sheet. When a small point-bonding pattern with a bonding area of approximately 7% is used, the preferred polyester non-woven textile material is one designated by Hollingsworth and Vose as TR2315A–B. When a large point-bonding pattern is used, approximately 21% bonding area, the preferred textile material is designated TR2864C1 by Hollingsworth and Vose. Either non-woven aesthetically pleasing textile material is then screen coated using an acrylic binder/flame retardant coating with an additional weight of 15 to 25 g/m2. The coating can be formulated to increase the durability of the non-woven aesthetically pleasing textile material while adding flame retardant. The polyester non-woven textile material can then be run through a hot-melt roll coater/laminator where a flame resistant co-polyester adhesive from, for example, EMS Chemie North America of Sumter, N.C., is applied to the surface of either the polyester non-woven textile material or the glass non-woven base material to be coated thereon. The coating weight of this adhesive is dependent upon the bond strength desired to achieve between the polyester non-woven textile material and the glass non-woven base material. Generally an adhesive having a basis weight in the range of 30 to 45 g/m.sup.2 has been found desirable. A Gravure roller, preferably having a crosshatch 25.times.25 pattern thereon is used to compressively laminate the glass non-woven base to the polyester non-woven aesthetically pleasing textile material. The depth of the engraving on the Gravure roller is a main variable related to the adhesive weight per area being applied. The adhesive formulation obtained from EMS Chemie is a 50:50 mix of two materials with the materials designated by EMS as Grilltex D1573G and Grilltex VP1692G. The EMS Grilltex VP1692G is compounded with a 25% loading of an organic phosphorous flame retardant. The resulting 50:50 mix produces a final flame-retardant loading of approximately 13.5%. Following the application of the adhesive upon the surface of the polyester non-woven material, the adhesive is kept molten until it is joined with the glass non-woven base material. The glass non-woven base material is preferably the afore-noted 5802 (120 g/m.sup.2) matting sold by Johns-Manville, a glass non-woven from Ahlstrom designated GFT-413G10-60-1300 (60 g/m.sup.2) or a non-woven glass matting from Ahlstrom designated GFT-413G10-80-1300 (80 g/m.sup.2). A composite laminate made with the above-noted materials is inherently translucent and that feature combined with the ability of light to travel down the length of the cells defined between the dividers in a finished panel makes it possible to see shadows in the areas where two cells meet.

The shadowing can be decreased if desired, by using, in lieu of the afore-noted polyester non-woven textile material, an aesthetic material having a silver, gray, or black color upon its back side. The backside is the one, which receives the hot-melt adhesive and is subsequently laminated to the glass non-woven base matting. The coloring reduces the amount of light which can travel down the cells and up through the surface thus reducing the shadowing effect. 5% carbon black in the aesthetic material has proven to provide desirable results.

An alternative aesthetic textile material to the polyester non-woven described above is a knit material, which has a silver, gray, or black appearance on one side. To achieve this, a knit material from Gilford technical textiles of Greensboro, N.C., has been used with the knit material being composed of two different types of yarns in a single knit construction. The preferred yarns used are nylon and polyester. The nylon yarns are mainly observed on one side of the matting and the polyester on the other. The knitted material is "cross-dyed" with black dyestuffs that have affinity for the nylon and leaving the polyester white in color. A flame retardant and soil release may also be added to the dye bath formulation. The knit is then stabilized and a melamine resin added to stiffen the fabric. The knit material can then be laminated to the glass non-woven base material as previously described with the polyester fiber material. The preferred Gravure roller pattern used in this case is one having a random computerized dot pattern and which is well known in the trade. When the silver, gray, or black side of the knit is laminated to the glass non-woven base material, the light transmittance through the laminate is reduced by the presence of the darker layer. The visual appearance of the surface is unique in that it mimics the appearance of a perforated metal ceiling panel. You can also laminate the white side of the knit material to the glass non-woven material and when doing so, the appearance of the knit lamination mimics a metal screen material but also eliminates the shadowing effect.

Another method of reducing reflected light and transmitted light shadowing is the use of a colored black, gray, or silver glass non-woven base material. If the pigmented black, gray, or silver glass non-woven is laminated to either the polyester fiber mat or the knit matting described previously, the shadowing effect can also be reduced.

It should also be noted that the coloring of the aesthetic material, whether it be the polyester fiber matting or the knit material, could be obtained by printing or coating the materials with a colored pigment. This would involve a secondary printing or coating step, which would add to the cost. The use of colored or pigmented adhesive may also be employed as a low-cost solution to the shadowing and/or increased surface whiteness of the aesthetic material.

Still a further system for reducing or eliminating shadowing is to make the dividers 52 a gray color such as by making the divider from a material with 0.03% carbon black.

Through experimentation, the flame resistancy of a panel formed in accordance with the present invention can be improved by using Melamine Formaldehyde exclusively as the binder for the glass fibers in both the outer sheet and the connector sheet in the panel. In other words, there would be no thermoplastic resin utilized in the outer sheet or connector sheet, and since the Melamine Formaldehyde does not burn, there is some improvement in the flame resistancy of the panel. A core for such a panel in which improvement is desired for the flame resistancy could still be made from the John's Manville fiberglass matting designated No. 5802 but the adhesive used to bond the dividers to the outer sheet and connector sheets would be made with no fire resistant additives so that the glue burned quickly and would smoke for a shorter time period. The adhesive used in the outer sheet between the decorative layer and the underlying base layer would desirably have fire resistant properties.

In a second preferred embodiment of the invention, the decorative layer material would not change from that described previously, but the outer layer, connector layer and dividers would be made of materials that do not use Melamine Formaldehyde as the Melamine Formaldehyde can produce toxic gases if the panels are subjected to high temperatures that affect complete decomposition of all organic materials. In this second preferred embodiment, the outer layer would be made of a 120 g/m.sup.2 (gsm) glass matte composed of 85% 13 micron glass fibers bound with 15% PAA binder. PAA is an acronym for Poly Acrylic Acid, which may be categorized as a thermoset resin. Such a glass matte material is available from Johns Manville of Denver, Colo., and designated R8235 glass matting. The connector sheet could be either a 13 micron or 16 micron glass matte, which is also 120 gsm composed of 85% glass fiber and 15% PAA binder. Accordingly, the connector sheet could be made from the same Johns Manville R8235 material or a similar material where the glass fibers were 16 micron rather than 13 micron. The dividers are made from a material that is a 120 gsm glass matte composed of 70% 16 micron glass fibers bound with 20% PAA and 10% PET (polyester fibers). The divider material can also be obtained from Johns Manville under R8221 glass matting.

Figure 14:
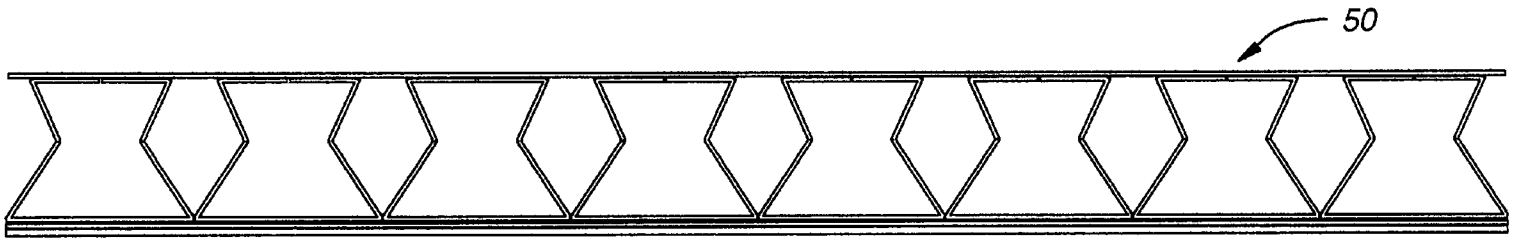
FIG. 14 is an end elevation of a panel as shown in FIG. 12 having dividers with asymmetric partitions and with the panel fully expanded.
Figure 15:
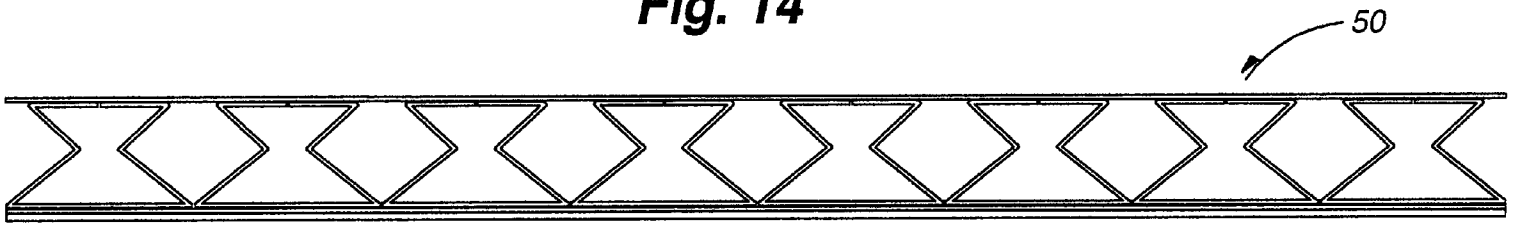
FIG. 15 is an end elevation similar to FIG. 14 with the panel being partially compressed.
Figure 16:
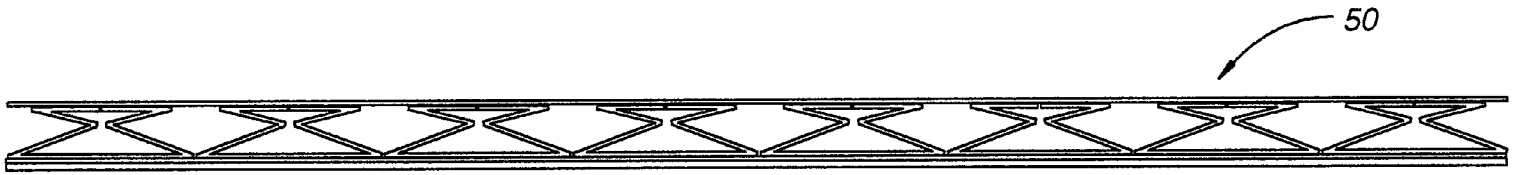
FIG. 16 is an end elevation similar to FIG. 15 with the panel being slightly further compressed.

FIGS. 14–17 illustrate the assembled panel 50 in progressively compressed conditions with FIG. 14 showing the panel in a fully expanded condition and FIG. 17 in a fully collapsed or compressed condition.

Figure 18:
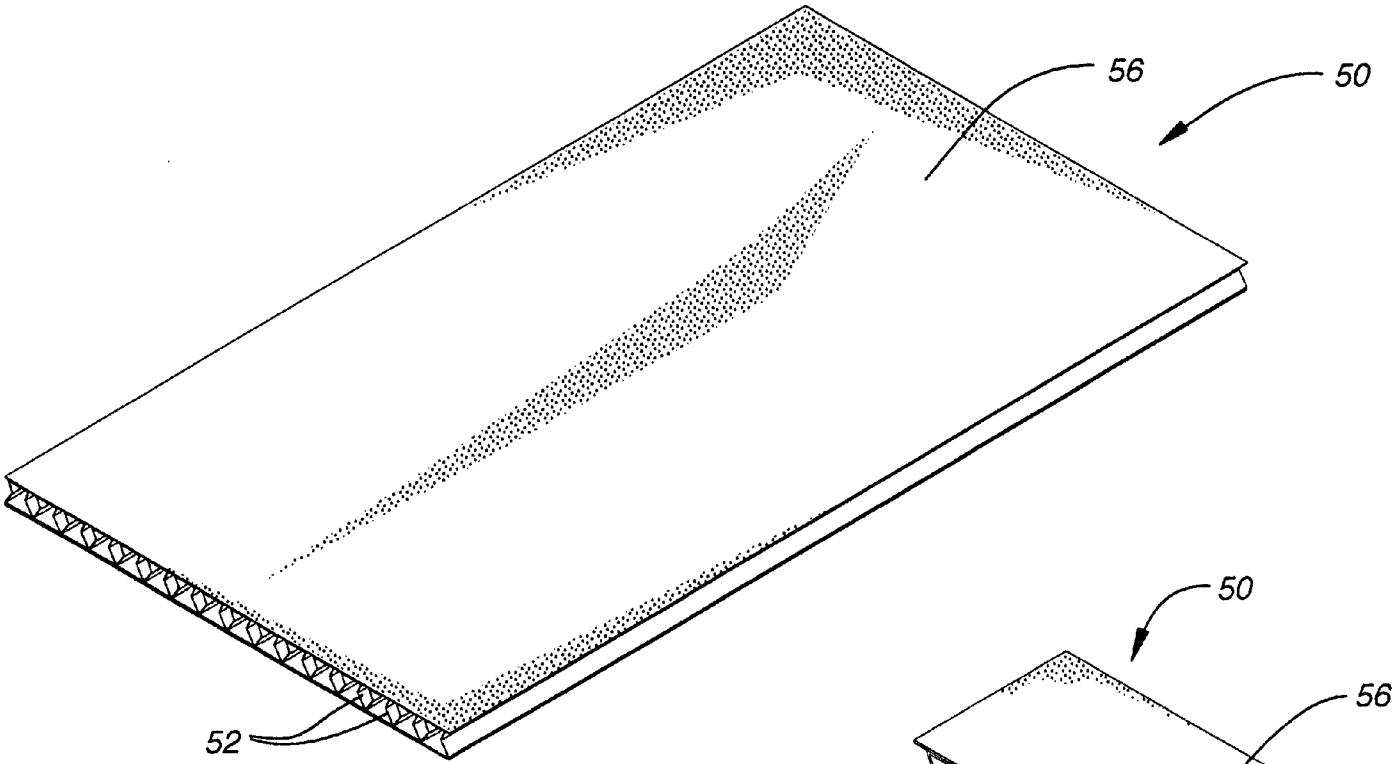
FIG. 18 is an isometric view of the panel as shown in FIG. 14.
Figure 19:
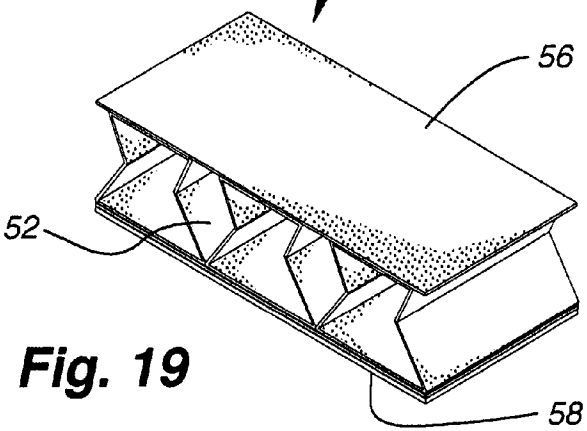
FIG. 19 is an enlarged isometric view of a portion of the panel shown in FIG. 18.
Figure 20:
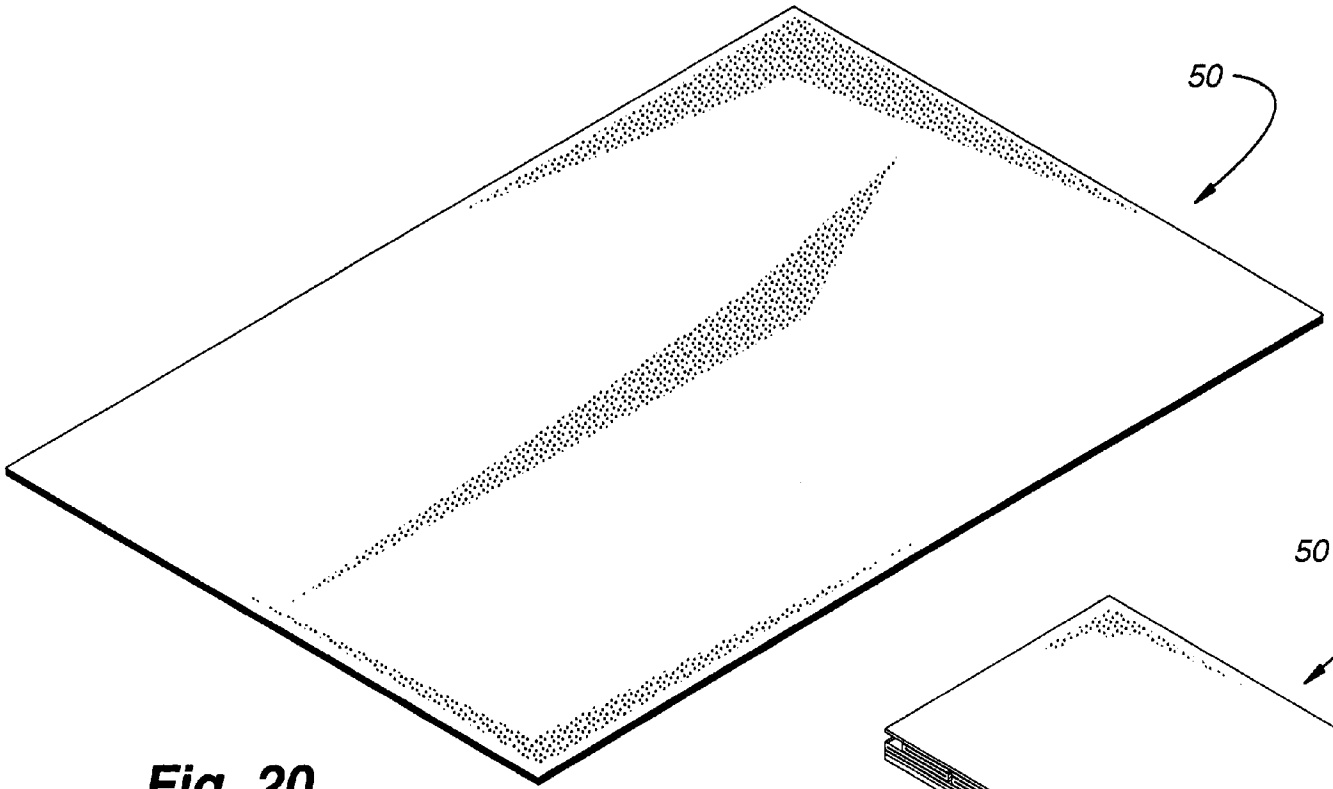
FIG. 20 is an isometric view of the panel shown in FIG. 18 in a fully compressed condition.
Figure 21:
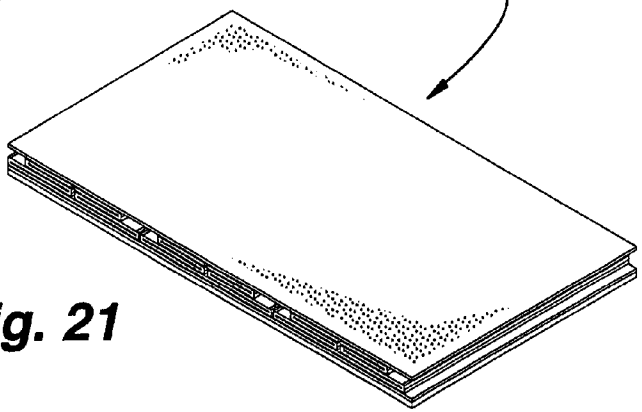
FIG. 21 is an enlarged isometric view of a portion of the panel as seen in FIG. 20.
Figure 23:
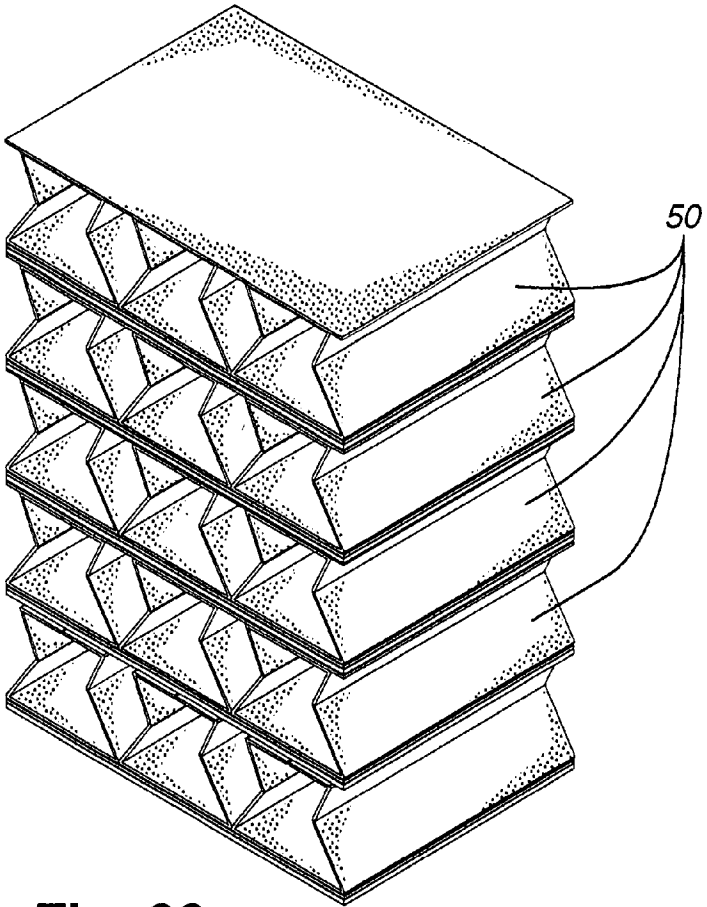
FIG. 23 is an isometric view of the panels shown in FIG. 22 in an expanded condition.
Figure 22:
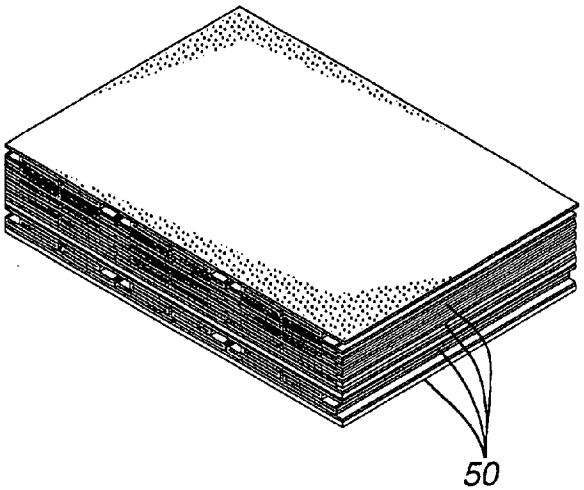
FIG. 22 is an isometric view of a plurality of panels stacked together while in a compressed condition.

An isometric view of the panel 50 is shown in FIG. 18 and an enlargement thereof in FIG. 19. It will there be readily appreciated that the dividers 52 are evenly spaced from each other while extending parallel to each other and longitudinally of the panel. Of course, in FIGS. 18 and 19, the panel is fully expanded with the panel being shown fully compressed in corresponding views 20 and 21, respectively.

A problem with conventional ceiling panels is that they remain of the same size and thickness during shipment, installation and use. A desirable feature of the panel of the present invention resides in the fact that, while the panel has a predetermined at rest or expanded thickness that might correspond with that of conventional ceiling panels, it can be compressed for shipping purposes so that far more panels can be packed in one container for shipping purposes thereby improving shipping costs considerably. When the panels are removed from the shipping container, they will either naturally expand if a thermosetting resin was used in the fiberglass material or can be heated to expand if a thermoplastic resin was used. While the panel could be expanded to any predetermined desired thickness, a preferred panel for ceilings might be in the range of 12 to 26 mm in thickness when desirably expanded depending on the span of the panel but could be thicker or thinner depending on use, and approximately 3–4 mm in thickness when fully compressed.

Figure 24:
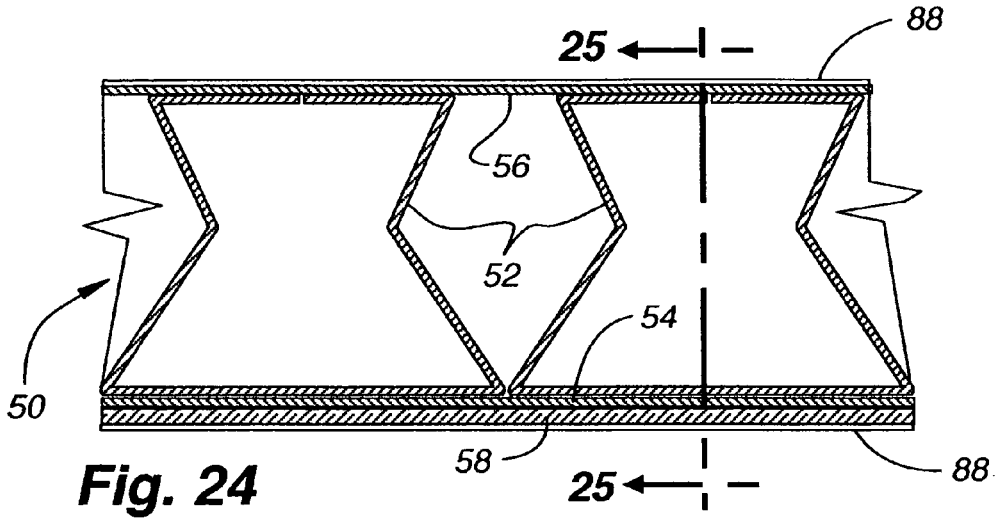
FIG. 24 is an enlarged fragmentary end elevation of the panel shown in FIG. 14 with end supports for the panel to inhibit the panel from bending.
Figure 25:
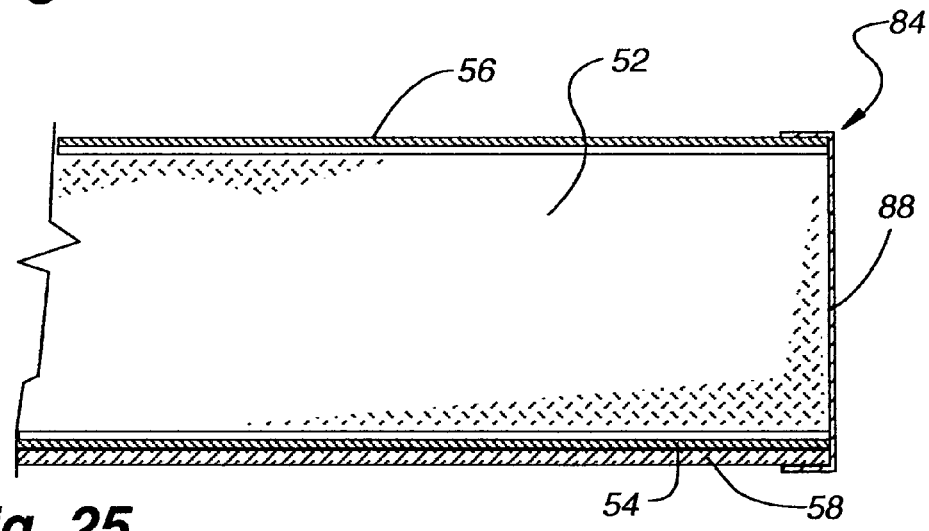
FIG. 25 is a fragmentary section taken along line 25—25 of FIG. 24.
Figure 26:
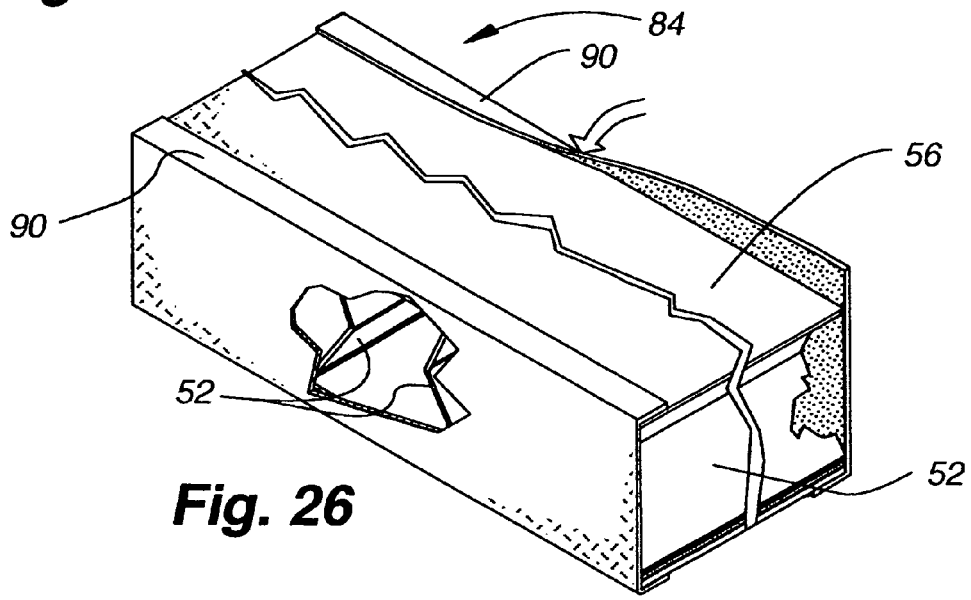
FIG. 26 is a fragmentary isometric with parts removed showing an end support on one end of the panel and a second end support being installed on the opposite end of the panel.
Figure 31:
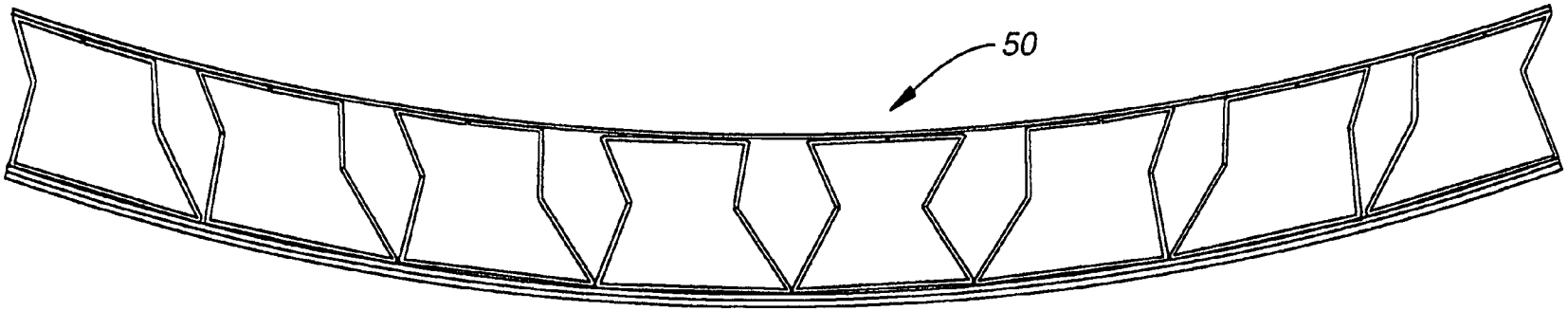
FIG. 31 is an end elevation of the panel shown in FIG. 14 with the panel being curved concave upwardly.
Figure 32:
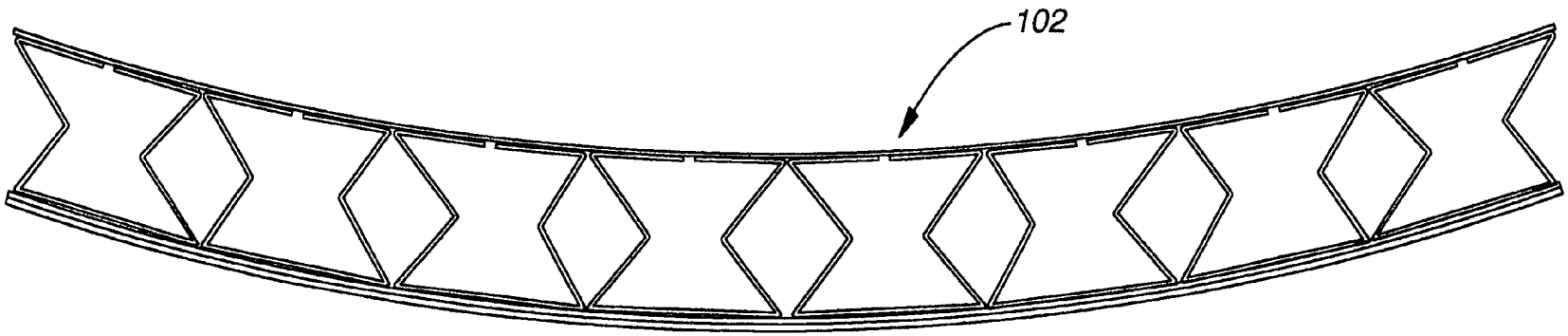
FIG. 32 is an end elevation of a panel in accordance with a second embodiment of the present invention wherein the partitions of the dividers are symmetric rather than asymmetric as shown in FIG. 31.
Figure 65:
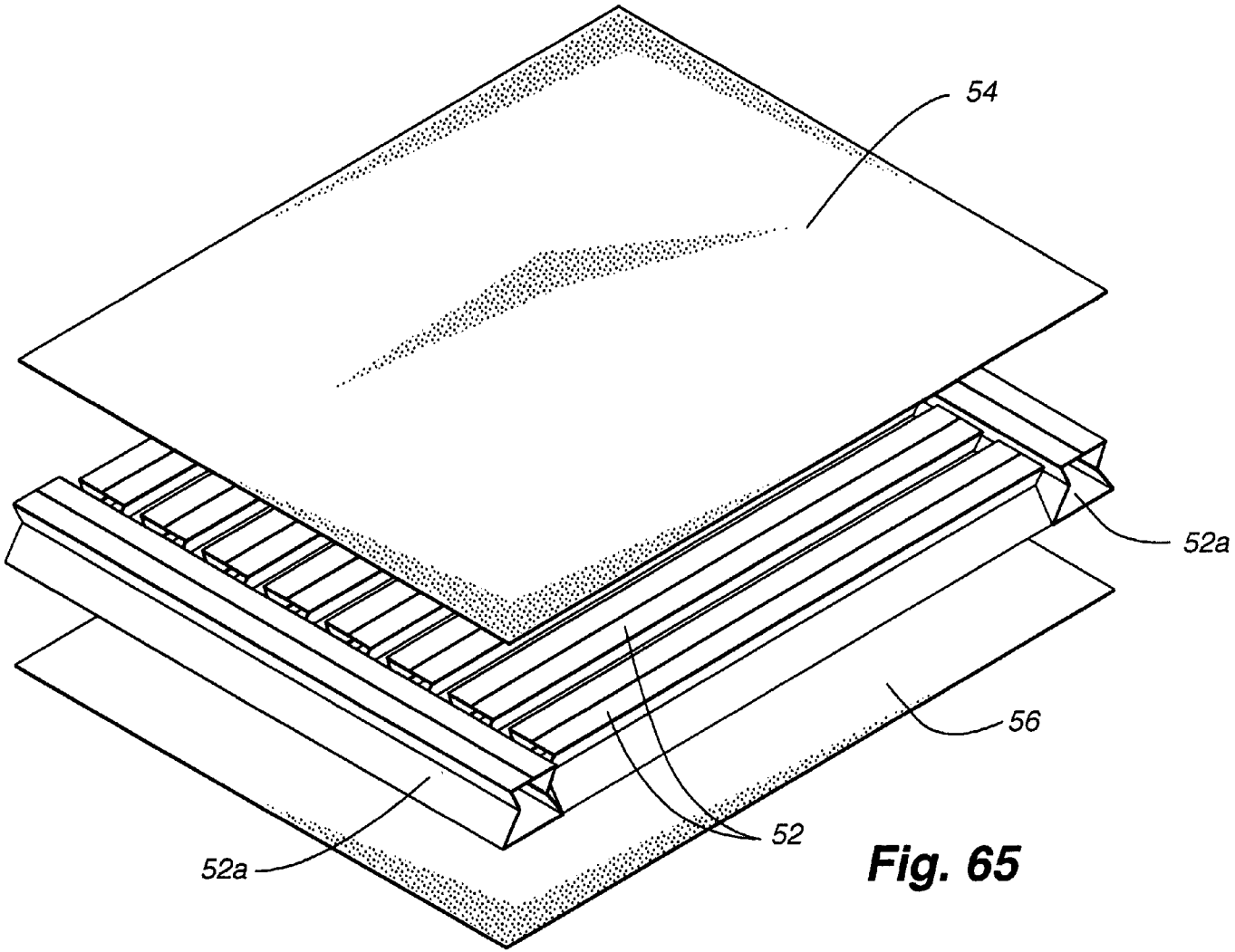
FIG. 65 is an exploded isometric view of a panel similar to that shown in FIG. 1 that has been rigidified by providing additional dividers at the ends of the panel that extend perpendicular to the primary dividers.
Figure 67:
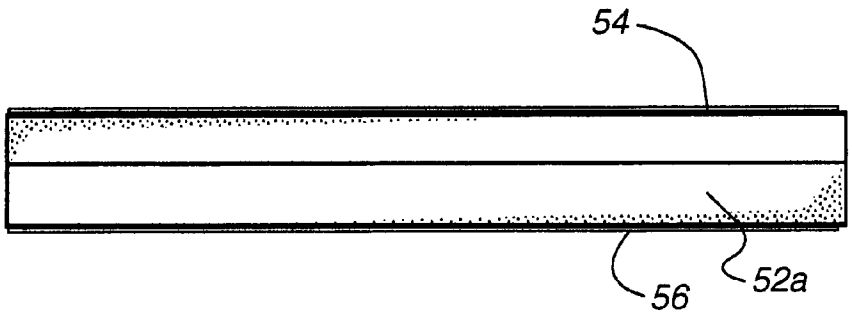
FIG. 67 is an end elevation of the panel shown in FIG. 65.
Figure 66:
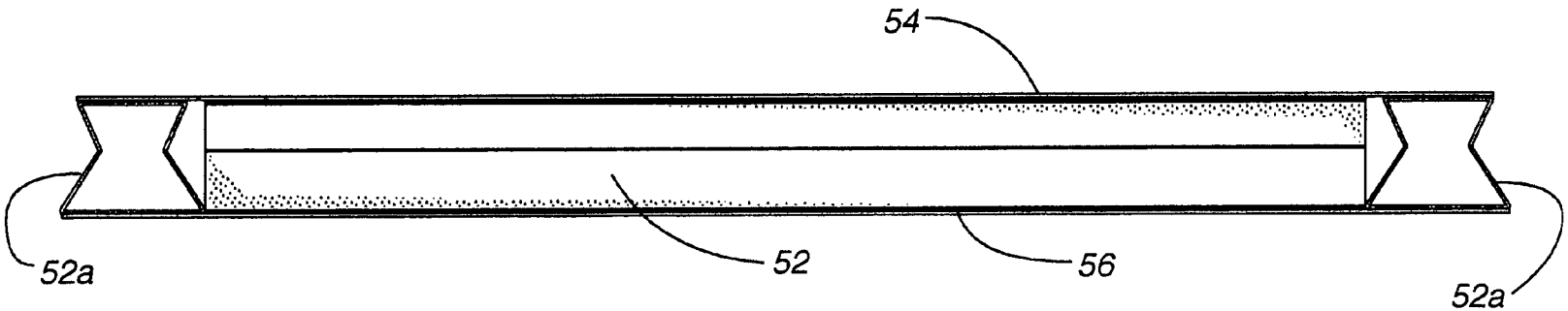
FIG. 66 is a side elevation of the panel shown in FIG. 65.

As best seen in FIG. 31, the panel 50 can easily be flexed or bent transversely of the direction in which the elongated dividers 52 extend to facilitate the insertion of the panel into the support structure of a drop ceiling, for example. In fact, the panel can be preformed in the bent configuration so that this becomes its at rest configuration should a curved panel be desired for some reason. The panel will not flex or bend very easily in the opposite direction, i.e. the direction in which the dividers extend, as the tubular configurations of the dividers will inhibit such. If desired, however, the panel can be substantially rigidified so that it is inhibited from bending in either transverse direction by placing support members 84 along opposite ends of the panel so as to cover the open ends 86 of the tubular or cellular dividers. The support members 84 can either be preformed C-shaped channel members 88 (such as plastic, aluminum, etc.) of a rigid configuration, as illustrated in FIGS. 24 and 25, or can be strips 90 of adhesive material, for example, which are adhered to the ends of the panel as illustrated in FIG. 26. While the strips of adhesive material would have some flexibility, it would have enough stiffness so that when incorporated onto the ends of the panel, it will inherently prevent the panel from bending in a transverse direction relative to the longitudinal direction of the dividers. Plastic or vinyl tapes or the like would be an illustration of a suitable adhesive strip. As a further alternative and as shown in FIGS. 65–67, a divider 52*a* could be placed at each end of the panel to cover the open ends of the parallel dividers 52. The outer sheet 54 and connector sheet 56 are extended to cover the dividers 52*a* which serve to rigidify the panel in the cross direction.

The panel can also be rigidified in a cross-direction by incorporating cross dividers (not shown) at selected locations throughout the panel. The cross dividers would run perpendicularly to the primary dividers and might assume an identical or varied configuration to the cross-sectional configuration of the primary dividers. Of course, the cross dividers could be adhesively bonded in the panel the same as the primary dividers. The height of the dividers, whether they be primary dividers or cross dividers, can also be varied across the width of a panel to create varied structural and aesthetic effects.

Figure 28:
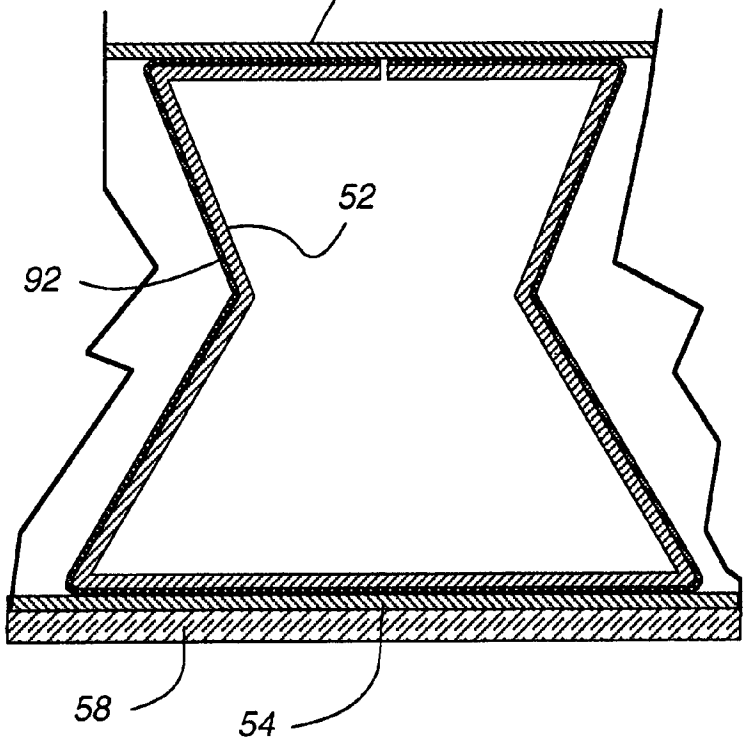
FIG. 28 is a fragmentary vertical section taken through the panel similar to FIG. 27 showing still another alternative arrangement of the divider wherein a metal foil is applied to the outer surface of the divider.
Figure 27:
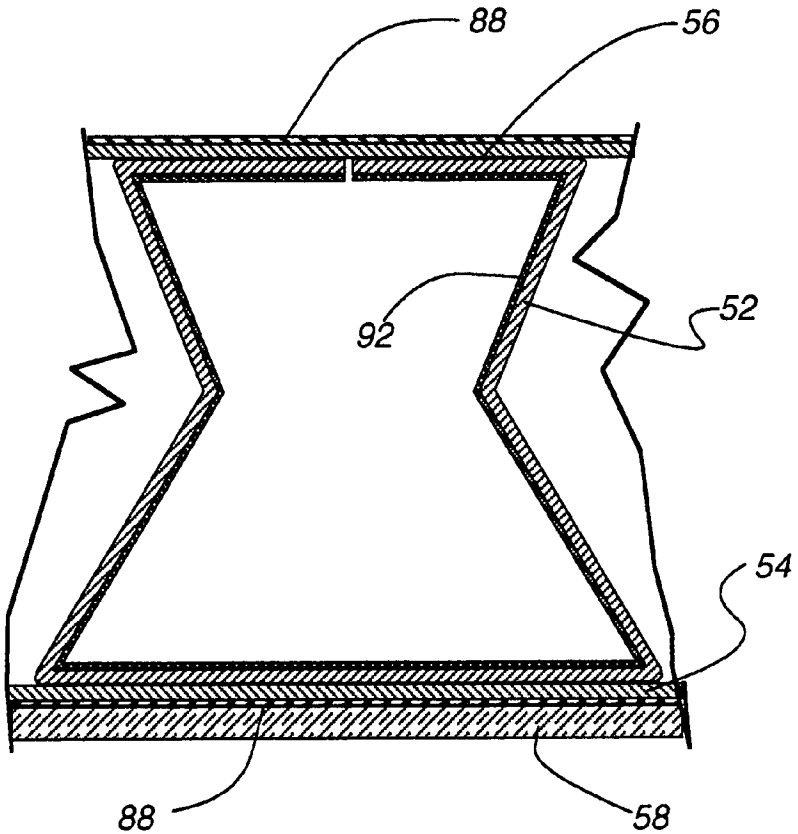
FIG. 27 is a fragmentary vertical section taken through a portion of the panel illustrating an alternative embodiment of the divider wherein the divider includes an inner layer of a metallic foil.

To change the structural characteristics of the dividers 52, the outer or inner surface of the divider can also be laminated with another sheet of material and possibly a metallic sheet material 92, which renders the divider material slightly more rigid, as illustrated in FIGS. 28 and 27, respectively. A metallic sheet would also affect the thermal characteristics of the panel. FIG. 27 shows the metallic sheet material on a panel with a support member 88 while FIG. 28 does not include a support member. Of course, the lamination process would take place during the formation of the divider and preferably immediately before creasing.

Figure 29:
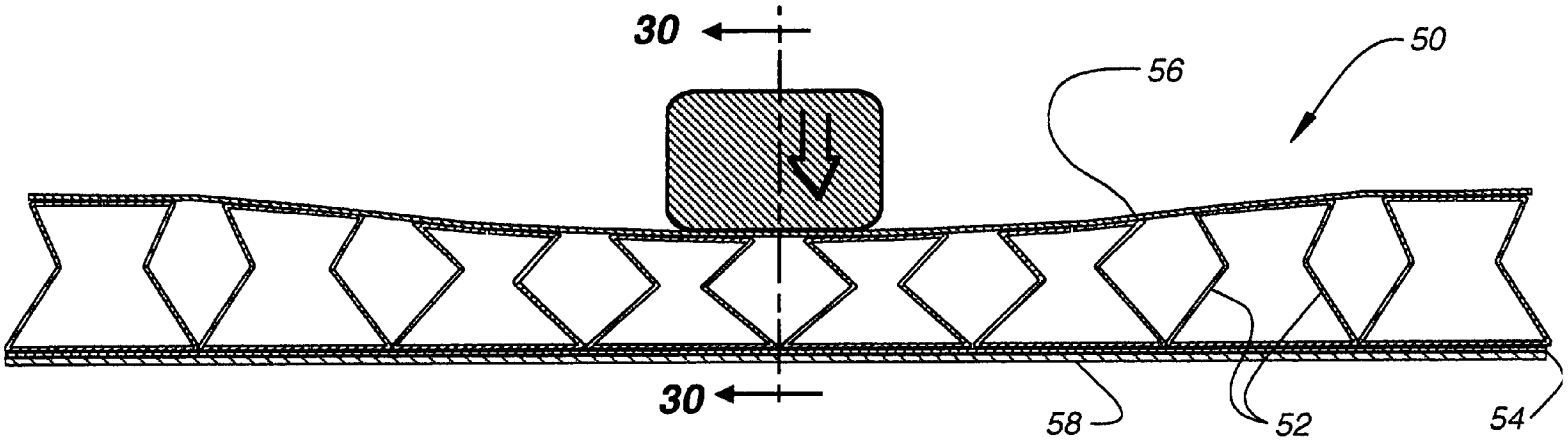
FIG. 29 is a transverse section taken through the panel as shown in FIG. 14 with the panel being compressed on its top surface.
Figure 30:
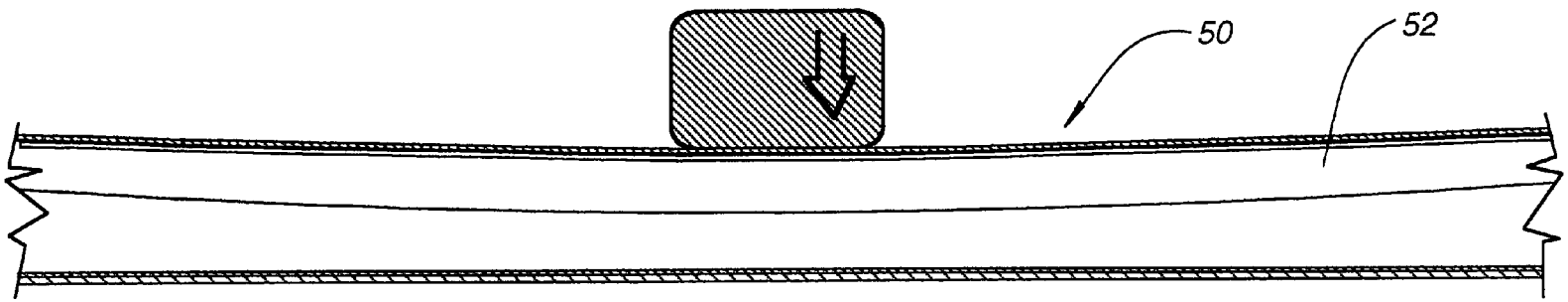
FIG. 30 is a section taken along line 30—30 of FIG. 29.

As seen in FIGS. 29 and 30, the panel formed in accordance with the above process is unique in that pressure applied at any one location to one surface of the panel will only depress the panel at that location and will not deform the opposite side of the panel. The panel will also support multiples of its own weight without deflection on the opposite side of the panel. By way of example, a panel formed in accordance with the present invention that is 26 millimeters thick when expanded and which is 24 inches wide by 48 inches long weighs approximately 0.9 kilograms (1.98 pounds). The panel can support up to 2.9 kilograms load (6.38 pounds) in the form of a circular weight 10 inches in diameter with minimal deflection observed on the opposite side of the panel. Point loads of approximately 2 inches in diameter and weighing 1 kilogram (2.2 pounds) are also easily absorbed by the same panel with no deflection of the bottom surface.

Figure 33:
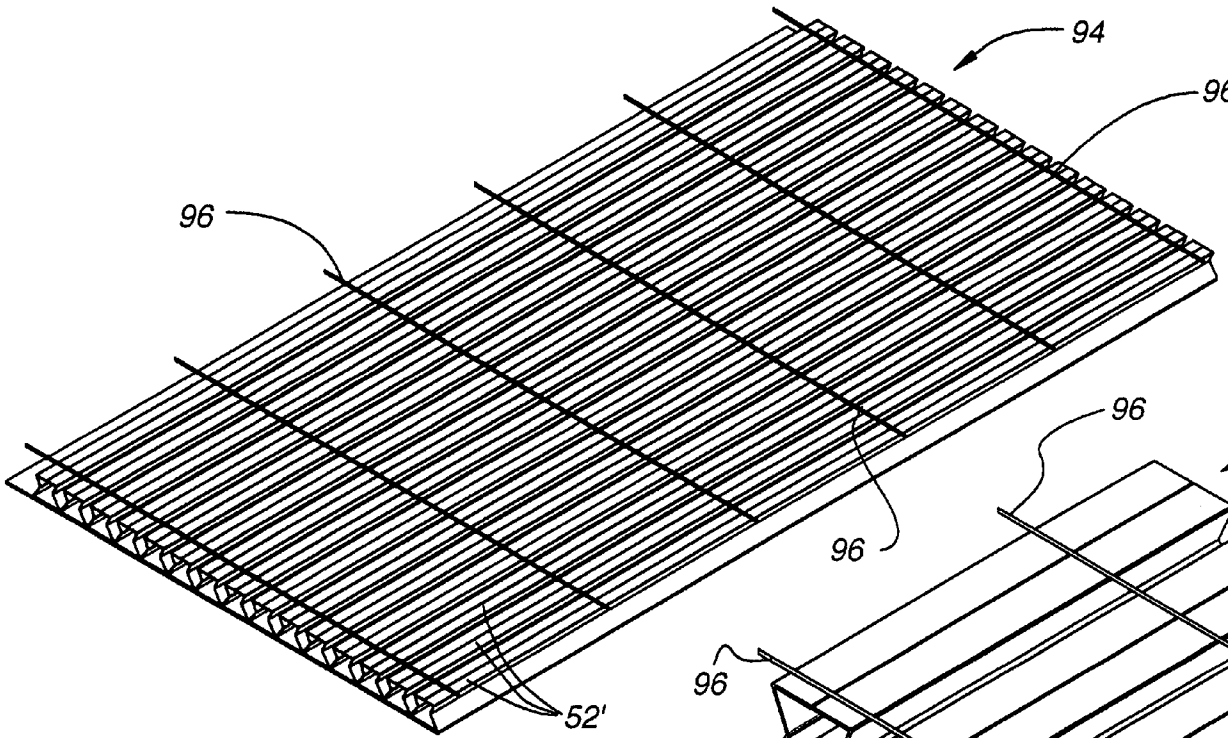
FIG. 33 is an isometric view showing a panel in accordance with the present invention wherein the connection means are elongated strands or fibers that are secured to the dividers distally from the outer sheet.
Figure 34:
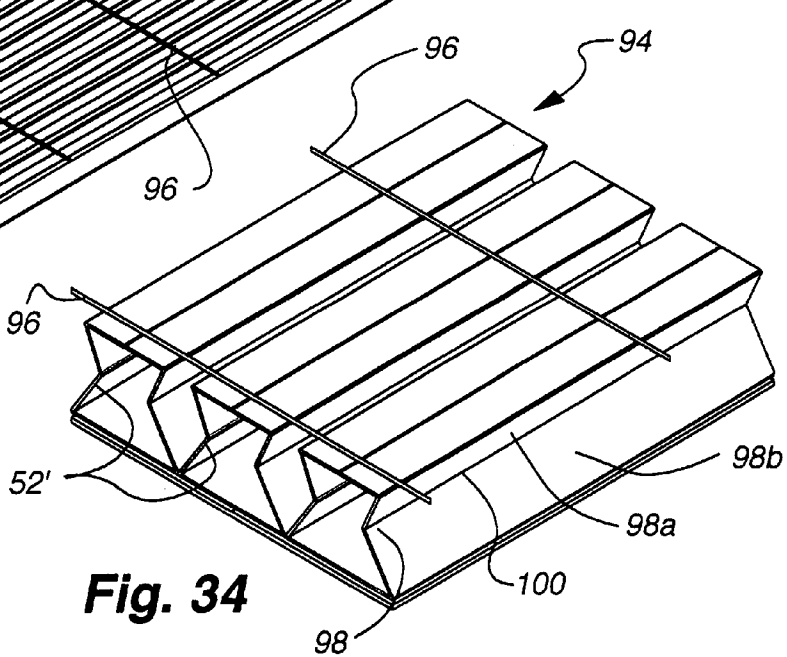
FIG. 34 is an enlarged isometric showing a portion of the panel illustrated in FIG. 33.
Figure 35:
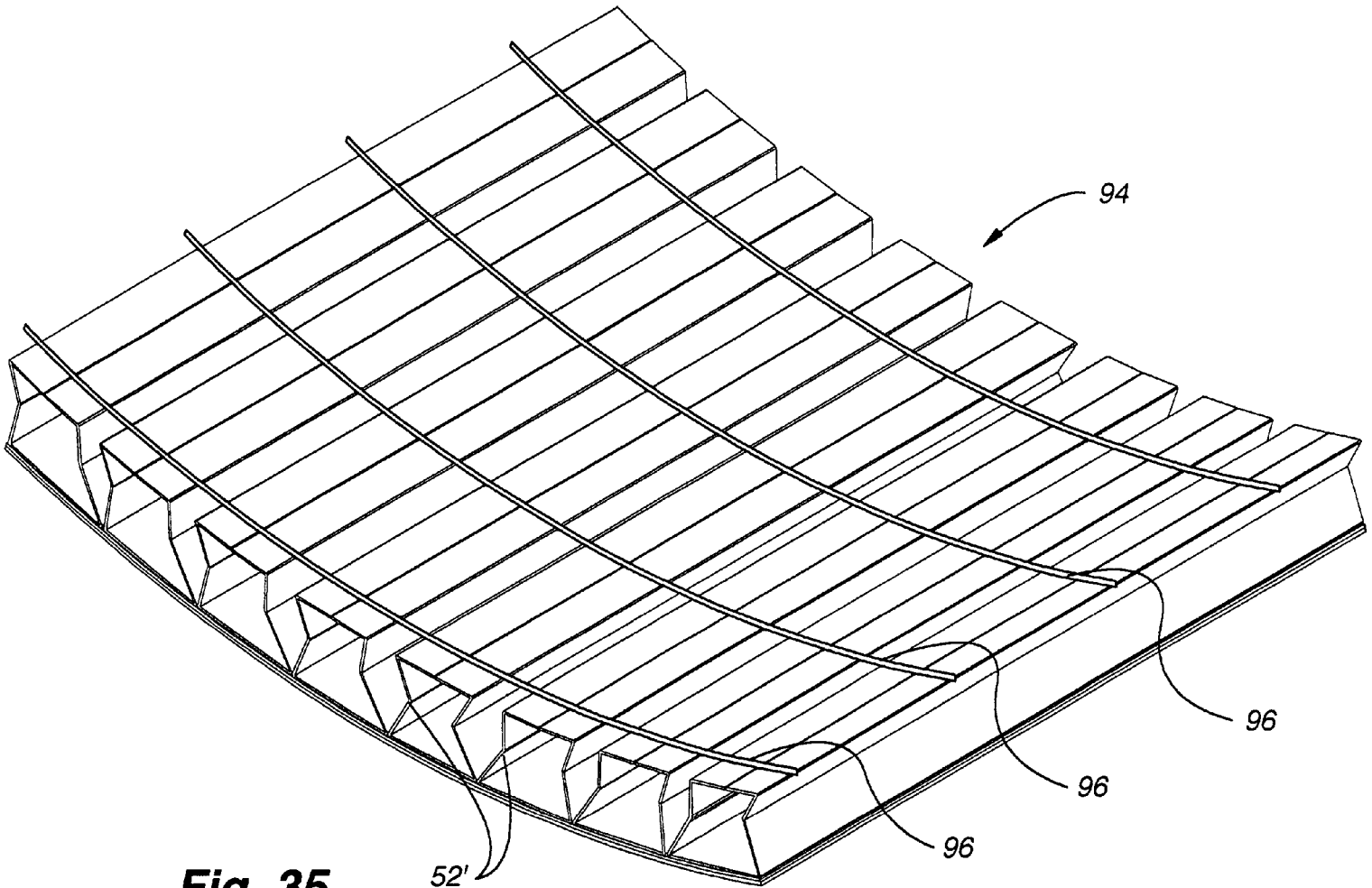
FIG. 35 is an isometric view of the panel shown in FIG. 33 with the panel having been bent or curved so as to be upwardly concave.

With reference to FIGS. 33–35, a second embodiment of a panel 94 is illustrated wherein the connector sheet 54 has been replaced with a connector in the form of a plurality of elongated flexible but non-extensible strands or fibers 96. These strands or fibers could be plastic, nylon or other similar material having the same or similar characteristics. The strands or fibers of material can be adhesively or otherwise bonded to tubular dividers 52' while extending transversely thereto and with the fibers spaced from each other preferably in parallel relationship to each other. A panel 94 so formed can be easily flexed or bent, as illustrated in FIG. 35, in a direction transverse to the longitudinal direction of the dividers as with the previously described panel.

In each of the afore-described embodiments of the invention, the dividers have identical side partitions 98 (FIGS. 12 and 34) which have longitudinal fold lines 100 therein so that the side partitions fold inwardly when the panel is compressed. The side partitions thereby define upper and lower portions 98*a* and 98*b*, respectively, which are rectangular in configuration but wherein the upper portion 98*a* is of a smaller dimension than the lower portion 98*b*. This arrangement might be referred to as an asymmetric arrangement in that the upper portion of the divider is of a different size than the lower portion.

A third embodiment of the present invention is illustrated in FIGS. 36–42 and in this embodiment, a panel 102 is identical to that shown in FIG. 12 except that the partitions 104 in the dividers 105 are symmetric in configuration. In other words, the panel 102 includes an outer sheet 54' and a connector sheet 56' interconnected by dividers with partitions and may include a decorative panel 58' overlying the outer sheet if desired. Fold lines 106 along the partitions 104, however, are positioned so that an upper rectangular portion 104*a* of each partition is of equal size to a lower rectangular portion 104*b*. The panel 102 can again be compressed.

Figure 36:
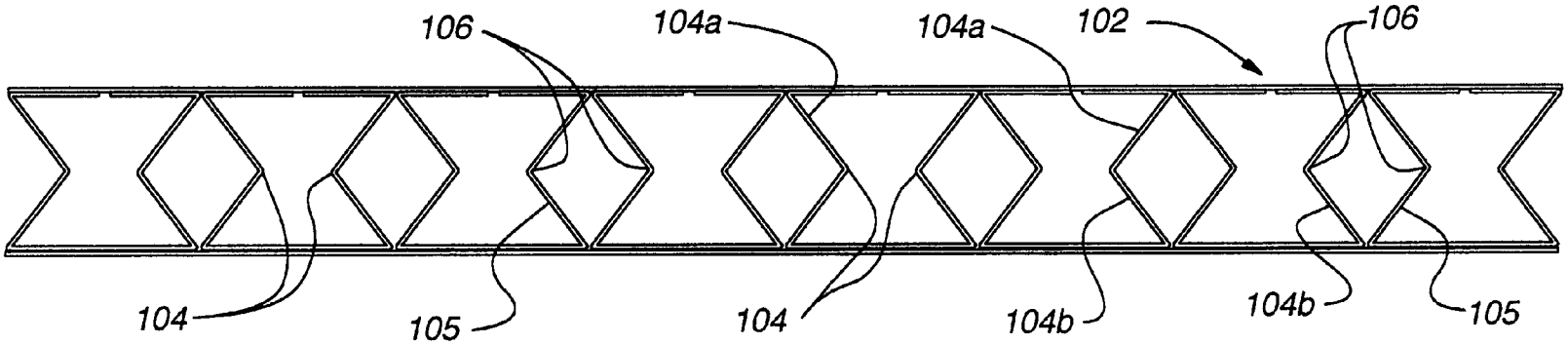
FIG. 36 is an end elevation of a panel formed in accordance with the present invention and corresponding to the panel shown in FIG. 32.
Figure 37:
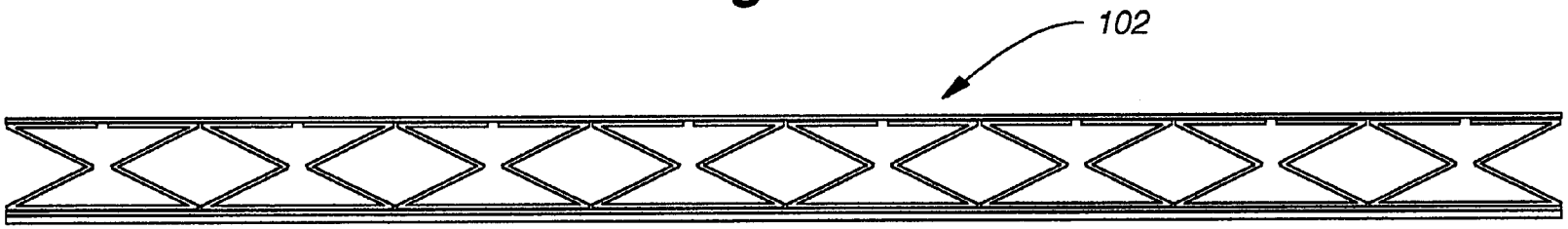
FIG. 37 is an end elevation of the panel shown in FIG. 36 with the panel partially compressed.
Figure 38:
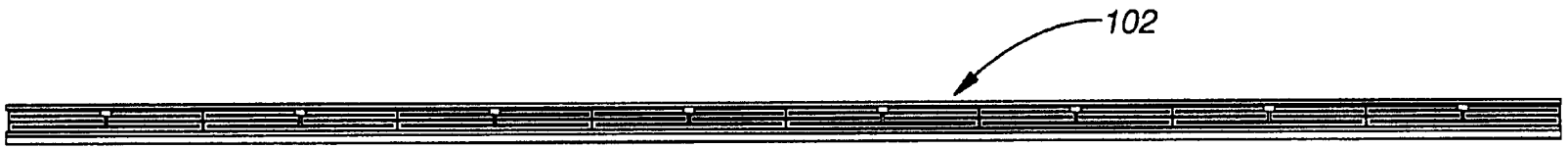
FIG. 38 is an end elevation of the panel shown in FIG. 37 having been fully compressed.
Figure 39:
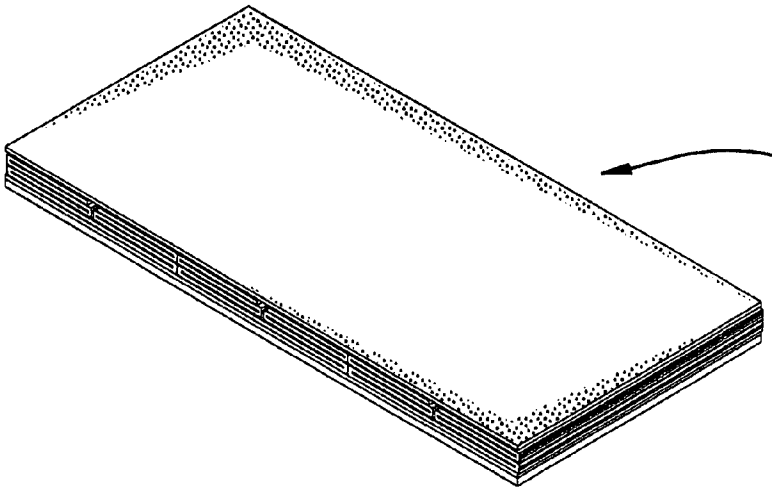
FIG. 39 is an isometric view of the panel shown in FIG. 38 in a fully compressed condition.
Figure 40:
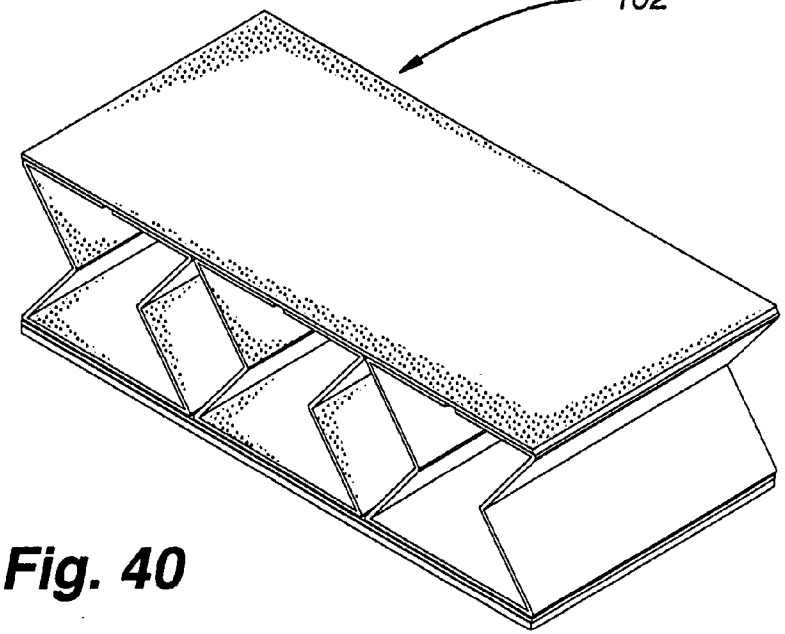
FIG. 40 is an isometric view of a portion of the panel shown in FIG. 36 in a fully expanded condition.

The compressed and expanded forms of the panel 102 shown in FIGS. 36–38 are illustrated isometrically in FIGS. 39 and 40 and it will be appreciated that the panel can be fully compressed to a depth or side profile that is far less than its normal expanded condition.

Figure 42:
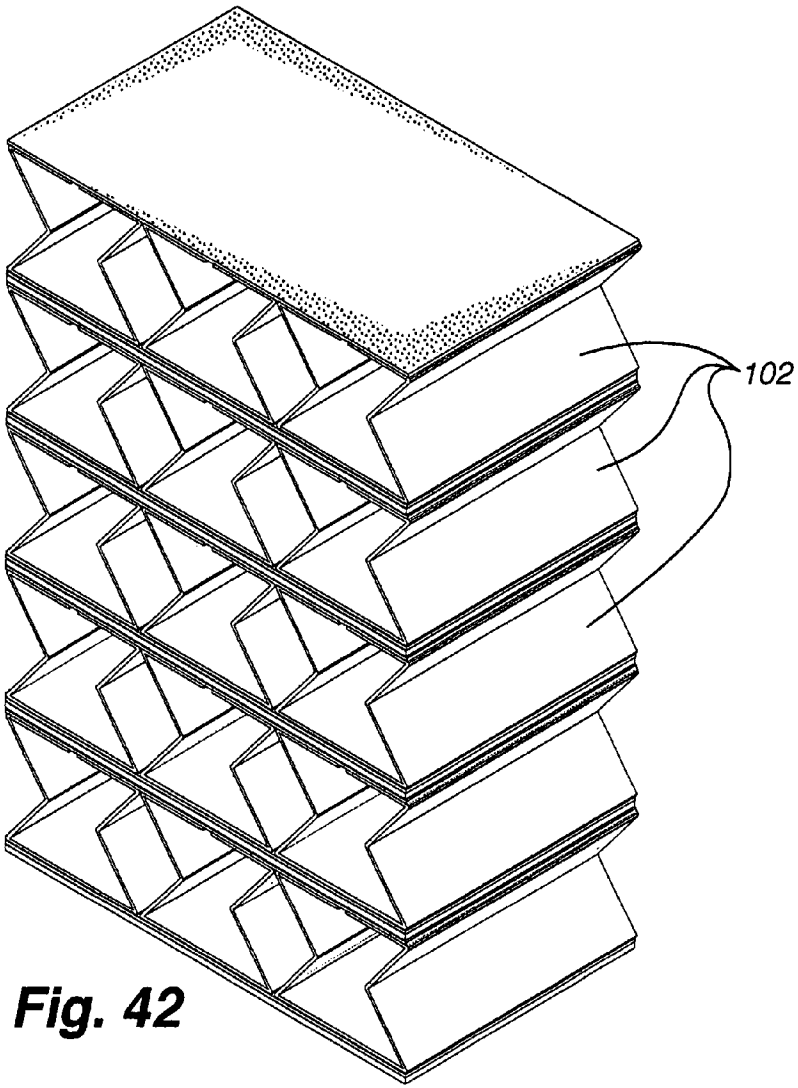
FIG. 42 is an isometric view of a portion of the panels of the type shown in FIG. 36 having been stacked in a fully expanded condition.
Figure 41:
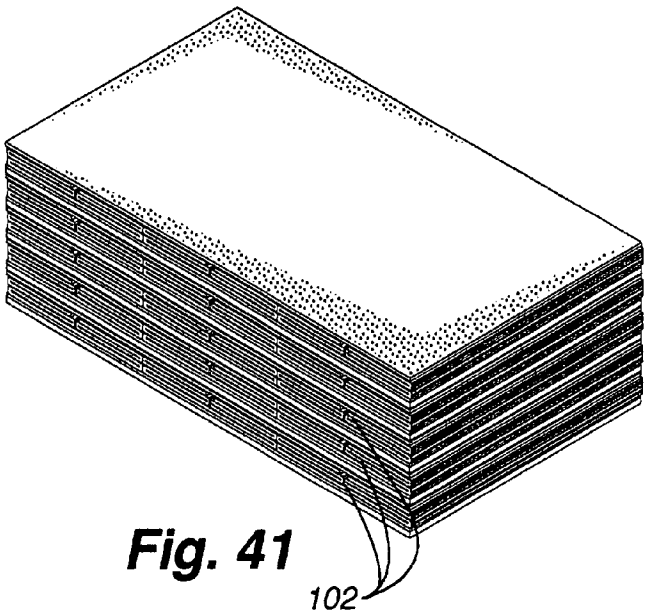
FIG. 41 is an isometric view of a plurality of panels of the type shown in FIG. 36 having been compressed and stacked together.

As seen in FIGS. 41 and 42, when the panels are stacked, a considerable amount of space can be saved by compressing the panels, which, of course, saves considerable expense when shipping as, more panels can be compressed and shipped in one container than with conventional ceiling panels.

An advantage of a panel using symmetric dividers resides in the elimination of telegraphing that can, if not carefully watched, exist in compressed panels. Telegraphing is a phenomenon that can result in compressed panels of the type described herein when a sheet is compressed tightly against other components of the panel such as dividers or partitions. If the pressure is too great or the dividers exert too much resistance, a visual pattern can be seen through the sheet where a partition is secured thereto and where it is not.

By reference to FIG. 17, which illustrates a panel with asymmetric dividers, it will be appreciated there are spaces between the dividers along their connections to the connector sheet, but such a gap hardly exists when using symmetric dividers as best seen in FIG. 38. Accordingly, in a panel using symmetric dividers as shown in FIG. 38, telegraphing is virtually eliminated regardless of the pressure applied to the panel. It should also be appreciated, however, that in panels of the present invention with symmetric or asymmetric dividers, there is less tendency for telegraphing due to the fact that when the connector sheet is forced downwardly against the dividers, they do not resist the pressure but simply compress so that an adequate pressure for bonding the connector sheet to the dividers can be applied without creating telegraphing.

Figure 43:
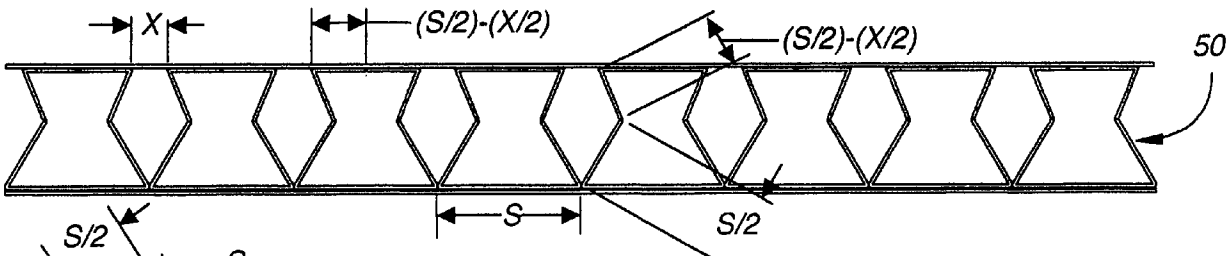
FIG. 43 is a diagrammatic end elevation of a panel with asymmetric dividers illustrating dimensional characteristics thereof.
Figure 44:
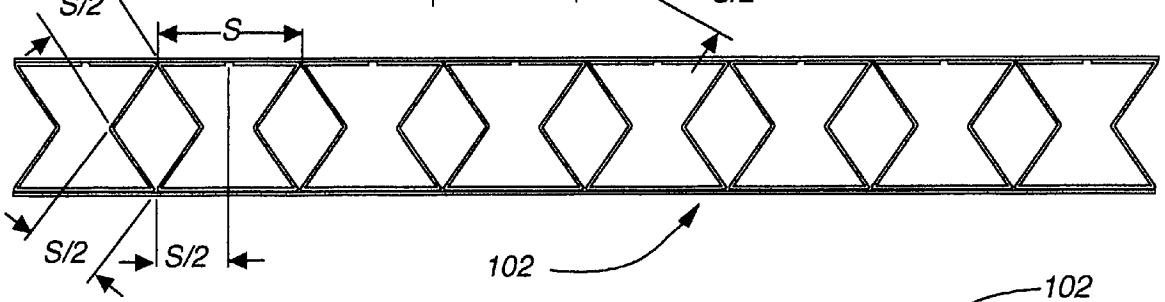
FIG. 44 is a diagrammatic end elevation of a panel with symmetric dividers illustrating dimensional characteristics thereof.
Figure 46:
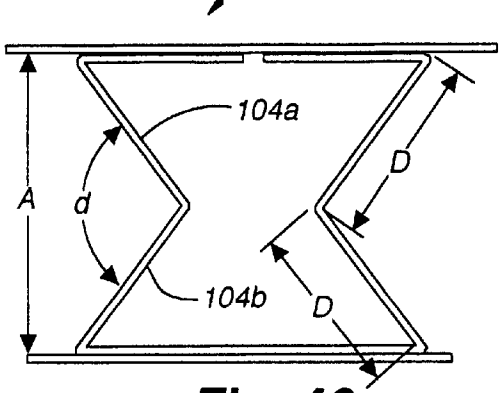
FIG. 46 is an enlarged end elevation of a portion of the panel of FIG. 44 illustrating other dimensional characteristics.
Figure 45:
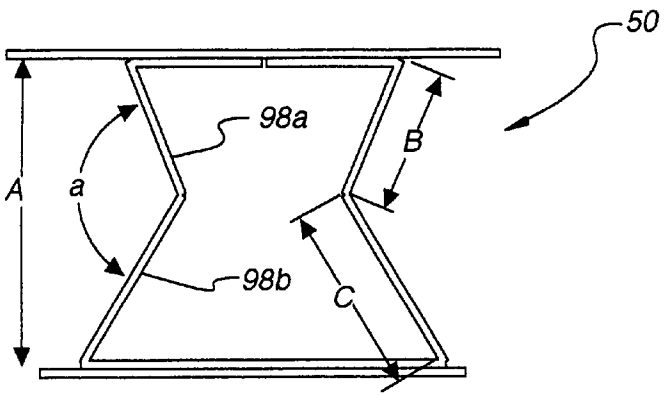
FIG. 45 is an enlarged end elevation of a portion of the panel of FIG. 43 illustrating other dimensional characteristics.

By changing the location of the fold line 106 in each side partition of a divider 105, the resistance of the panel to compression can also be regulated. For example, in the at rest expanded position of an asymmetric panel 50 such as disclosed as the first embodiment of the present invention and shown in FIGS. 43 and 45, an obtuse angle "a" is formed in the side partition 98 which is greater than the corresponding angle "d" in the partition 104 as shown in FIG. 46 of a symmetric panel. The height A of each panel in the expanded form is, however, identical. Note also the difference in the length B and C of the upper and lower portions 98*a* and 98*b*, respectively, of the side partitions of the asymmetric divider, whereas in the symmetric divider illustrated in FIG. 46, the length D of the upper partition portion 104*a* and the lower partition portion 104*b* are identical.

Figure 47:
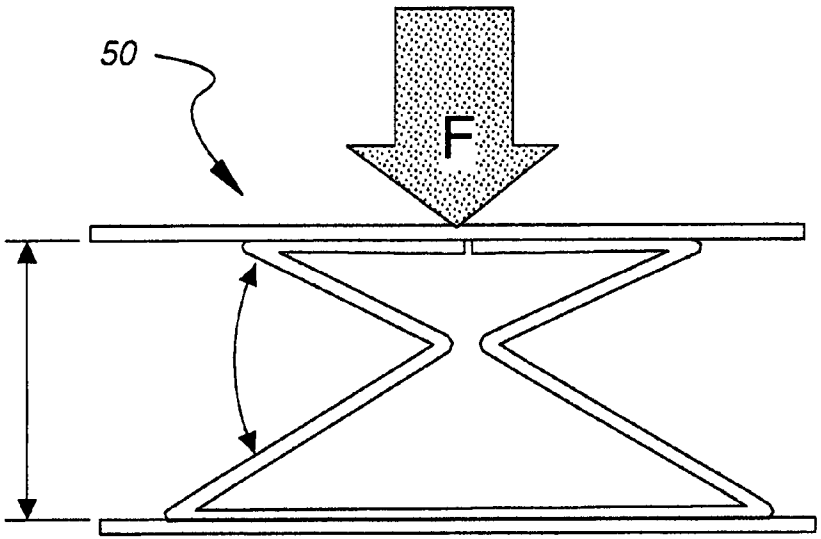
FIG. 47 is an end elevation similar to FIG. 45 showing the panel compressed with a force F.
Figure 48:
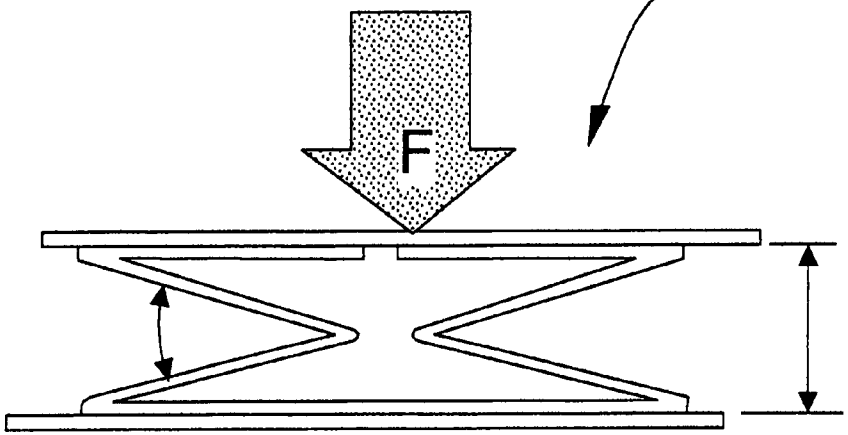
FIG. 48 is an end elevation similar to FIG. 46 showing the panel compressed with a force F.

The greater the angle "a" or "d" in the side partition, the more resistance there will be to compressing the panel, as illustrated in FIGS. 47 and 48. In FIGS. 47 and 48, an equal force F is shown being applied to the asymmetric divider panel 50 in FIG. 47 and the symmetric divider panel 102 in FIG. 48 and it will be seen that the same amount of force compresses the symmetric divider panel a greater amount. This is because the angle in the side partition in the symmetric divider panel is smaller than the angle in the asymmetric divider panel.

Figure 50:
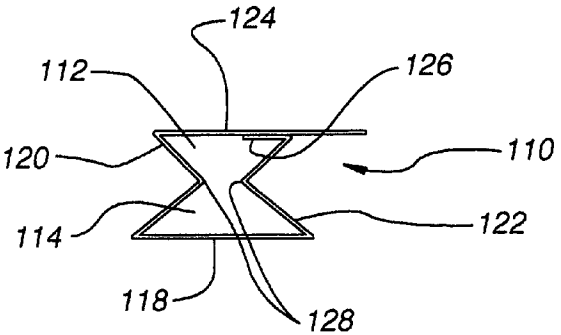
FIG. 50 is an end elevation of the divider shown in FIG. 49.
Figure 49:
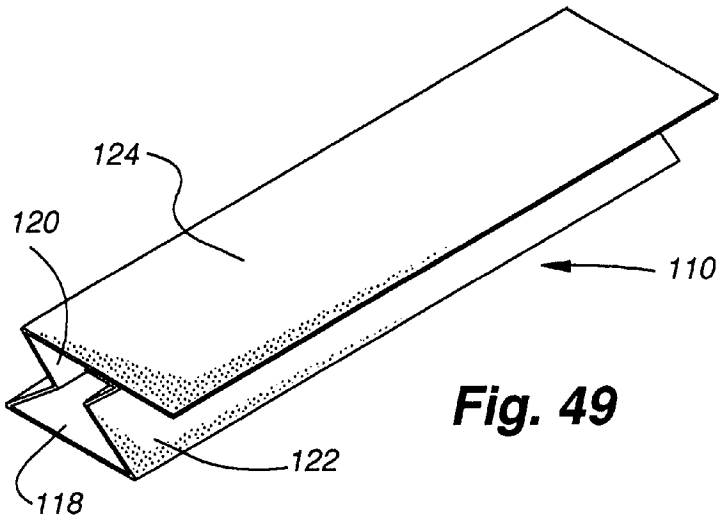
FIG. 49 is an isometric view of another embodiment of a divider for use in the panel of the present invention.
Figure 52:
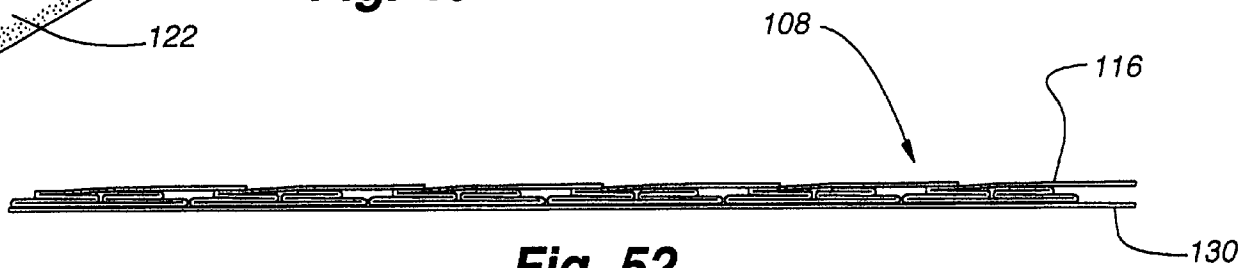
FIG. 52 is a reduced end elevation of the panel shown in FIG. 51 in a compressed form.
Figure 51:
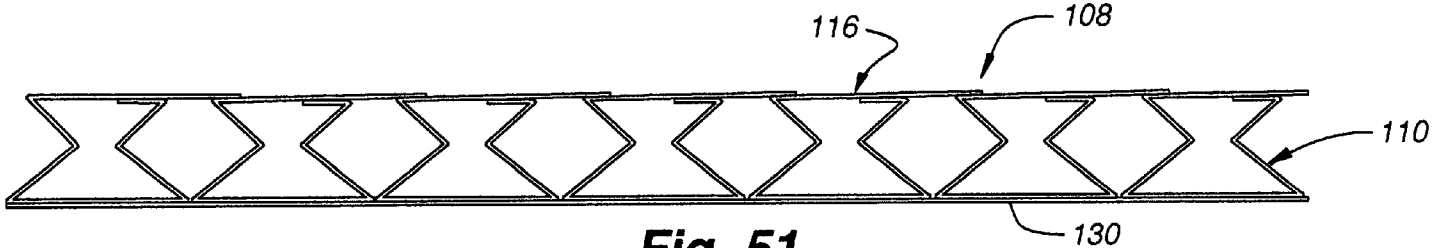
FIG. 51 is an end elevation of a panel including a plurality of the dividers shown in FIG. 49 in an expanded form.

By way of illustration and not limitation, in a panel formed in accordance with the present invention which has been found to provide satisfactory performance and wherein the outer sheet, connector sheet and dividers are all made of 100GSM Johns Manville #8802 glass matting, the parameters identified in FIGS. 43 through 46 fall in the following ranges:

X=5 to 10 mm
S=20 to 40 mm
A=15 to 26 mm
B=8 to 10 mm
C=13.5 to 17 mm
D=13.5 to 15 mm
a=100 to 120 degrees
b=100 to 120 degrees In another alternative embodiment 108 of a panel in accordance with the present invention shown in FIGS. 51 and 52, the connector sheet of the previously described embodiments is eliminated by the use of a unique divider 110. The divider 110, as best seen in FIGS. 49 and 50, is of generally hourglass configuration defining two truncated triangular zones 112 and 114 inverted relative to each other similarly to the first described embodiment of the present invention, but the top of the divider has a long horizontal leg adapted to overlap an adjacent divider so as to have a segmented connector sheet 116 that is composed of a plurality of interconnected strips defined by the horizontal top leg of the divider. While the divider 110 has been shown to be asymmetric, it could, in fact, assume a symmetric configuration similar to that shown in the third described embodiment of the present invention. The divider, therefore, has a base 118, a left side partition 120 and a right side partition 122, with each side partition having a horizontal leg 124 and 126 respectively at its top. Both of the side partitions have a crease line 128 so that the side partitions will fold when pressure is applied to the top or bottom of the divider. The horizontal top leg 126 of the right side partition is approximately a third of the width of the divider at its top, but the horizontal leg 124 from the left side divider is slightly longer than the base 118 of the divider so that it overlies and overlaps the horizontal top leg 122 of the right divider.

As is best seen in FIG. 51, when a plurality of the dividers 110 are positioned in immediately adjacent or contiguous side-by-side relationship, the top horizontal leg 124 from the left side partition 120 extends beyond the right side partition 122 and into overlapping relationship with the top horizontal leg 124 of the left side partition 120 of the next adjacent partition to the right. The overlapping horizontal top legs 124 from the left side partitions thereby form in combination a segmented but integrated connector sheet. Of course, the top horizontal leg 124 from the left side partitions of each divider is adhesively secured to the top horizontal leg 126 from the right side partition and also to the top horizontal leg 124 from the left side partition of the divider that is to the immediate right thereof. A cover sheet 130 is secured to the base 118 of each of the dividers to interconnect the dividers along their bases and, of course, a decorative sheet (not shown) can be secured to the lower face of the outer sheet or the segmented connector sheet if desired.

Figure 53:
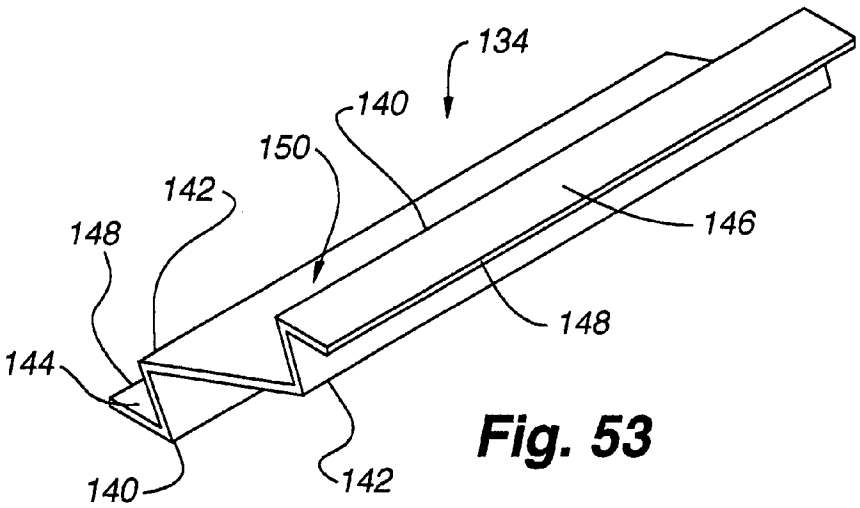
FIG. 53 is an isometric view of still another embodiment of a divider for use in the panel of the present invention.
Figure 54:
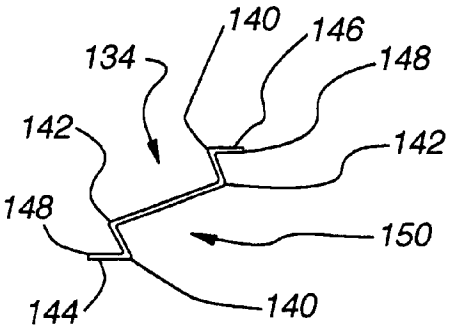
FIG. 54 is an end elevation of the divider shown in FIG. 53.
Figure 56:
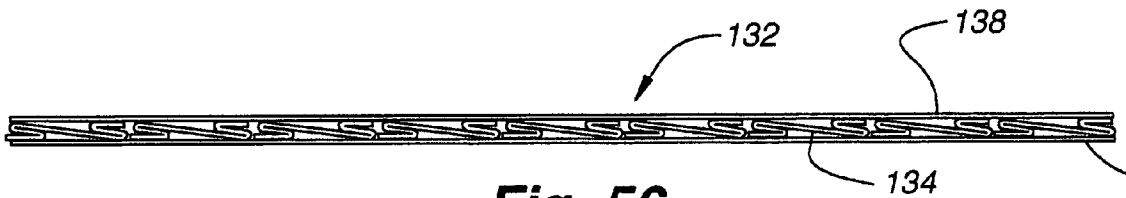
FIG. 56 is a reduced end elevation of the panel of FIG. 55 in a compressed form.
Figure 55:
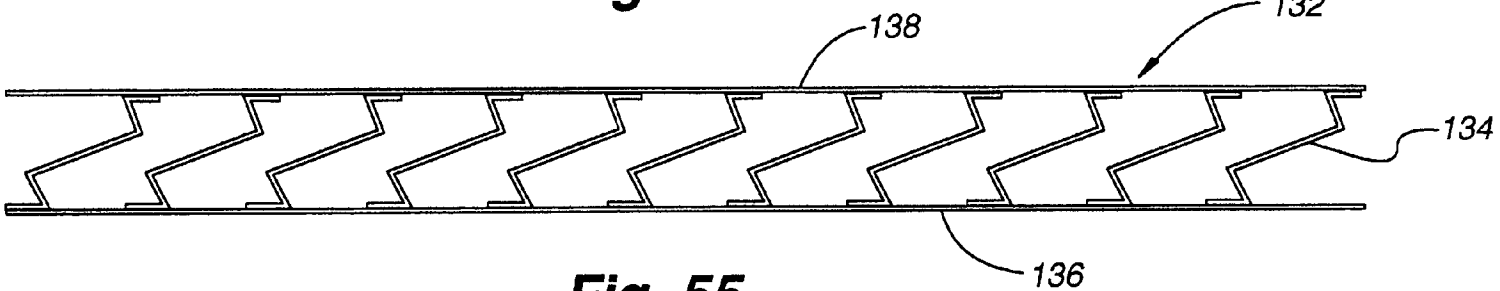
FIG. 55 is an end elevation of a panel formed in accordance with the present invention and utilizing the divider of FIG. 53 with the panel in an expanded form.

Still another embodiment 132 of a panel formed in accordance with the present invention is shown in FIGS. 53–55, and in this embodiment, the dividers 134 are not cellular in and of themselves but are rather strips of material that have been folded into a zig-zag pattern and secured between an outer sheet 136 and a connector sheet 138 so as to form a cellular compressible panel. Looking initially at FIGS. 53 and 54, the divider 134 is formed from a strip of material which has a pair of outer parallel crease lines 140 and inner parallel crease lines 142 but with the outer crease lines being folded in opposite directions and the inner crease lines being folded in opposite directions. A pair of attachment surfaces or marginal zones 144 and 146 are thereby defined between the outer crease lines 140 and the side edges 148 of the strip which can be secured in any suitable manner to the outer sheet and the connector sheet respectively. In between these marginal zones of the dividers, an intermediate portion 150 of the divider has the two inner folds therein allowing the strip to fold when transverse pressure is applied to either of the marginal zones. The panel 132 formed with the dividers 134 of FIGS. 53 and 54 is shown in FIGS. 55 and 56 in an expanded and compressed condition, respectively.

Figure 57:
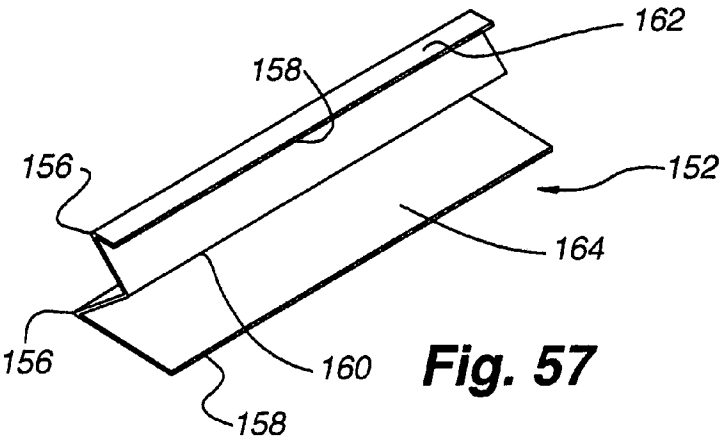
FIG. 57 is an isometric view of still another embodiment for a divider for use in the panel of the present invention.
Figure 58:
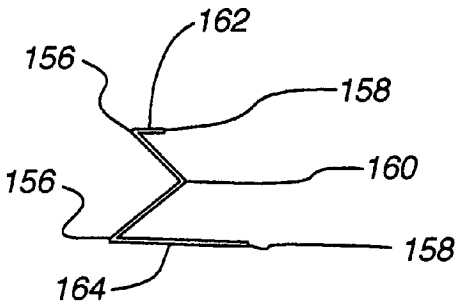
FIG. 58 is an end elevation of the divider shown in FIG. 57.
Figure 60:
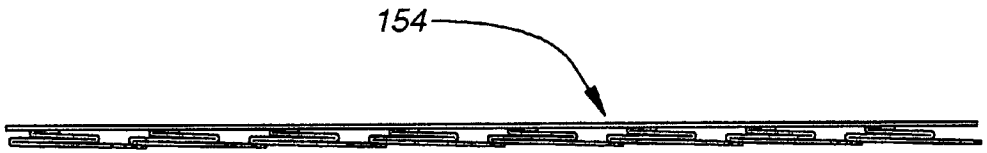
FIG. 60 is a reduced end elevation of the panel shown in FIG. 59 in a compressed form.
Figure 59:
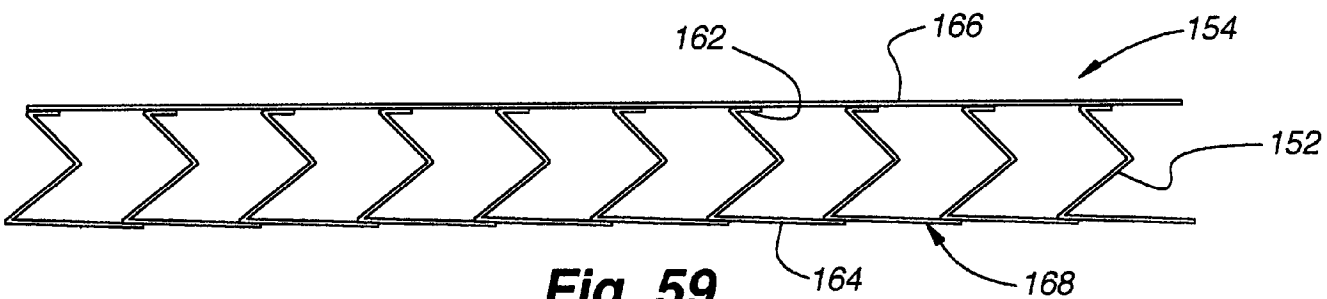
FIG. 59 is an end elevation of a panel utilizing the divider of FIG. 57 with the panel shown in an expanded form.
Figure 61:
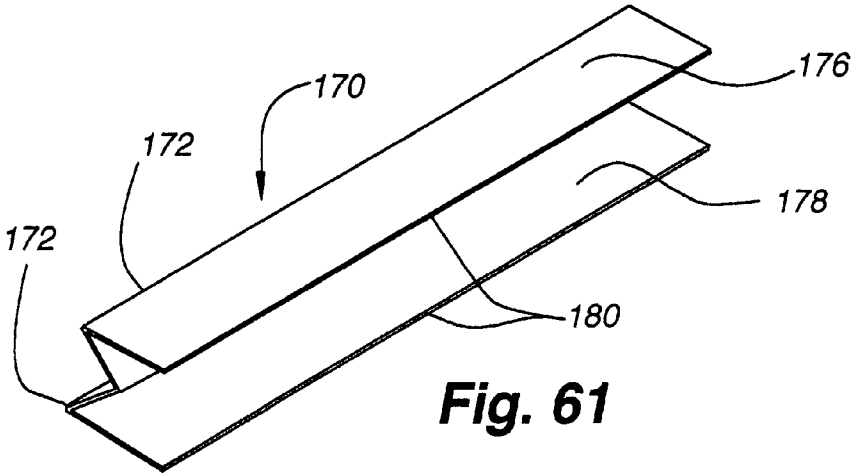
FIG. 61 is an isometric view of still another divider for use in the panel of the present invention.
Figure 62:
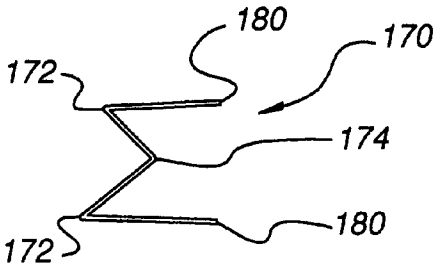
FIG. 62 is an end elevation of the divider shown in FIG. 61.
Figure 64:
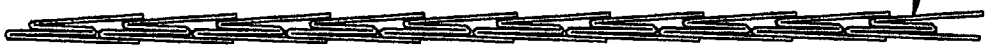
FIG. 64 is a reduced end elevation of the panel shown in FIG. 63 in a compressed form.
Figure 63:
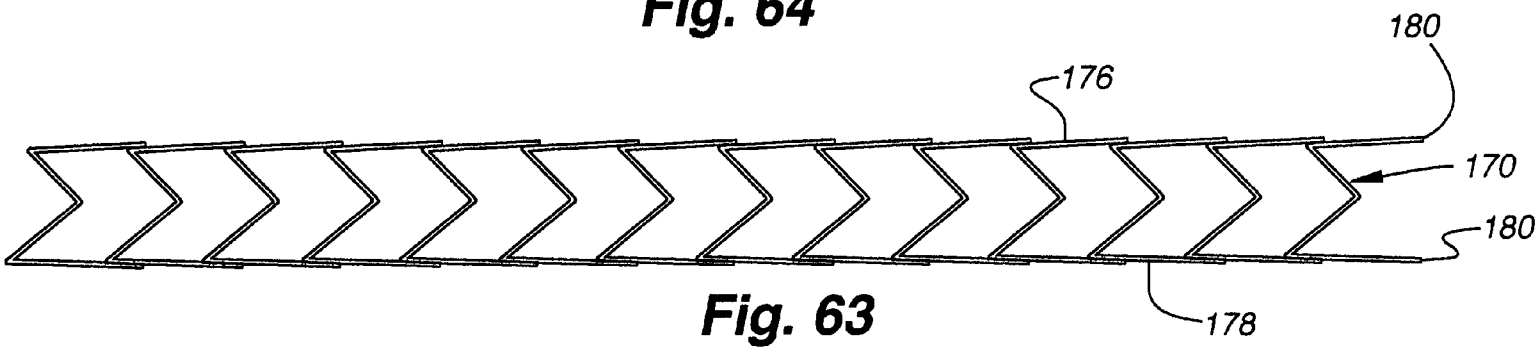
FIG. 63 is an end elevation of a panel utilizing the divider shown in FIG. 61 and with the panel in an expanded form.

Another divider 152 is shown in FIGS. 57 and 58 for use in a panel 154 shown in FIGS. 59 and 60 in an expanded and collapsed condition, respectively. The divider 152, as seen in FIGS. 57 and 58, includes a pair of parallel outer crease lines 156 with folds in the same direction therein spaced inwardly from the side edges 158 of a strip of material from which the divider is formed and a third intermediate crease line 160 between the parallel outer crease lines. An upper marginal zone 162 is defined between one edge of the strip of material and one of the outer crease lines and a second much larger lower marginal zone 164 is defined along the bottom of the divider between the associated edge of the strip of material and the adjacent crease line. A fold in an opposite direction is provided at the intermediate crease line 160 so that the divider has upper and lower marginal zones of different widths that both project to the right, as viewed in FIG. 8, from their adjacent fold lines 156. The upper marginal zone 162 of each divider is secured to a connector sheet 166 at parallel equally spaced locations while the lower marginal zones 164 are adapted to extend to the right and overlap a small portion of the next adjacent divider to the right. The overlapping lower marginal zones are secured to each other thereby forming an integrated segmented outer sheet 168 formed from the plurality of lower marginal zones of the respective dividers. Of course, a decorative sheet (not shown) could overlie the interconnected lower marginal zones or the connector sheet to provide variety to the aesthetics of the panel.

A similar embodiment 170 of a divider is shown in FIGS. 61–64 where, again, a strip of material is provided with a pair of outer crease lines 172 and an intermediate crease line 174 therebetween, with upper and lower marginal zones 176 and 178 being defined between the edges 180 of the strip and the outer crease lines 172. The folds at the outer crease lines 172 are in an opposite direction to the fold along the intermediate crease line 174 so that the outer and lower marginal zones both project horizontally to the right, as viewed in FIG. 62. As will be appreciated, both of the horizontal zones extend horizontally beyond the intermediate crease line 174 and are adapted to overlap the upper and lower marginal zones of adjacent dividers to the right so that they can be secured thereto in any suitable manner to form the panel shown expanded in FIG. 63 and compressed in FIG. 64.

Figure 73:
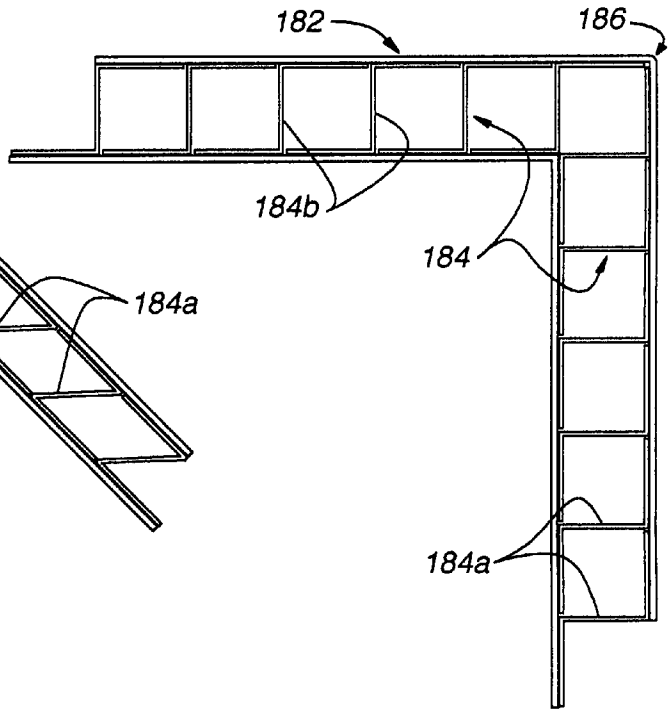
FIG. 73 is an end elevation of the panel as shown in FIG. 72.
Figure 71:
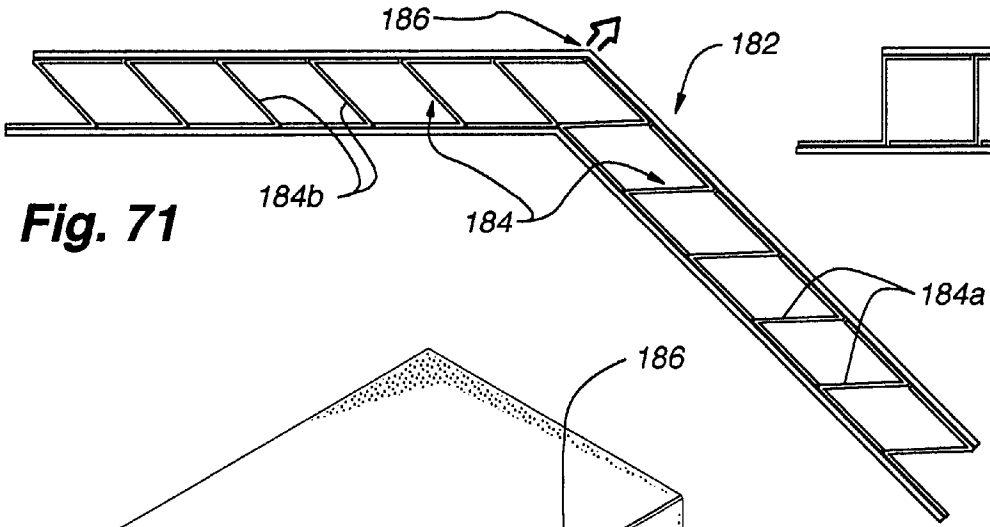
FIG. 71 is an end elevation similar to FIG. 68 with the panel slightly further expanded.
Figure 72:
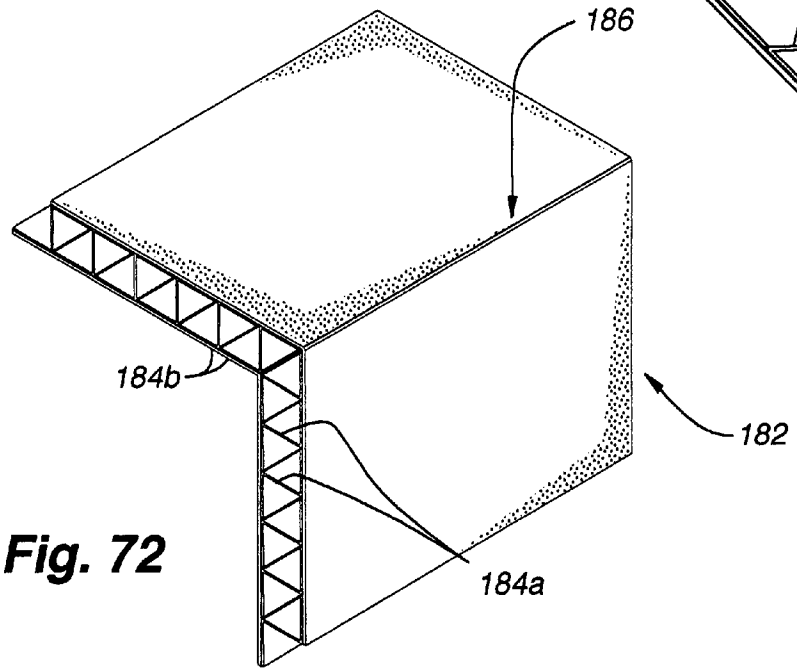
FIG. 72 is an isometric view of the panel of FIG. 68 having been bent along a right angle and with the panel fully expanded.
Figure 74:
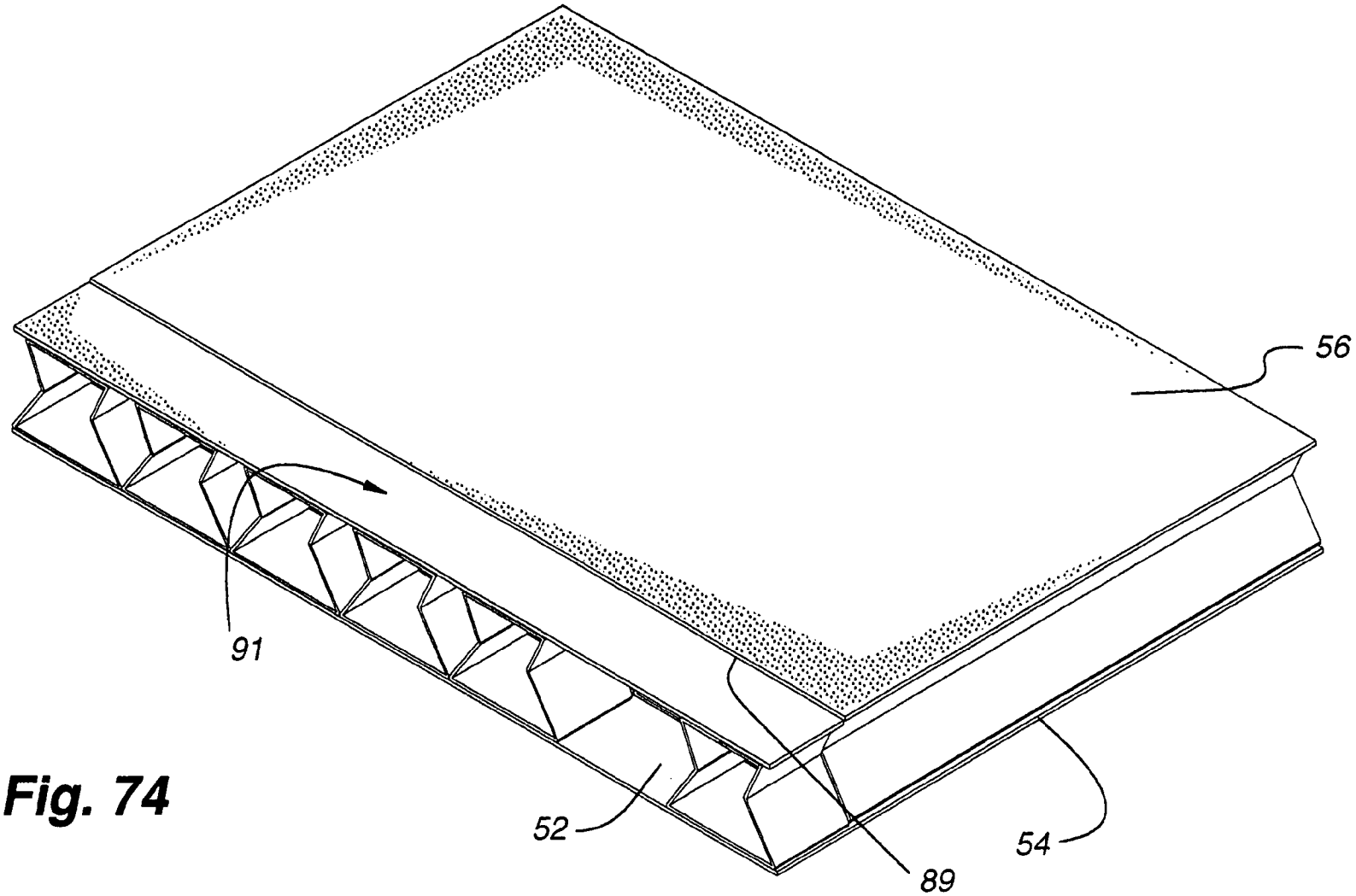
FIG. 74 is an fragmentary isometric view of an end of a panel with a segment of the panel having been partially cut.

In a further embodiment of a panel 182 made in accordance with the teachings of the present invention, and as seen in FIGS. 68–73, the panel again has an outer sheet 54, a connector sheet 56 and a plurality of dividers 184 extending therebetween. As is probably best seen in FIGS. 68 and 71, the dividers 184*a* in a part of the panel are of Z-shaped cross-section while the dividers 184*b* in the other part of the panel are of reverse Z-shaped cross-section. At the location 186 at which the direction of the dividers changes, the panel can be bent at a right angle as seen in FIGS. 72 and 73 so that the panel can, for example, follow the right-angled contours of building components on which it is mounted. For example, the panel could be wrapped around rectangular ductwork of the type that might be found in a house for conducting forced air or the like.

Referring again to FIGS. 68 and 71, it will be appreciated on the right-hand portion of the panel that the dividers 184*a* are Z-shaped in cross-section so as to define an upper horizontal leg 188 that extends to the left, a lower horizontal leg 190 that extends to the right and a diagonal connecting leg 192 that connects the right edge of the upper leg to the left edge of the lower leg. The Z-shaped dividers 184*a* are, of course, formed similarly to those described previously by placing crease lines in strips of material from which the dividers are made and then folding the strips of material along the crease lines. The reverse Z-shaped dividers 184*b* on the left side of the panel, of course, have an upper horizontal leg 194 that extends to the right, a lower horizontal leg 196 that extends to the left and a diagonal connecting leg 198 that extends from the left edge of the upper leg to the right edge of the lower leg.

As is best seen in FIGS. 68 and 71–73, at the location 186 where the direction of the dividers changes, (in the illustrated panel, near its center) the panel can be folded at a right angle. The panel can then be fully expanded as shown in FIGS. 72 and 73 so that the legs of the dividers are perpendicular to each other thereby forming rectangular cells.

Figure 69:
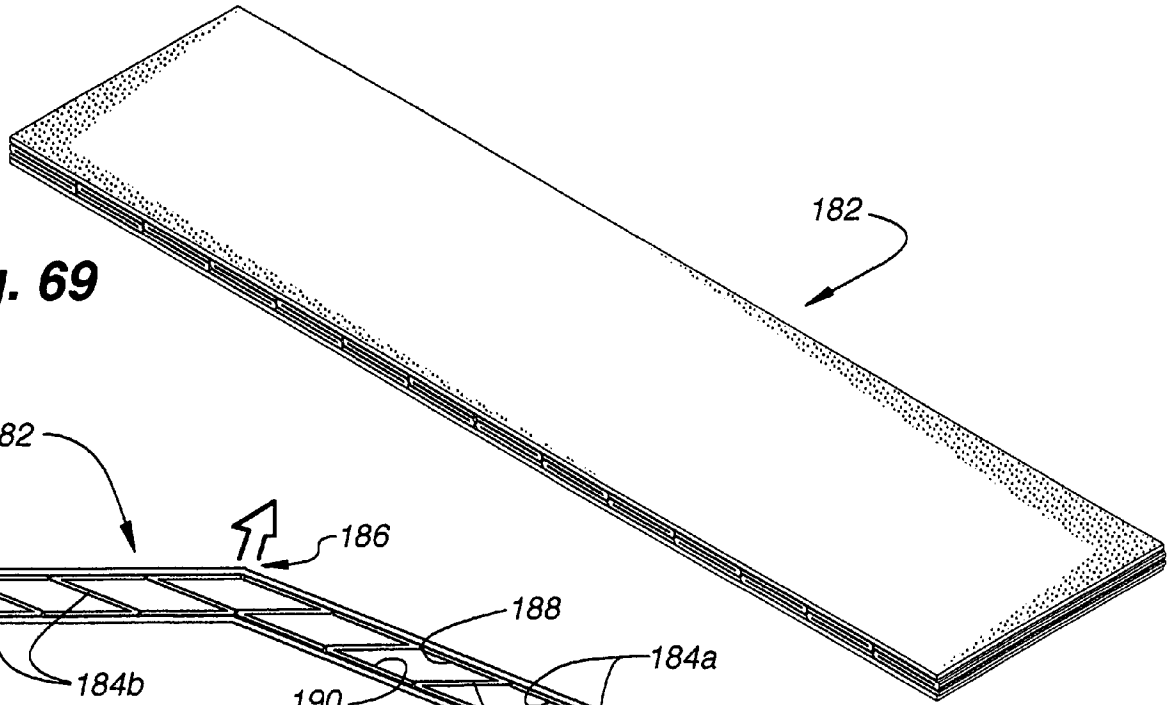
FIG. 69 is an isometric view of a panel formed as in FIG. 68 with the panel in a fully compressed condition.
Figure 68:
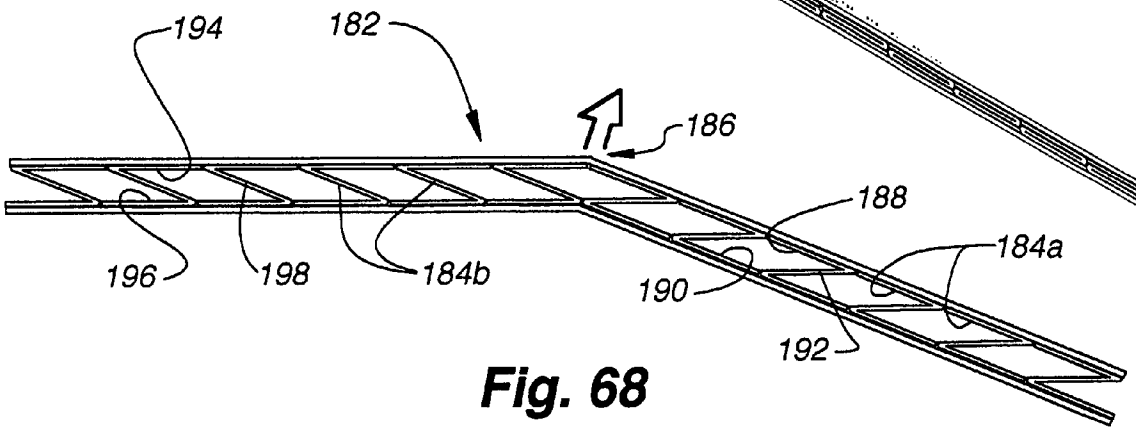
FIG. 68 is an end elevation of a further embodiment of the present invention in which the panel can be bent at a right angle.
Figure 70:
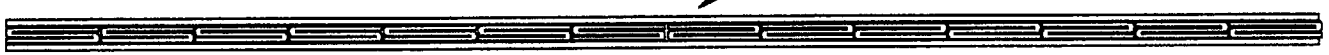
FIG. 70 is a side elevation of the panel shown in FIG. 69.

With reference to FIGS. 68 and 69, it will be appreciated that the panel can also be compressed as with the earlier described embodiments of panels made in accordance with the present invention.

Figure 9:
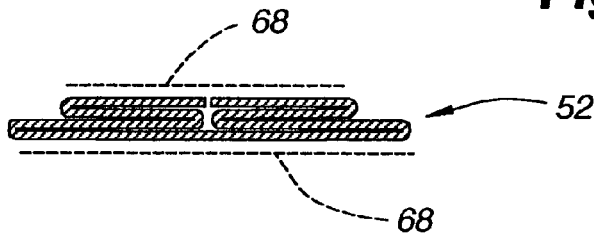
FIG. 9 is a front elevation similar to FIG. 8 with a layer of adhesive shown in dashed lines positioned above and below the divider.
Figure 100:
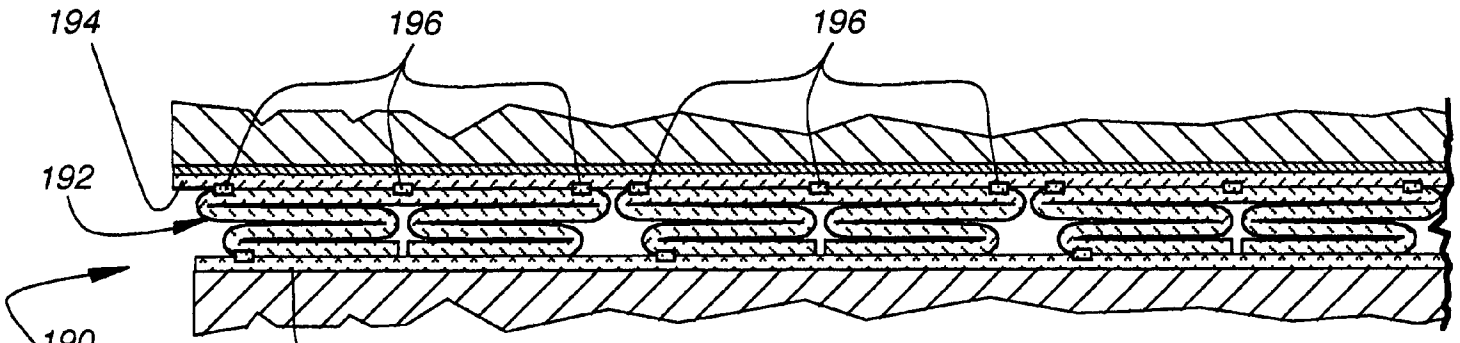
FIG. 100 is a fragmentary section taken through an alternative embodiment of a compressed panel showing a unique system for gluing the cellular structures to the outer and cover sheets.
Figure 101:
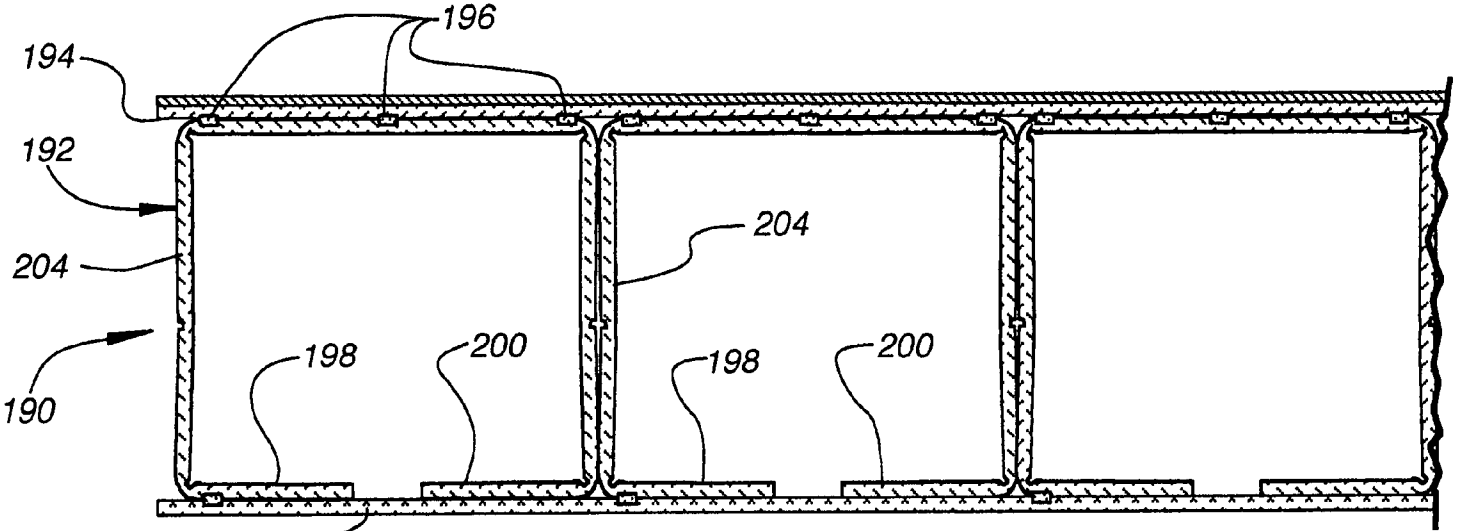
FIG. 101 is a fragmentary section similar to FIG. 100 with the panel fully expanded.

In still a further embodiment 190 of the panel of the present invention shown in FIGS. 100 and 101, the dividers 192 are of the configuration illustrated for example in FIGS. 7–9 even though they have been inverted so that the bottom of the divider is shown on the top and secured to the overlying outer sheet 194 along three parallel glue lines 196. The opposite side of the divider which is open and defined by two flaps 198 and 200 has one of the flaps 198 secured to the connector sheet 202 while the other flap 200 is unsecured. The panel 190 is shown in a compressed condition in FIG. 100 and an expanded position in FIG. 101. In the compressed condition, it will be seen that the connector sheet 202 is shifted slightly to the right relative to the outer sheet 194. When the panel is allowed to fully expand as shown in FIG. 101, the left sidewall 204 of each cell folds out into a vertical orientation as the material from which the cell is made biases the sheet toward a flat orientation and in doing so, the connector sheet 202 is pulled or shifted to the left so that its edges become aligned with the edge of the outer sheet. The movement of the connector sheet to the left is caused by the unfolding of the sidewalls of the divider. The connection of the left flap 198 to the connector sheet 202 pulls the connector sheet to the left upon expansion of the cell. On the other hand, as the right side of the dividers unfolds and assumes a vertical orientation, the bottom flap 200 associated therewith is allowed to slide relative to the connector sheet 202 so that the flaps become more separated than they are in the compressed condition of FIG. 100. The right sidewall of one divider is then folded into contiguous relationship with the left sidewall of an adjacent divider so that the sidewalls of the dividers reinforce each other and become somewhat rigid to rigidify the panel so that it cannot be easily compressed.

Figure 75:
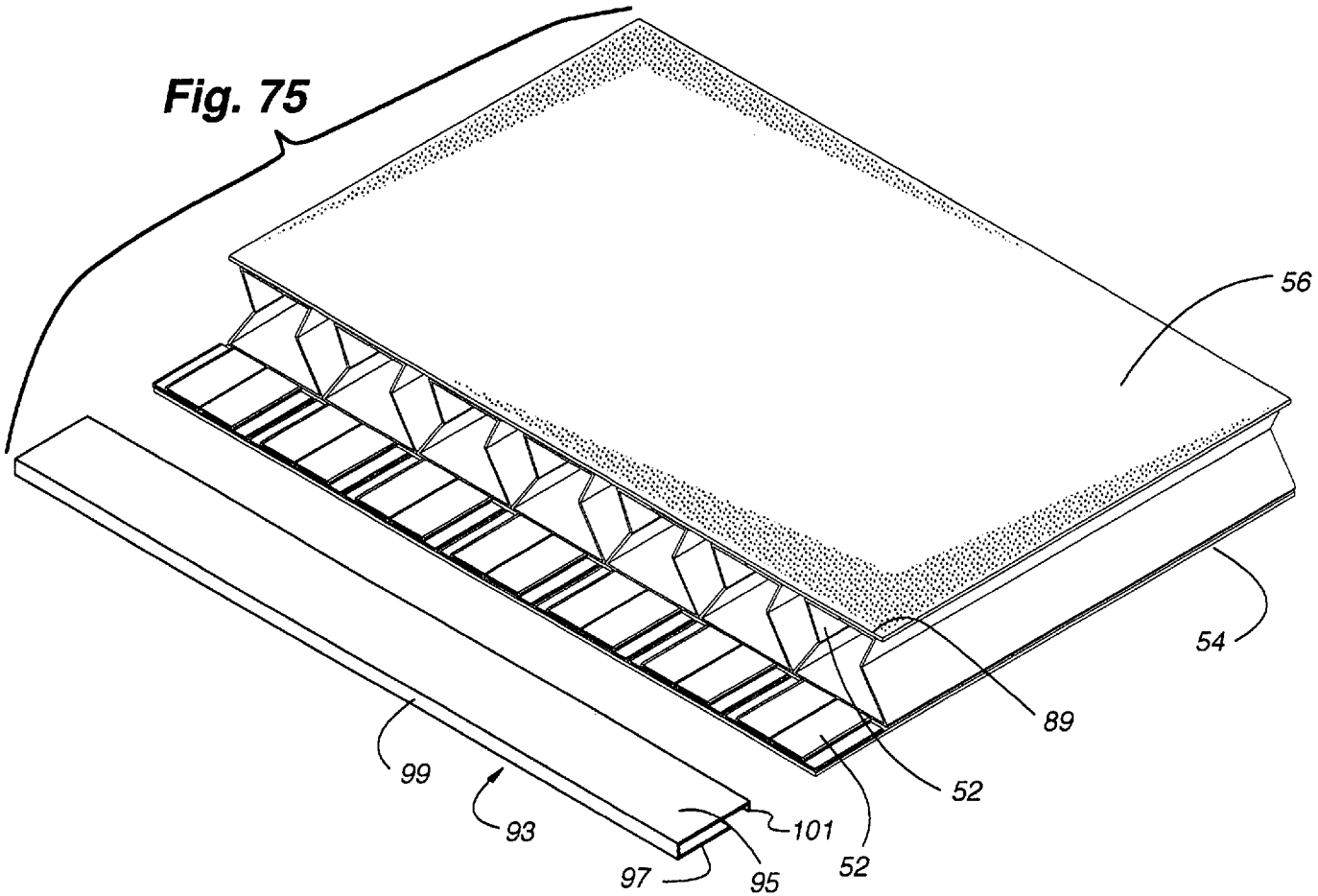
FIG. 75 is a fragmentary isometric similar to FIG. 74 with the partially cut segment of the panel having been compressed and positioned for receipt of an elongated clip.
Figure 77:
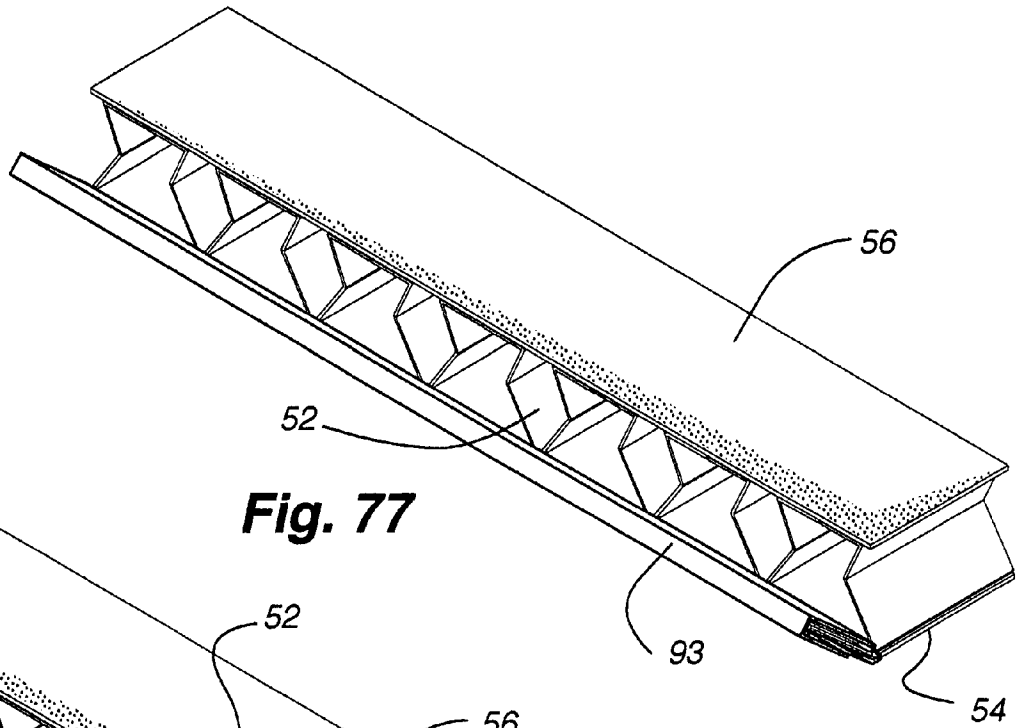
FIG. 77 is a fragmentary isometric similar to FIG. 76 wherein the clip mounted on the compressed segment of the panel is being folded upwardly.
Figure 76:
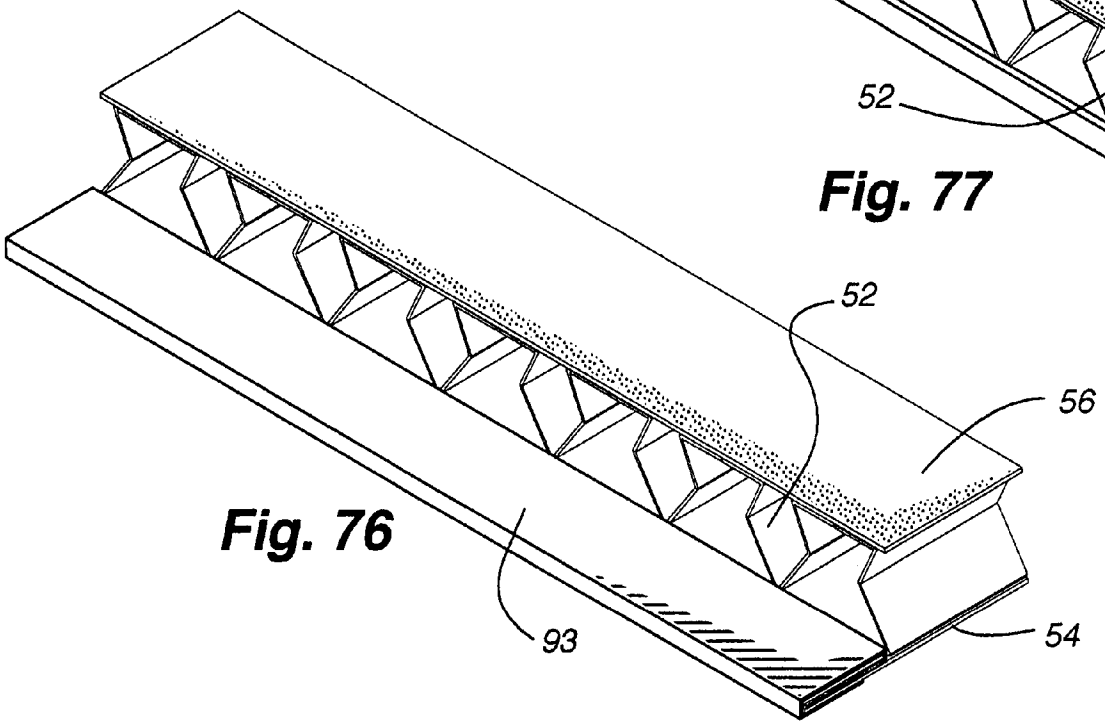
FIG. 76 is a fragmentary isometric similar to FIGS. 74 and 75 showing the clip having been mounted on the compressed segment of the panel.
Figure 79:
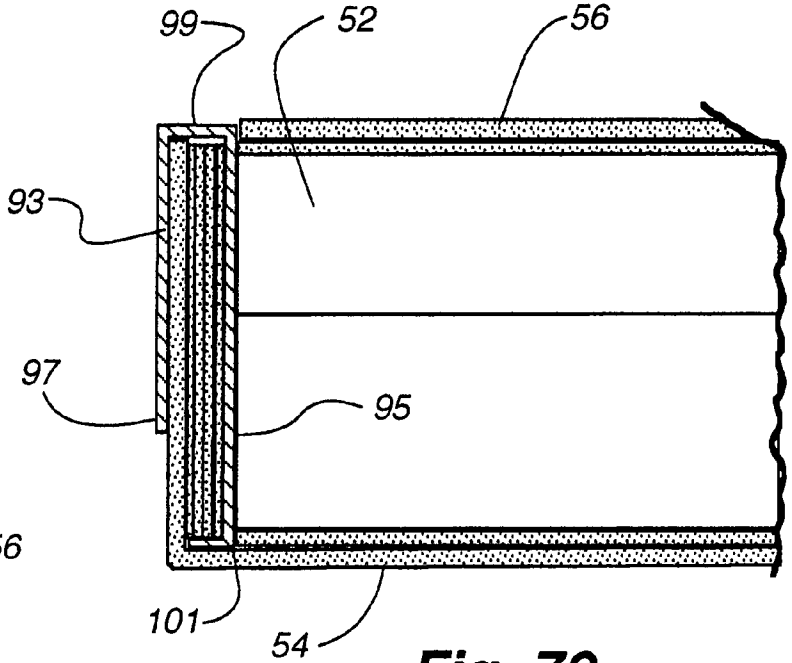
FIG. 79 is an enlarged fragmentary section taken along line 79—79 of FIG. 78.
Figure 78:
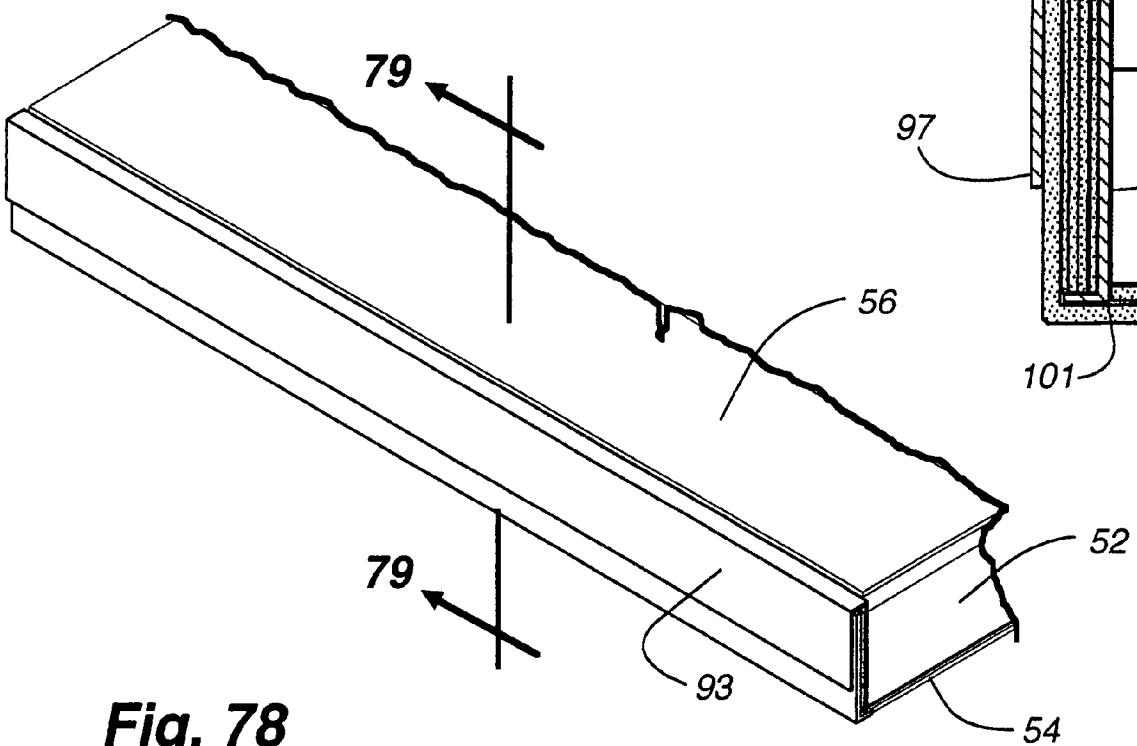
FIG. 78 is a fragmentary isometric similar to FIG. 77 wherein the clip mounted on the compressed segment of the panel has been folded 90.quadrature. into abutment with the new end of the panel.
Figure 80:
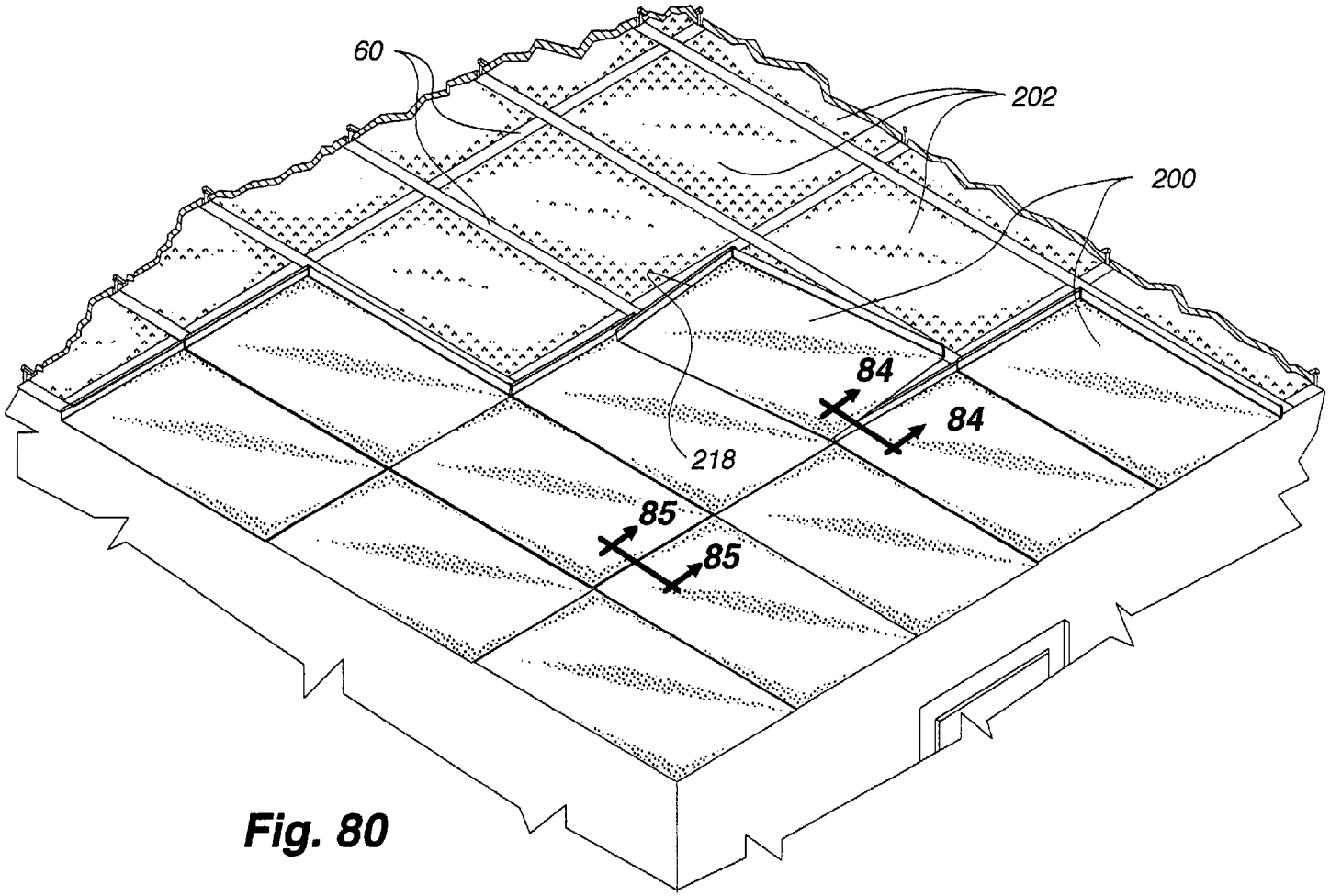
FIG. 80 is a fragmentary isometric view of an alternative arrangement of a ceiling system wherein panels are suspended from rather than supported by a supporting gridwork.

The panel of the present invention is also amenable to rigidification in a cross-direction in a manner illustrated in FIGS. 74–79. It will there be appreciated that a segment of the panel near an end thereof can be partially cut at 89 by cutting through the connector sheet 56 and the dividers 52 (in a direction transverse to the length of the dividers) but not severing the outer sheet 54. This cut forms a small band 91 of material, which can be independently compressed as illustrated in FIG. 75 to receive a rigidifying clip 93. The rigidifying clip in the disclosed embodiment is of substantially J-shaped cross-section having a long side 95, a spaced parallel short side 97, a connecting wall 99 interconnecting corresponding edges of the long and short sides and a lip 101 depending from the long side along the opposite edge from the connecting wall 99. The clip is mounted on the compressed band of material so as to retain the material in a compressed state. The clip and compressed material can then be folded upwardly as shown in FIGS. 77 and 78 to form a rigidification along the end of the panel. Of course, the rigidified band of material can be adhesively secured in position after it has been folded upwardly as illustrated in FIGS. 78 and 79 if desired.

The clip, with appropriate modification readily evident to those skilled in the art, can also be used as a mounting clip for suspending the panel from ceiling support members (not shown) such as of the type described in U.S. Pat. No. 6,199,337 entitled Cladding System and Panel for Use in Such System, which is of common ownership with the present invention. That patent is hereby incorporated by reference.

It should be further understood from the above description of the various embodiments of the present invention that the dividers each have unique features that could be incorporated into the other embodiments. By way of example only, the upper and lower portions of the side partitions of the various dividers or the upper and lower portions of the walls separating the upper and lower marginal zones could be of the same or different dimensions so as to define symmetric and asymmetric dividers. Further, simply changing the angle in the side partition of a divider causes one panel to be more compressible than another. Similarly, by spacing the dividers at greater distances, the panel would be more easily bendable in a transverse direction to the dividers. The depth of the dividers will also affect the strength of the panels (assuming other parameters remain unchanged) so that the length and width of a panel (i.e. the span) can be significantly enlarged without altering strength or bonding characteristics of the panel simply by increasing the depth of the dividers. Also, as mentioned previously, numerous aesthetics and acoustical properties can be created by laminating different types of decorative sheets to the outer sheet of the panel so that one might create a different color, pattern, texture, or the like to the interior of the room in which the panel is used.

It will further be appreciated from the above description that the material from which the outer sheet, connector sheet or dividers is made can be varied to achieve different characteristics for the panel. For example, the materials could be varied to obtain different acoustic characteristics for the panel or to obtain different light transmitting characteristics. Also, the materials could be fire retardant to inhibit the spread of a fire in a building in which the panels were being used. It would also be possible to utilize different materials in the panel with for example the cover sheet or the connector sheet being made of the same or different materials and the dividers also being made of a material that is the same as or different from one of the cover or connector sheets. The dividers themselves might be made of different materials within a single panel. For example certain dividers may be provided to obtain the resilient and compressible feature of the panel while other dividers might be provided to vary the acoustics, light transmitting or fire retardant capabilities of the panel. Also, the panels could be stacked in a building structure to alter the acoustic or light transmitting characteristics of the panels.

While the panels previously described have principally been described for use as a replacement to conventional acoustical tiles that are supported on the T-shaped support members of a drop ceiling gridwork, the panel can be modified slightly so as to also be suspendable from the same T-shaped support members. As will be appreciated, by suspending panels of the present invention from the T-shape support members 60, the panels can be used to replace or renew an existing ceiling system with or without removing the acoustical tiles positioned or supported on top of the T-shaped support members 60.

Figure 84:
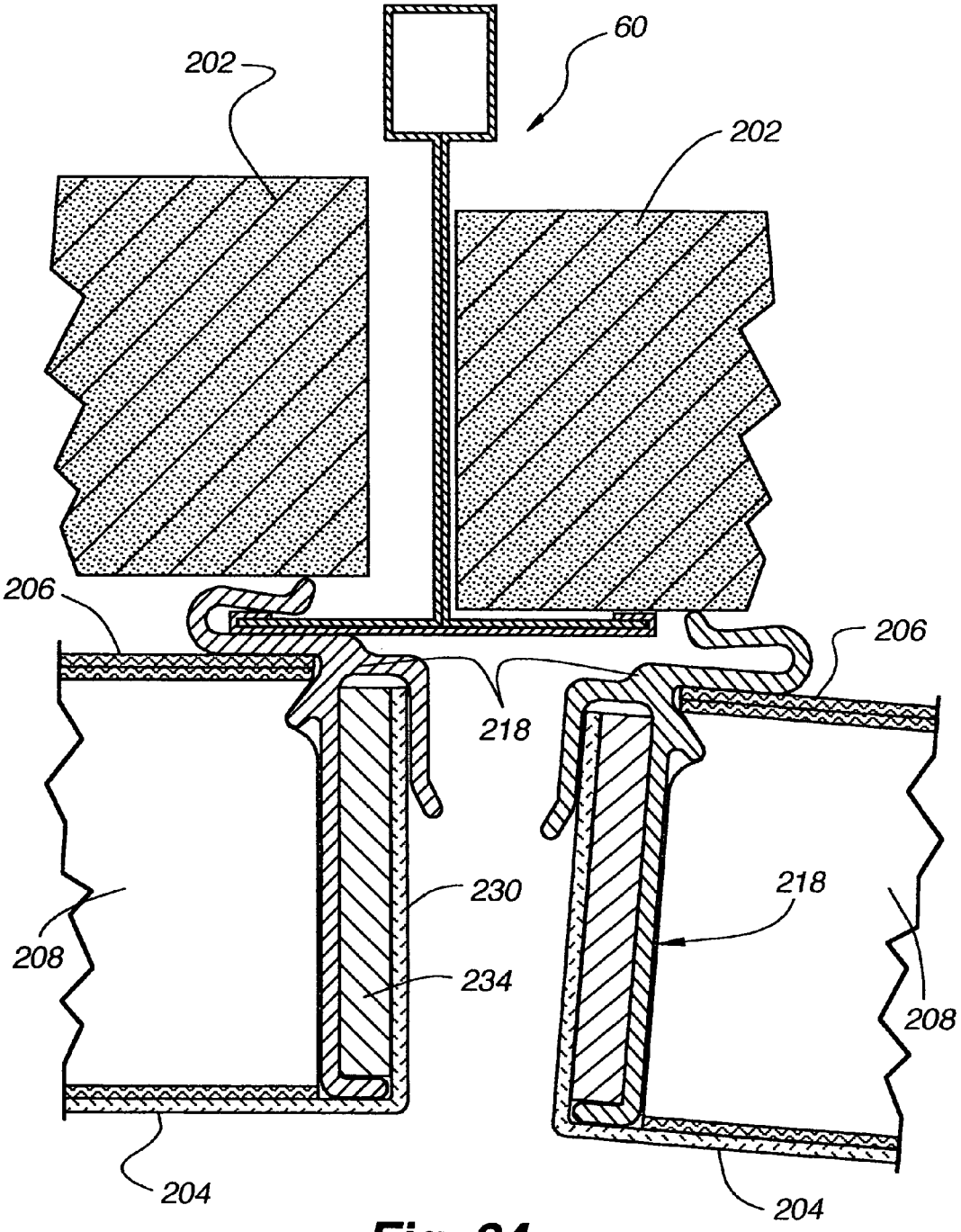
FIG. 84 is an enlarged fragmentary longitudinal section taken along line 84—84 of FIG. 80.
Figure 85:
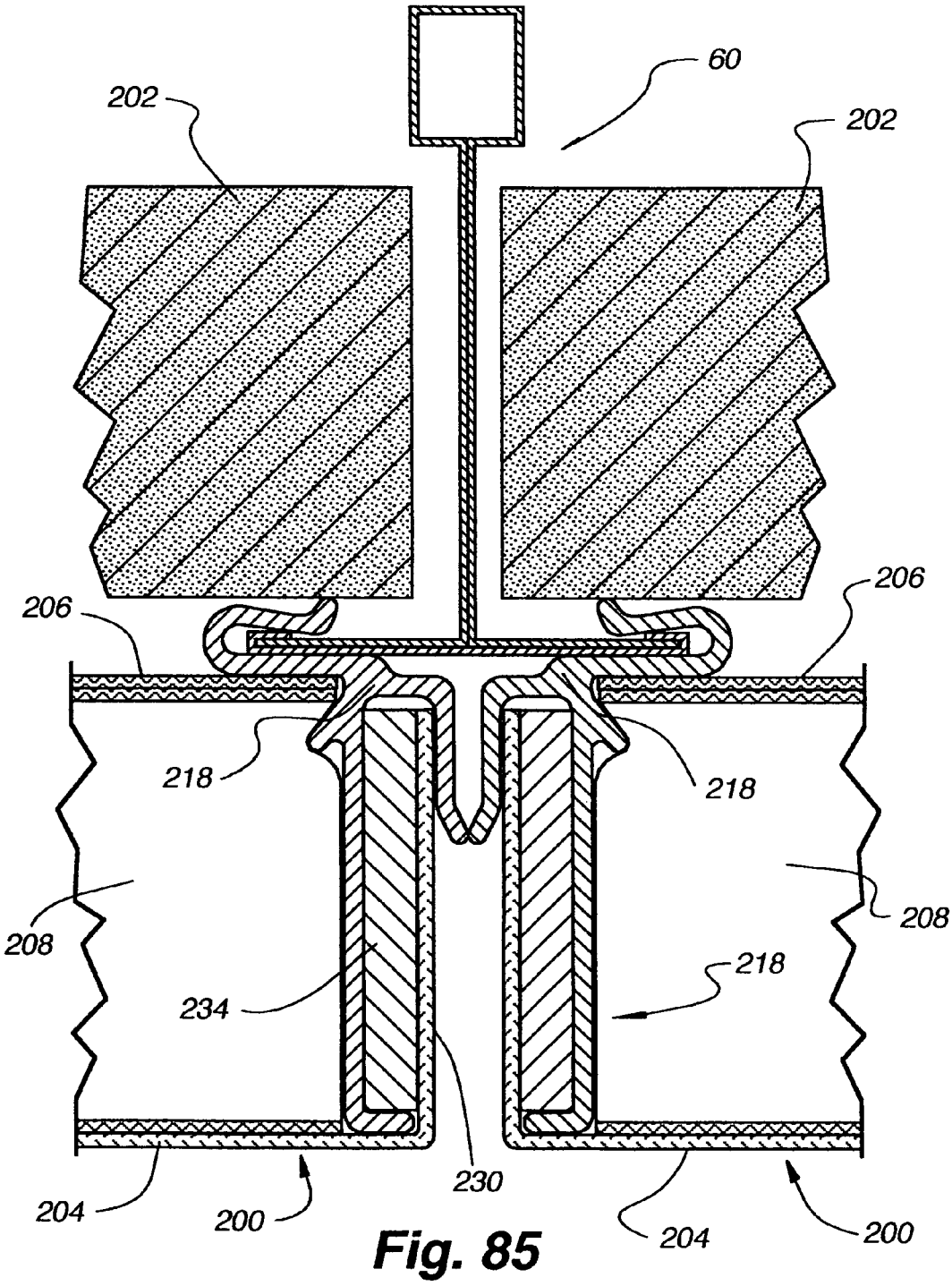
FIG. 85 is an enlarged fragmentary sectional taken along line 85—85 of FIG. 80.
Figure 86:
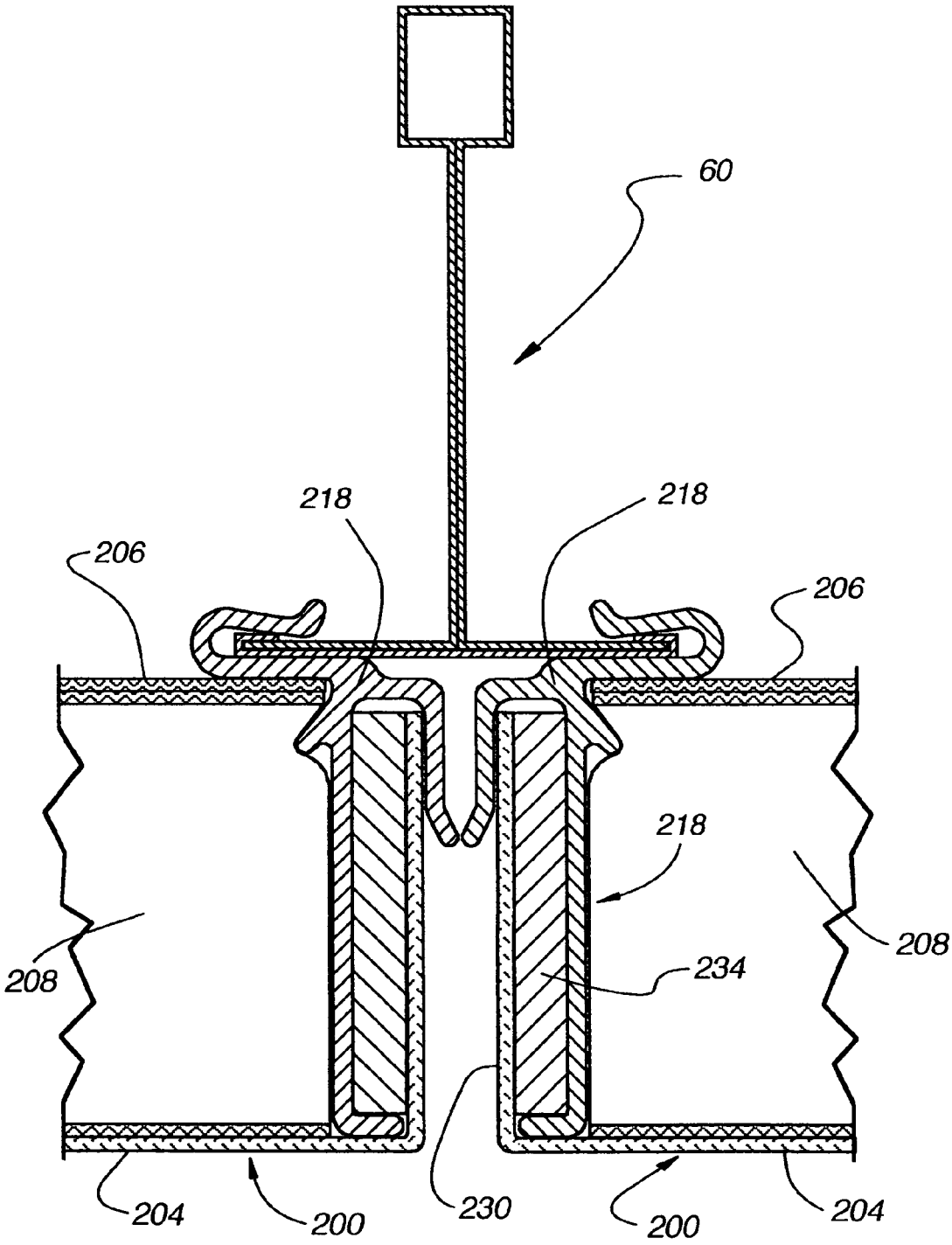
FIG. 86 is a fragmentary vertical section similar to FIG. 85 with the conventional acoustical tiles removed from their supported relationship to the support members.
Figure 88:
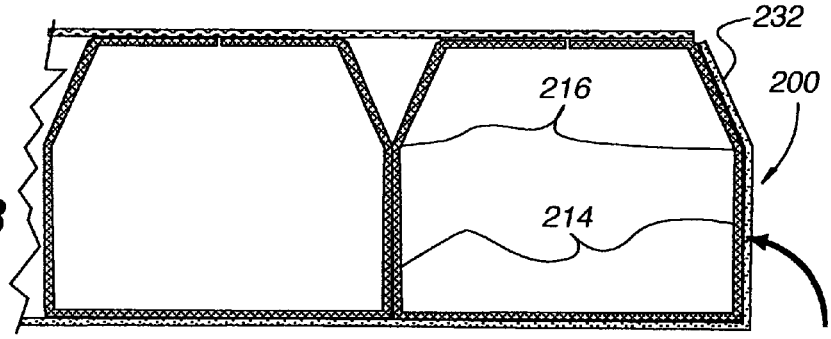
FIG. 88 is a fragmentary vertical section similar to FIG. 87 with the extended outer sheet being folded up and adhesively secured to a longitudinal end of the panel of FIG. 81.
Figure 89:
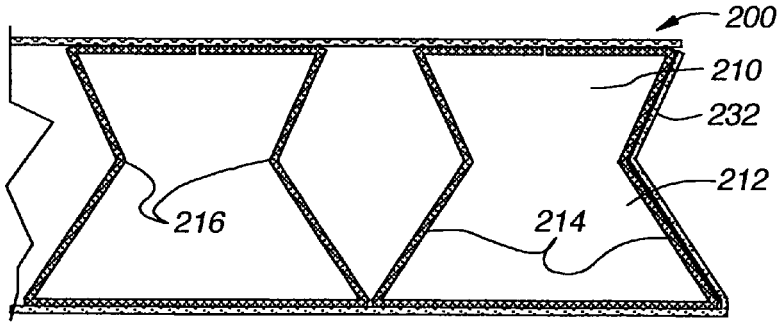
FIG. 89 is a fragmentary vertical section similar to FIG. 88 with the panel slightly compressed.
Figure 90:
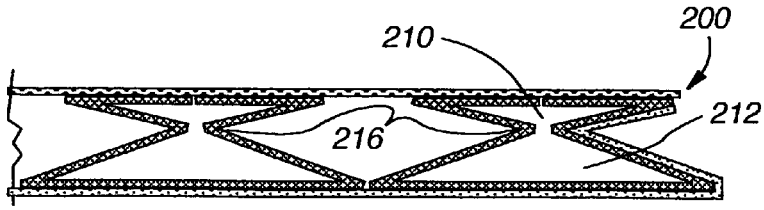
FIG. 90 is a fragmentary vertical section similar to FIG. 89 with the panel further compressed.
Figure 91:
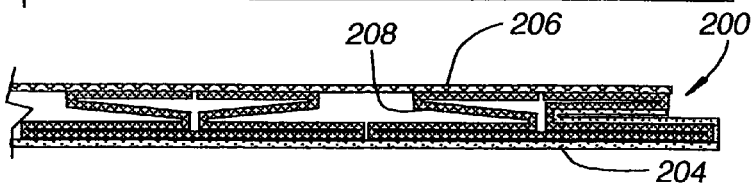
FIG. 91 is a fragmentary vertical section similar to FIG. 90 with the panel substantially fully compressed.

A panel 200 that has been modified to be suspendable from or supportable by the T-shaped support members 60 is shown in FIGS. 80–96 with a plurality of the panels shown in FIG. 8 installed in underlying relationship to existing acoustical panels 202 supported on support members 60. As will be appreciated, each panel 200 is of the general type previously described and as seen in FIGS. 84–86 has an outer sheet 204, a connector sheet 206, and a plurality of parallel cellular dividers 208 therebetween. The cellular dividers are preferably, as previously described, compressible in nature and best seen in FIGS. 87–91 as being formed from individual strips of material that have been creased and folded so as to define elongated tubes having two truncated triangular areas 210 and 212 superimposed upon each other. The dividers 208 have foldable intermediate side walls 214 with fold lines 216, which allow the side walls to either fold inwardly as shown in FIGS. 89–91 or fold outwardly as shown in FIGS. 87 and 88 depending upon a number of conditions including the type of binder used in the fiberglass matting material from which the dividers are made and the treatment of the dividers to heat and cold which will be described in more detail later.

At each end of the panel 200 along the open ends of the cellular dividers 208, a unique clip 218 as seen best in FIGS. 81–86, is secured to the panel. The clips are elongated and preferably extruded members of a rigid material such as aluminum, plastic, or the like and are generally of inverted J-shaped configuration as probably best seen in FIG. 82. They therefore define a vertical main flat body 220 with a lower protruding lip 222 from the bottom edge of the main body. An upper downwardly opening hook-shaped channel 224 extends from the upper edge of the main body. Also along the upper edge is formed a second or horizontally opening hook-shaped channel 226 which protrudes from the main body in the opposite direction as the lip 222 even though it opens in the same direction as the lip 222. An obliquely protruding rib 228 extends downwardly from the upper edge of the main body beneath the horizontally opening channel 226.

Figure 87:
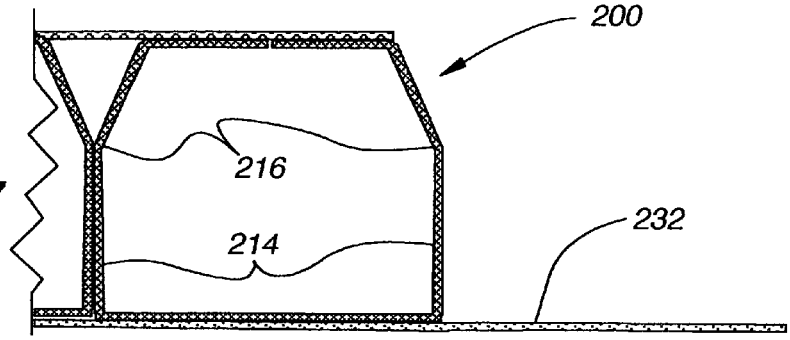
FIG. 87 is a fragmentary transverse vertical section taken through the panel of FIG. 81 showing the outer sheet extended from a longitudinal side edge of the panel.
Figure 92:
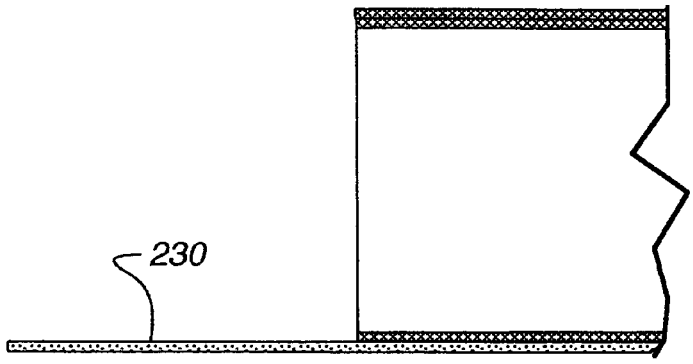
FIG. 92 is a fragmentary longitudinal vertical section showing the outer sheet extending longitudinally from one end of the panel of FIG. 81.
Figure 93:
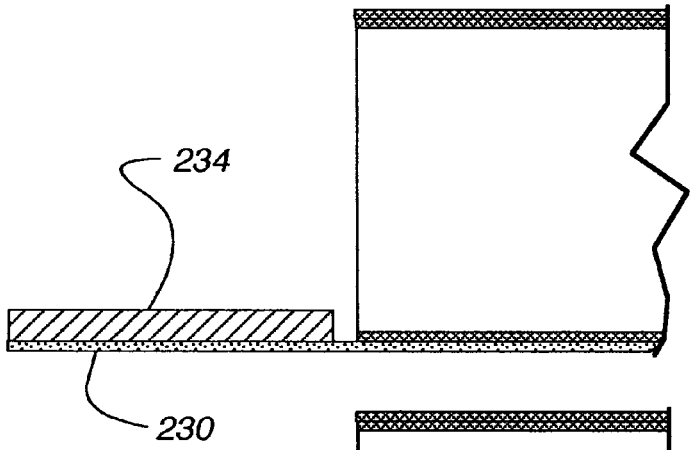
FIG. 93 is a longitudinal fragmentary vertical section similar to FIG. 92 with a stiffener strip supported on the outer sheet extension.
Figure 94:
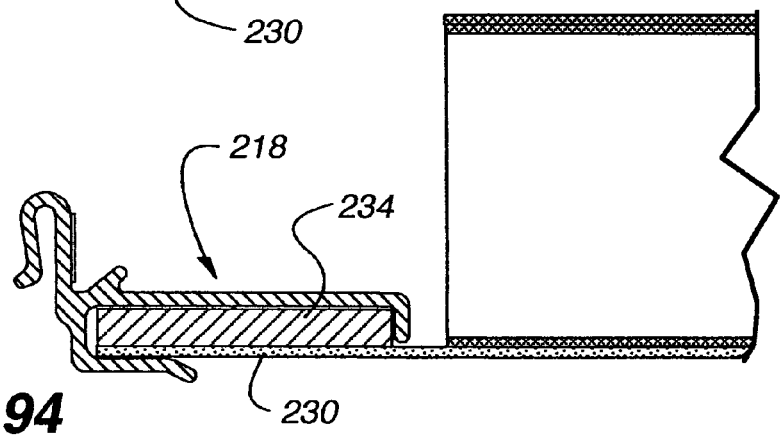
FIG. 94 is a longitudinal fragmentary vertical section similar to FIG. 93 with a clip secured to the outer sheet extension.
Figure 95:
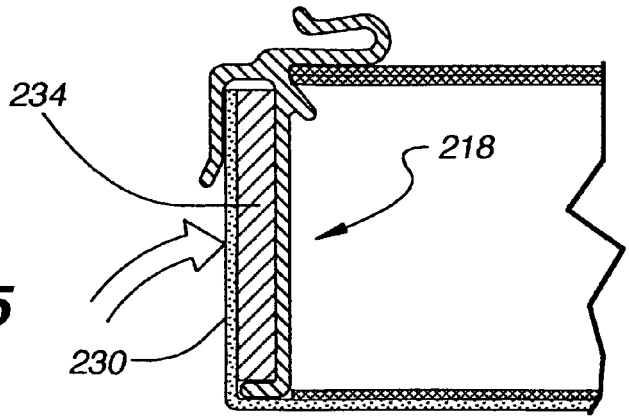
FIG. 95 is a longitudinal fragmentary vertical section similar to FIG. 94 with the clip being folded upwardly to overlie the longitudinal end of the panel.

With reference to FIGS. 92–95, the clip 218 is secured to the end of the panel 200 either by notching the end of the panel, as described previously, so that the outer sheet 204 protrudes longitudinally from opposite ends of the panel or the outer sheet can be made slightly longer and wider than the remainder of the panel so that it naturally protrudes from opposite ends and opposite sides as shown in FIGS. 87 and 92 defining outer sheet longitudinal extensions 230 and outer sheet lateral extensions 232. An elongated straight stiffening strip 234, which might be made of plastic, aluminum, paperboard, or the like, is adhesively bonded to the top surface of the outer sheet longitudinal extension 230 where it protrudes from the ends of the panel and clips are thereafter positioned over the outer sheet longitudinal extensions and the stiffeners as shown in FIG. 94 by inserting the stiffener strips and outer sheet longitudinal extensions into the downwardly opening J-shaped channels 224 adjacent to the main bodies with the lip 222 hanging over the innermost edge of the stiffeners. With the clips so positioned, the outer sheet longitudinal extensions 230, stiffener 234 and clip 218 can be folded upwardly as shown in FIG. 95 until the connector sheet 206 at opposite ends of the panel is received between the horizontally opening J-shape channels 226 and the oblique ribs 228 of the clips. The underside of the horizontally opening J-shaped channels 226 can then be adhesively or otherwise secured to the connector sheet 206 to hold the clip in the position illustrated in FIG. 95.

The oblique rib 228 of each clip projects beneath the connector sheet 206 so as to hold the panel in a fully expanded position. By following the same procedure at each longitudinal end of the panel, it will be appreciated that the ends of each panel will have a clip thereon and the horizontally opening J-shaped channels 226 are positioned to be secured to a flange of the T-shaped support member 60 as shown in FIGS. 84 and 85.

Figure 92A:
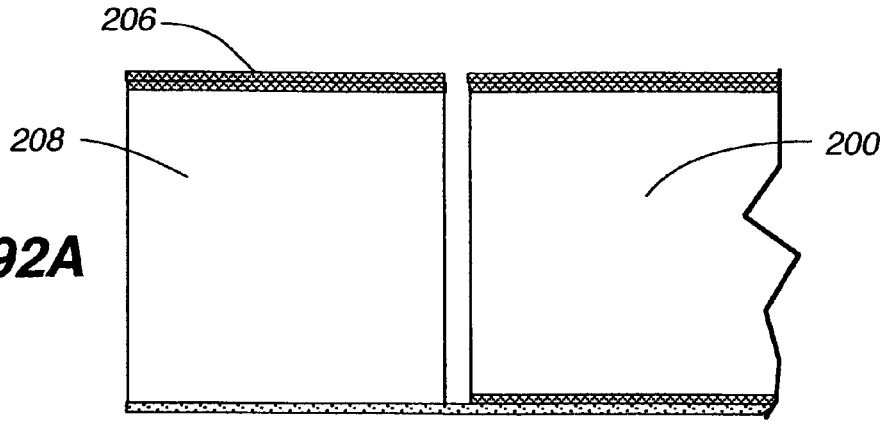
Figure 93A:
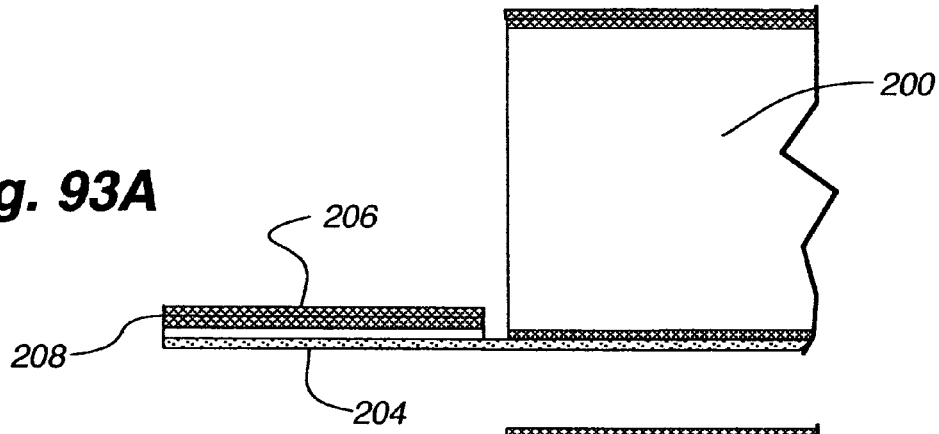
Figure 94A:
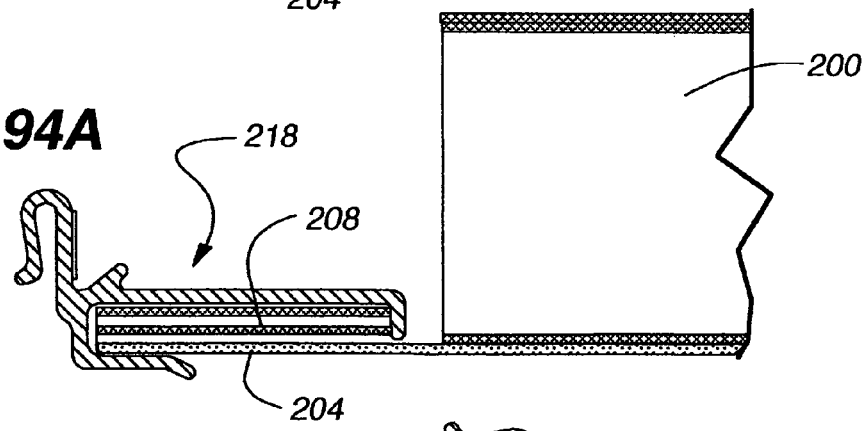
Figure 95A:
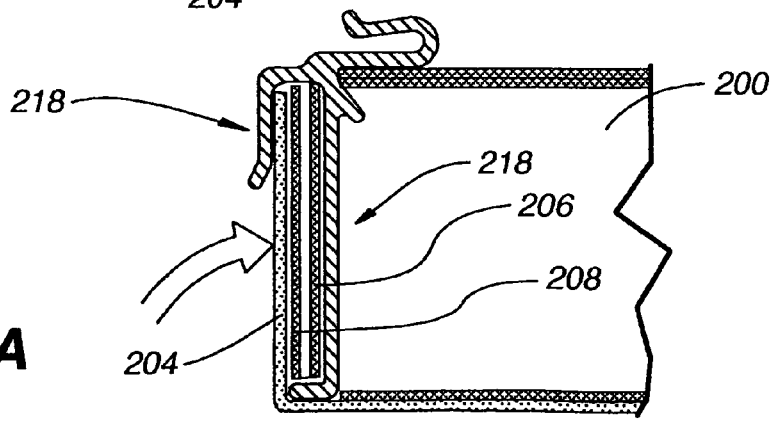

An alternative way for securing a J-shaped clip to ends of the panel is shown in FIGS. 92A–95A. In the alternative system, at an open longitudinal end of a panel, a cut or slit is made downwardly through the connector sheet 206 and the open ends of the dividers 208 as shown in FIG. 92A, so as to define a slight gap between the severed portions of the connector sheet and the dividers and the remainder of the panel. The severed portions of the connector sheet and dividers are then compressed downwardly into closely adjacent relationship with the outer sheet 204 and this compressed material is then inserted into the downwardly opening J-shaped channels 224 of the clip so that the lip 222 of the clip hangs over the innermost edge of the compressed material, as shown in FIG. 94A. The clip with the compressed material confined therein is then folded upwardly as shown in FIG. 95A and secured in position, preferably with adhesive so as to define a longitudinal end of a panel.

Figures 81, 82, 83:
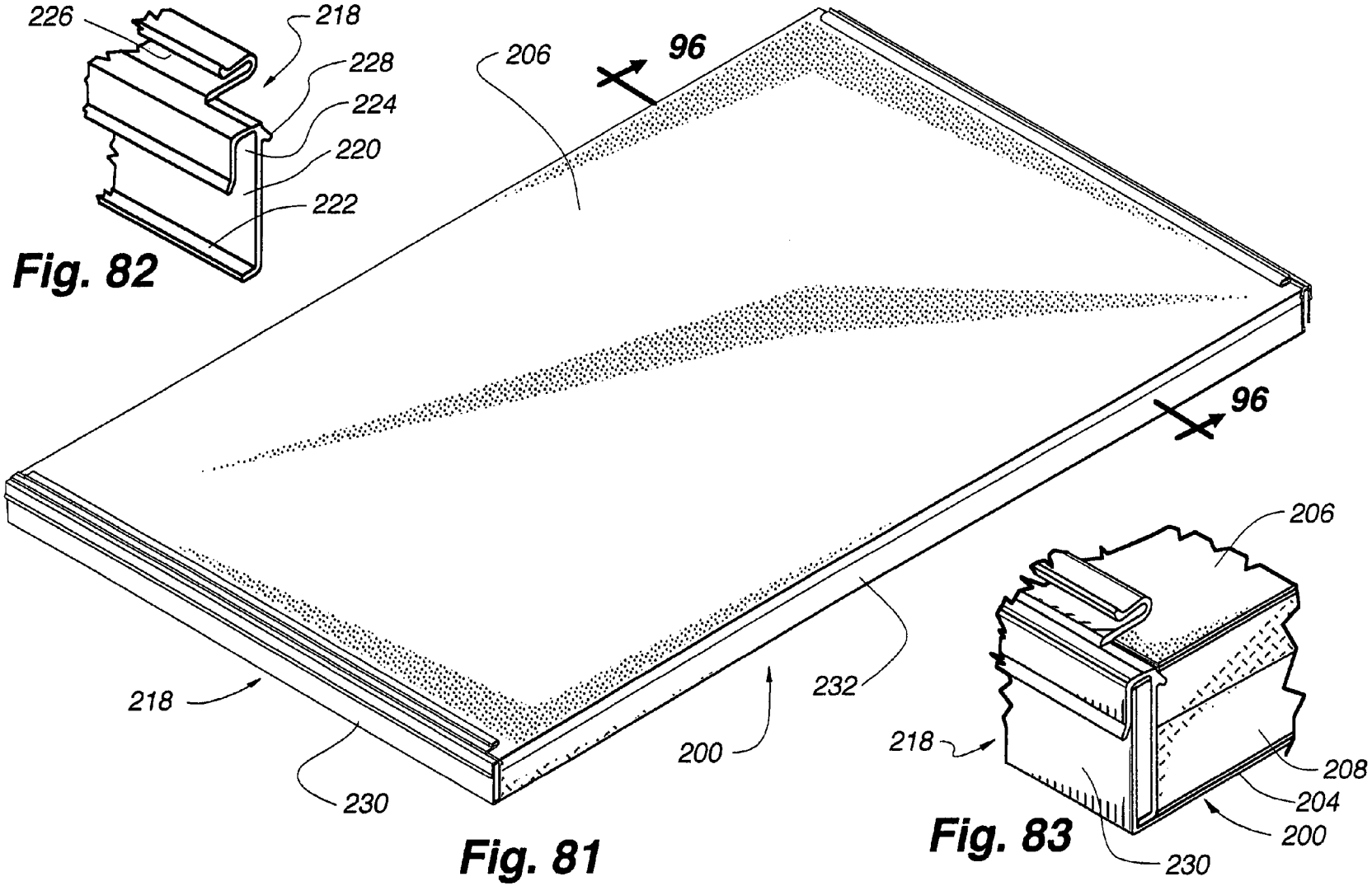
FIG. 81 is an isometric view of a panel for use in the ceiling system shown in FIG. 80.
FIG. 82 is a fragmentary isometric view of an end of a clip member used in the panel of FIG. 81.
FIG. 83 is a fragmentary isometric view of the clip of FIG. 82 mounted on the longitudinal end of the panel shown in FIG. 81.

As illustrated in FIG. 83, the ends of the horizontally opening J-shaped channels 226 are spaced inwardly from opposite longitudinal ends of the clip 218 to accommodate a T-shaped support member 60 that extends perpendicularly to the T-shaped support member 60 to which the clip is secured. In this manner, the panels can be carried by a conventional gridwork of T-shaped support members in a suspended or supported manner with or without another set of acoustical tiles being supported by the gridwork. In other words, the panels 200 with the clips 218 secured thereto can be used in connection with an existing gridwork or in connection with a new gridwork in exactly the same manner. As will also be appreciated, the clips of adjacent longitudinally aligned suspended panels can abut each other (FIG. 85) so the ends of the outer sheets of the panels are only slightly spaced to give a substantially continuous appearance to the ceiling with virtually no view of the gridwork from which the panels are suspended. Further, due to the fact that the clips hold the panels in their fully expanded position, the lower or outer sheet 204 of each panel will be horizontally aligned with the outer sheet of an adjacent panel to give a smooth uniform appearance to a ceiling formed from such panels. Referring to FIGS. 87–91, the outer sheet lateral extensions 232 can be folded up into engagement with the adjacent sidewall 214 of the outermost divider and secured thereto with a suitable adhesive to give the panel a finished look along its side edges. Systems for folding the lateral extensions can be found in co-pending application Ser. No. 10/309,944, filed Dec. 3, 2002, and entitled "Method and Apparatus for Fabricating Cellular Structural Panels," which is of common ownership with this application and is hereby incorporated by reference.

Figure 104:
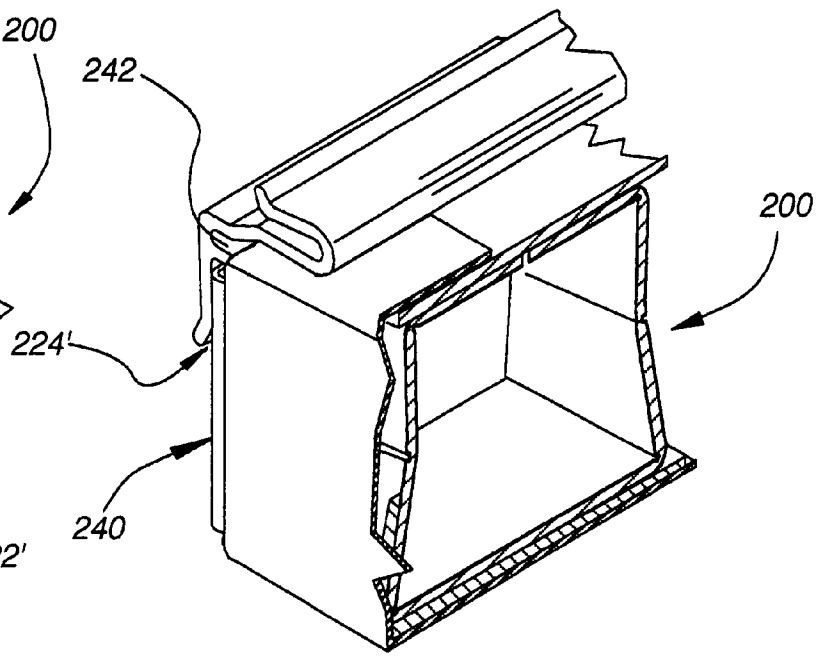
FIG. 104 is a fragmentary isometric showing the clip being moved into a closed position at the end of the associated panel.
Figure 102:
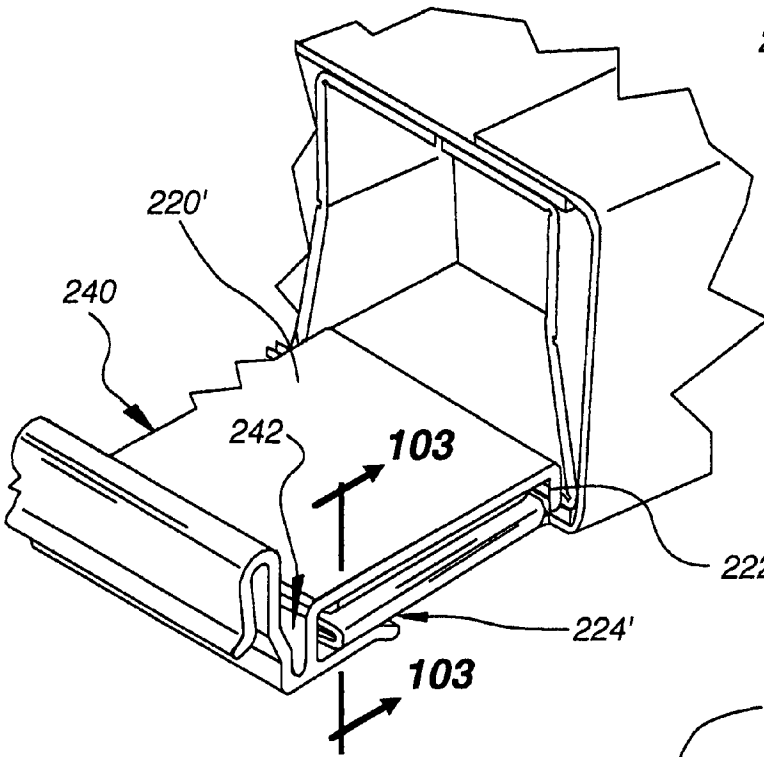
FIG. 102 is a fragmentary isometric showing an alternative clip embodiment connected to the end of a panel.
Figure 103:
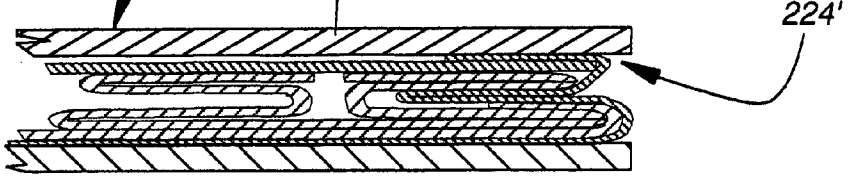
FIG. 103 is an enlarged fragmentary section taken along line 103—103 of FIG. 102.
Figure 105:
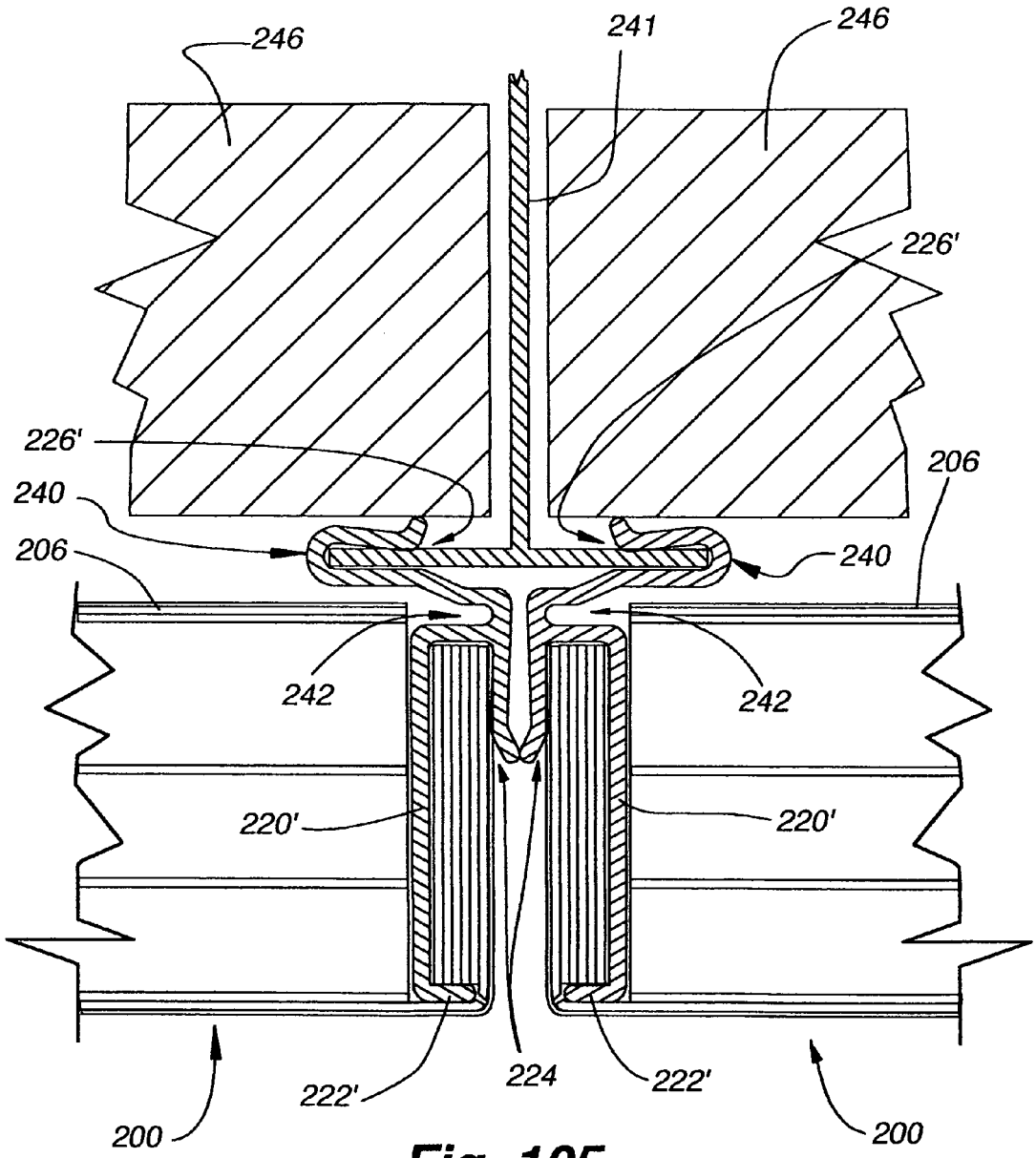
FIG. 105 is a fragmentary vertical section showing a panel with a clip of the type shown in FIG. 102 supporting adjacent panels from an inverted T-grid support system.

A slightly modified clip 240 for the ends of the panels 200 is shown in FIGS. 102–108. The clip 240 is substantially similar to the previously-described clip 218 shown in FIG. 82, the difference residing simply in the fact that the clip 240 does not have a rib 228. In describing the clip 240 corresponding parts to the clip 218 will be assigned corresponding reference numerals with a prime suffix. The clip 240 could be mounted on the ends of the panel in any of the afore-described ways or it could be mounted as described in the aforenoted co-pending application Ser. No. 10/309,944. In the method shown in the afore-described pending application, the entire panel 200 is compressed and clips 240 mounted on opposite ends of the panel so that the compressed material along the ends of the panel is confined within a channel 224' adjacent to the main body 220' of the clip. Subsequent to mounting the clip on the compressed ends of the panel, a notch is formed in the panel adjacent to the clip so that a lip 222' on the clip can protrude into the notch allowing the clip to be fully received on the compressed end of the panel. The notch also allows the clipped ends of the panel to be folded into confronting overlying relationship with the open ends of the dividers as seen in FIG. 104 to thereby close the ends of the panel. The clip is shown mounted on the compressed end of the panel in FIG. 102 where the remainder of the panel has been allowed to expand and closed into overlying relationship with the open ends of the dividers in FIG. 104. Another difference in the clip shown in FIGS. 102–108 and the clip 218 shown in FIG. 82 resides in the fact that a channel or connector 242 is defined between the downwardly opening channel 224' and the horizontally opening channel 226' with the channel 242 opening in the opposite direction to the channel 226'. The channel 242 is provided to facilitate the mounting of a panel having the clips on the ends thereof to a supporting T-grid system as will be described hereafter.

Figure 106:
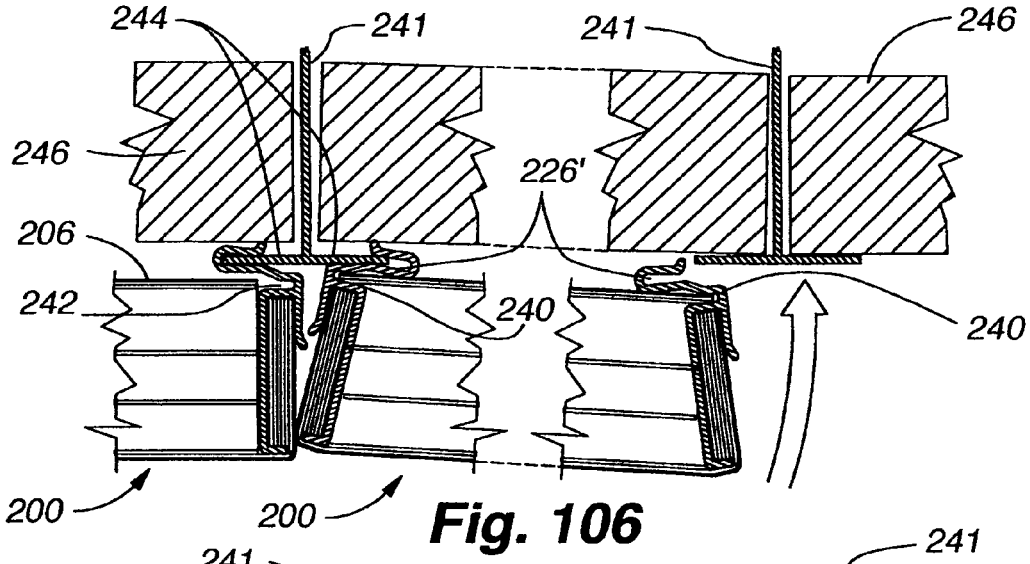
FIG. 106–108 are fragmentary vertical sections showing sequential steps for mounting the panel with a clip of the type shown in FIG. 102 to an inverted T-grid support system.
Figure 107:
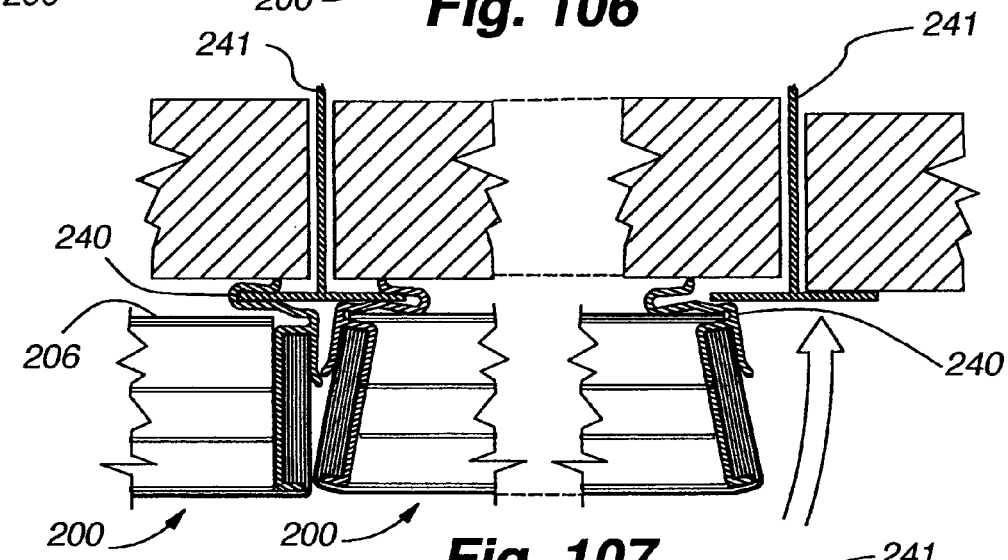
Figure 108:
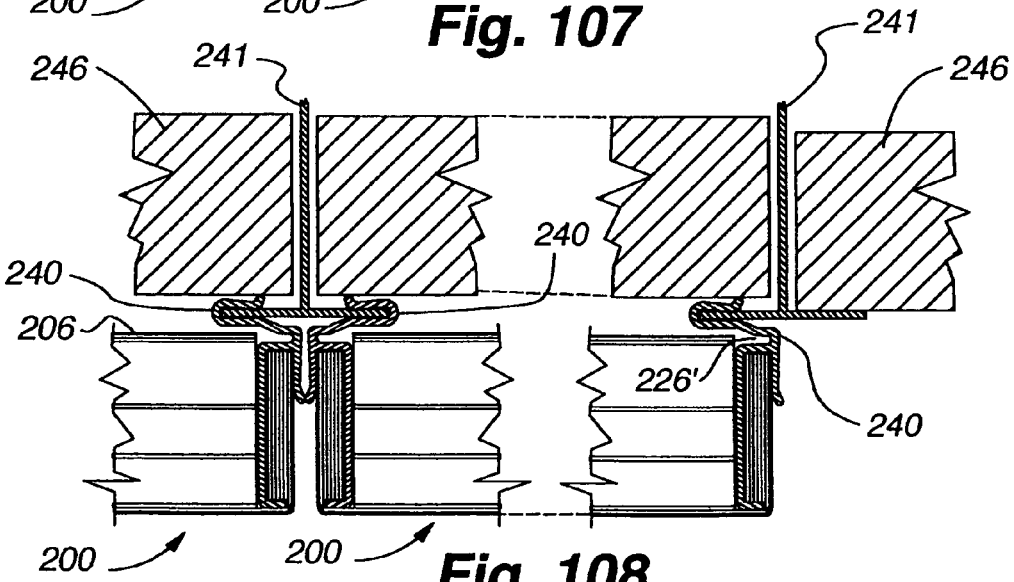

As best seen in FIGS. 106–108, when mounting a panel 200 having the clips 240 on the opposite ends thereof on a T-grid system wherein inverted T-shape supports 241 in the system have oppositely directed flanges 244 on which other panels 246 of a ceiling system may be supported, the clip 240 on one end of the panel is advanced onto an associated flange 244 by inserting the flange into the horizontal channel 226'. It will be appreciated that the connector sheet 206 of the panel, which is at the top thereof, may or may not be fully inserted into the horizontal channel 242 in order to facilitate the connection of the clip to the flange, but when connecting the opposite end of the panel to the next adjacent flange 244 of an inverted T-shaped support, the clip, as seen in FIGS. 106 and 107 is compressed against the end of the panel so that the connector sheet 206 becomes fully inserted into the horizontally opening channel 242 allowing the channel 226' in the clip and thus the panel itself to be pivoted and raised high enough to be in alignment with the associated flange 244 and at that point in time, the clip can be pivoted outwardly again allowing the channel 226' to receive the flange and allowing the connector sheet 206 to be removed from the channel 242. As seen in FIG. 108, the clips 240 at opposite ends of the panel have been mounted on associated flanges 244 of inverted T-shaped supports and the connector sheets 206 have been removed from the channels 242 so that the clips form vertical covers over the ends of the panel and can be positioned in adjacent relationship with clips 240 of an adjacent panel. It will also be appreciated that the clips of adjacent panels engage each other so that the inverted T-shaped supports are hidden from view once the panels having the clips thereon are suspended from the T-grid system.

Figure 109:
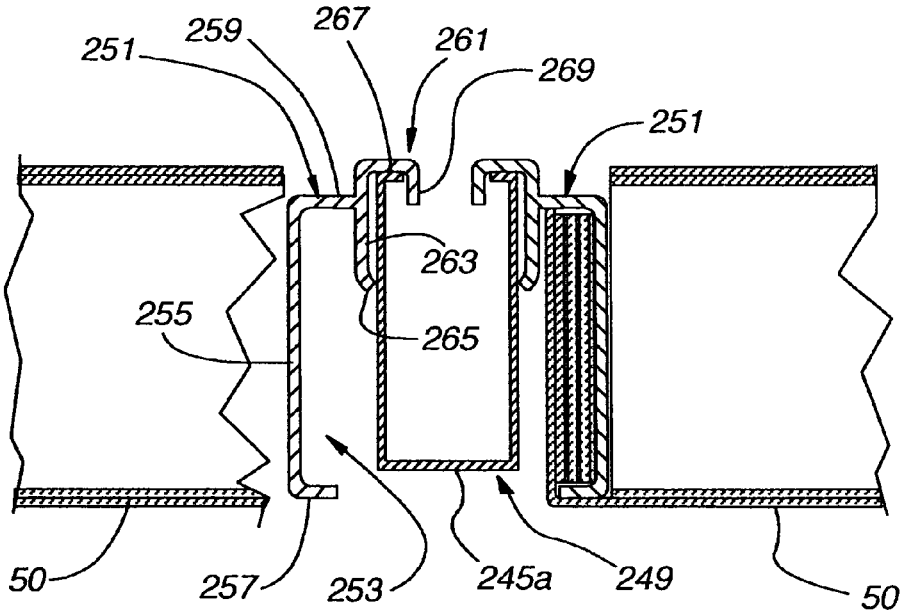
FIG. 109 is a fragmentary vertical section with parts removed illustrating a U-shaped support system and panels with side edge clips for cooperation therewith.
Figure 110:
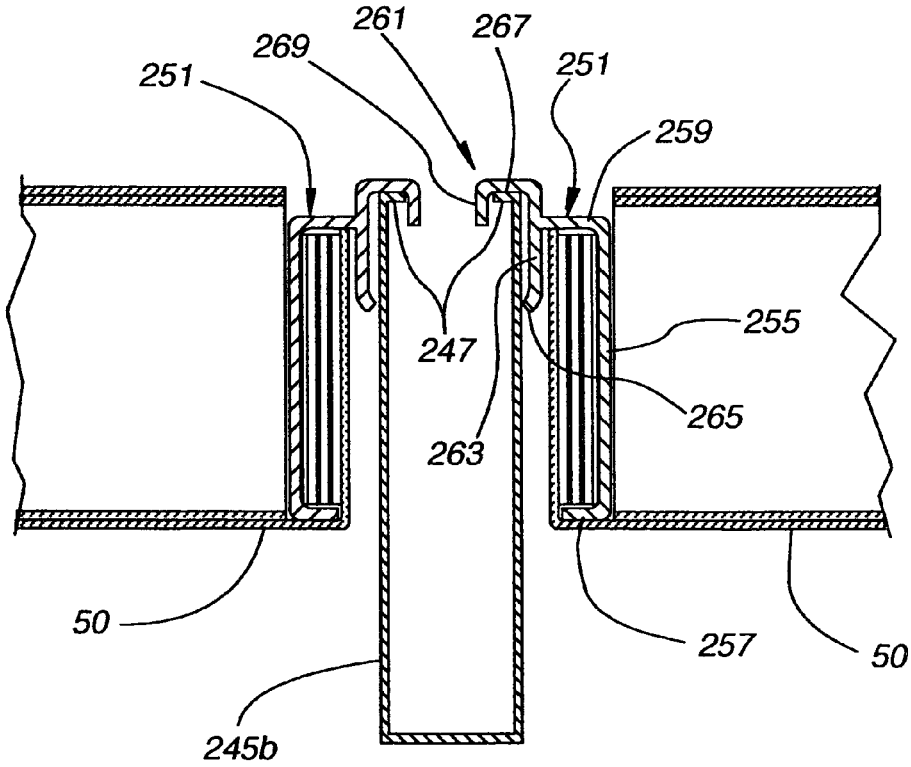
FIG. 110 is a fragmentary vertical section similar to FIG. 109 showing a deeper U-shaped support system.

Not all support systems for ceiling panels have support members of inverted T-shaped cross section. Rather, as seen in FIGS. 109 and 110 respectively, the support members 245*a* and 245*b* could be of generally U-shaped channeled cross section having inturned lips 247 along the two upper edges of the channeled support members. The channeled support members could have various depths depending upon the aesthetic appearance desired for the ceiling system and, for example, in FIG. 109, the channel 245*a* is fairly shallow in relation to the channel 245*b* illustrated in FIG. 110. The more shallow channel can be seen to define a recess 249 between adjacent ceiling panels 50 whereas the deeper channel 245*b* can be seen to extend downwardly beyond the lower surface of the ceiling panels supported thereby.

An edge clip 251 for use with ceiling panels 50 to be supported by a channeled support system is also seen in FIGS. 109 and 110, and as will be appreciated, the clip is designed to fit along the edge of the panel 50 similarly to the previously described clips 218 or 240. The clips 251 are elongated as with the previously described clips and are preferably extruded members of a rigid material such as aluminum, plastic, or the like. The clips define an open channel 253 that opens horizontally when the clip is in use on the edge of a panel as illustrated and defines a vertical main flat body 255 with a lower lip 257 protruding horizontally away from the lower edge of the main flat body. A corresponding horizontally extending lip 259 is provided away from the top edge of the main flat body with the upper horizontal lip being integral at its distal edge with a smaller channel-shaped portion 261 of the clip. The smaller channel 261 is in cross section of an inverted J-shaped configuration. The smaller channel also opens horizontally in the same direction as the main channel and defines a vertical plate portion 263 with an obliquely angled lip 265 along its lower edge and a horizontal extension 267 along its upper edge. The distal or outermost edge of the upper horizontal extension 267 has a downwardly depending lip 269 forming a hook to complete the smaller channel.

The main channel 253 receives an edge portion of the panel 50 to which it is to be connected in the same manner as the clips 218 and 240 described previously. The smaller channel 261 is adapted to receive the upper edge of the U-shaped support member 245*a* or 245*b* with the hook portion of the inverted J-shaped smaller channel being supported by an upper edge of the U-shaped support member and the oblique lip 265 engaging an outer surface of the U-shaped channel to positively but releasably secure the clip to the U-shaped channel.

As can be appreciated, when a panel is to be connected to a U-shaped support member, the adjacent edge of the panel 50 with the clip 251 thereon can be raised above the U-shaped support member and the inverted J-shaped smaller channel 261 is moved over the associated side edge of the U-shaped support. The panel can then be lowered until the clip 251 supports the panel on the associated side edge of the U-shaped support member. Of course, to remove the panel, the reverse process is followed.

Figure 97:
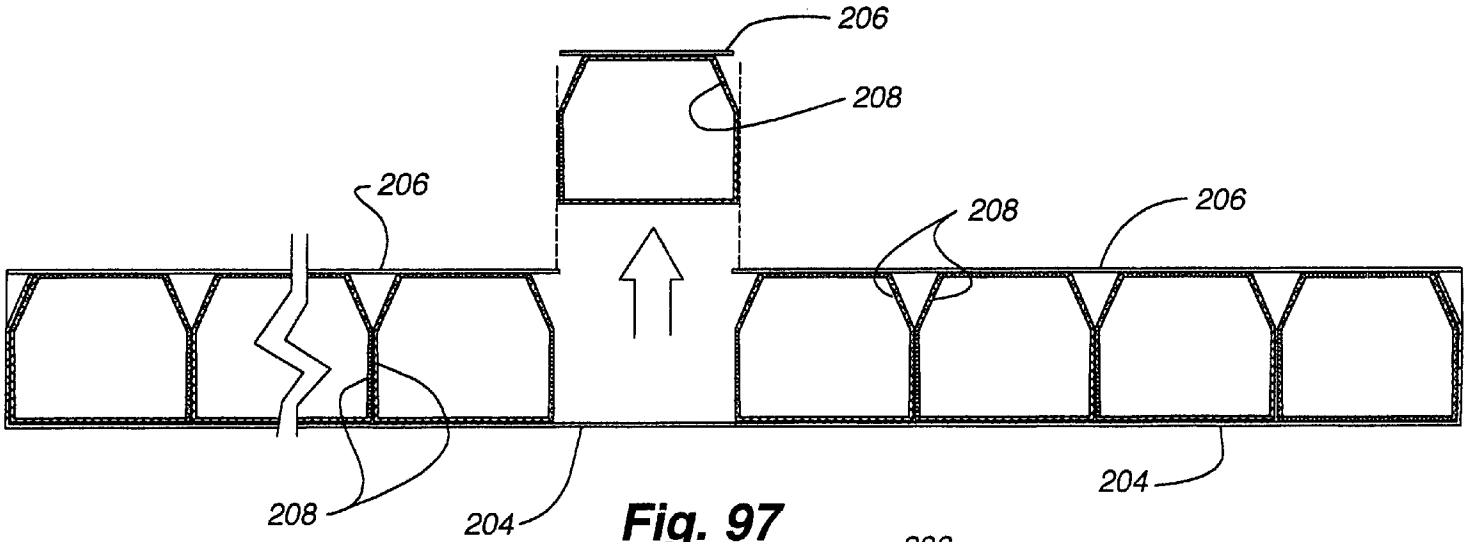
FIG. 97 is a transverse section with portions removed showing one divider being removed to facilitate a folding of the panel.
Figure 98:
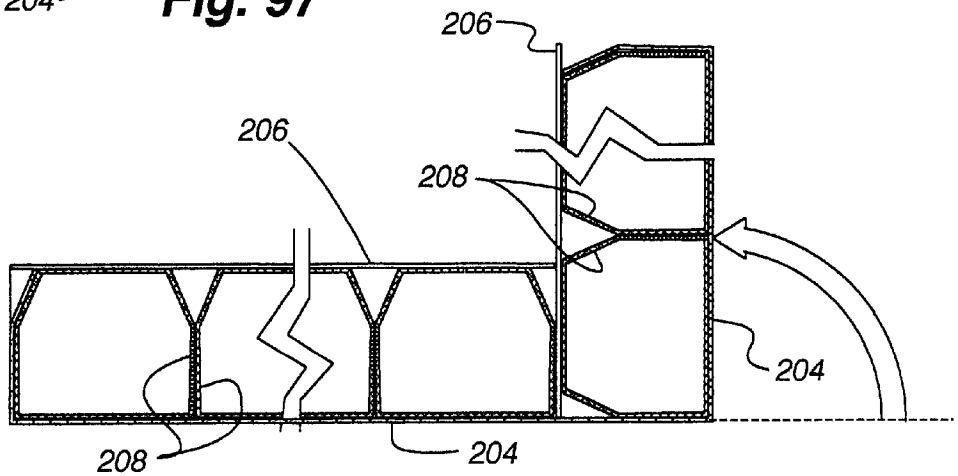
FIG. 98 is a transverse section with portions removed similar to FIG. 97 showing the panel folded about the space where the divider was removed as seen in FIG. 97.

Sometimes it might be desirable to fold a panel around a corner or to form a corner. With the panel of the present invention, such a fold or corner can be made in an aesthetically attractive manner as illustrated in FIGS. 97 and 98. It will be seen in FIG. 97 that a divider 208 including the connector sheet 206 across the top thereof can be severed from the remainder of the panel at the location where a fold or bend is desired in the panel leaving the outer sheet 204 where the divider was removed. The remaining portions of the panel can be folded in one direction or the other as illustrated in FIG. 98 so that one remainder portion of the panel is oriented perpendicularly to the other portion with the outer sheet 204 extending continuously around the bend so as to define a fully finished corner for the panel. Such a fold in the panel might be desirable, for example, in a skylight where a window is raised above the ceiling level into an upwardly recessed area and by following the procedure shown in FIGS. 97 and 98, a panel or panels can be folded to extend from the normal ceiling level up into the recessed area of the skylight.

Figure 96:
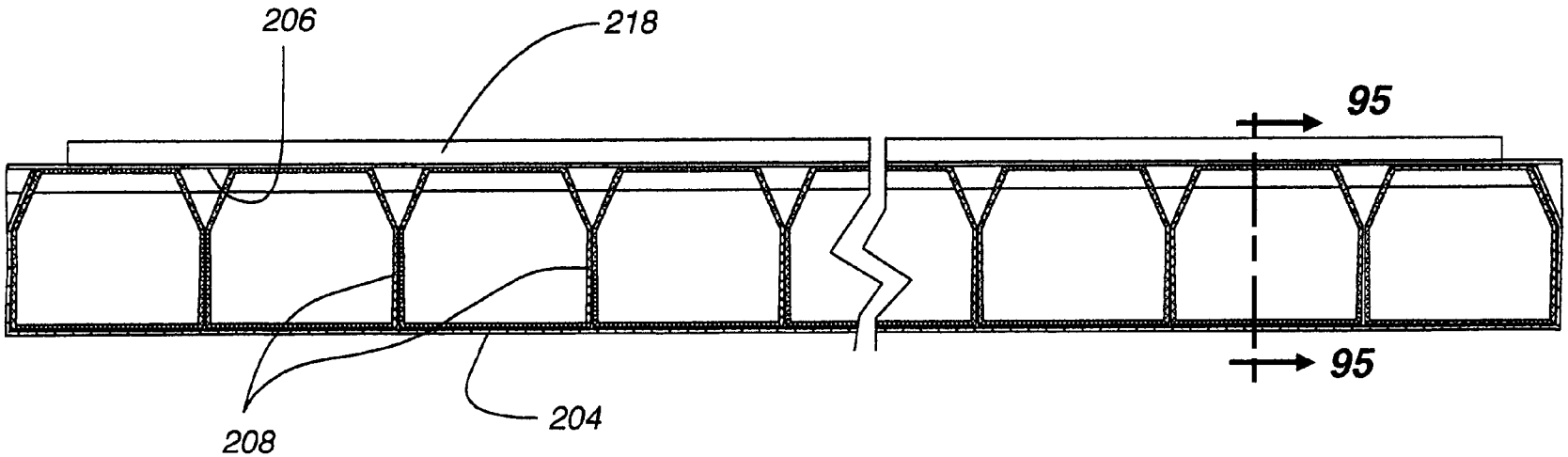
FIG. 96 is an enlarged fragmentary transverse vertical section taken along line 96—96 of FIG. 81.

As mentioned previously, the preferred material from which the dividers are made includes glass fibers and a mixture of a thermoset resin and a thermoplastic resin. The material so formed wants to remain in a flat planar orientation even after having been creased and folded as described previously into the configuration of the divider as illustrated for example in FIGS. 89–91. In order to retain the folded configuration with the side walls 214 of each divider folded inwardly, the panel 200 over a long period of time needs to be held in at least some compression or the folded side walls will fold outwardly in an effort to return to the flat planar orientation. Of course, the dividers cannot return to the flat planar orientation as they are secured along the top and bottom to the outer sheet 204 and connector sheet 206 but the side walls will over some period of time try to straighten out if not held in compression and when doing so, pass from their inwardly folded orientation of FIG. 89 to their outwardly folded orientation of FIG. 88 wherein the side walls abut the side walls of adjacent dividers thereby being mutually reinforced and rigidifying the panel so that it is incompressible from a practical standpoint. A panel in its substantially incompressible condition is shown in FIG. 96. In other words, to maintain the compressible nature of a completed panel, the sidewalls need to be at least partially folded inwardly as shown in FIGS. 89–91.

The strips of material from which the dividers 208 are made are folded in an unheated environment and a hot melt adhesive is applied to the strips or to the outer sheet 204 and connector sheet 206 before they are laminated together. As mentioned previously, unless the panels 200 are maintained in a compressed configuration such as illustrated in FIGS. 89–91, they will, over some period of time, expand into the configuration of FIG. 88 in which configuration the panel is no longer compressible. This time period over which it takes for the dividers to convert from the configuration of FIGS. 89–91 to the configuration of FIG. 88 is dependent upon a number of factors including the resin used in the material from which the dividers are made and also whether or not heat is applied to the material while the dividers are in the compressed configuration of FIGS. 89–91. By adding heat to the dividers while they are compressed, the time period it takes for them to expand into the configuration of FIG. 88 is lengthened. Also, by increasing the percent of thermoplastic resin used in the material from which the dividers are made, the time in which it takes for the dividers to transform from the configuration of FIG. 89 to the configuration of FIG. 88 can be increased. By way of example only, the time period for the transformation may be varied anywhere from 15 minutes to 32 hours.

Accordingly, when the panels 200 are formed and shipped, they are desirably shipped in a compressed state so that a relatively large number of panels can be packed and shipped in a relatively small container particularly in comparison to conventional acoustical tiles of a fixed depth, i.e., a depth similar to the fully expanded depth of a panel 200 in accordance with the present invention. Once the panels are removed from the shipping container, however, they expand immediately from the configuration shown in FIG. 91 through the configuration shown in FIG. 90 to the configuration shown in FIG. 89. They will remain in the configuration of FIG. 89 for the above-noted time period after which they will transform into the configuration shown in FIG. 88 where the panel becomes incompressible from a practical standpoint. During that time period, the panels can be cut to their desired shape and installed in a supporting grid system before the panels become substantially incompressible. They can therefore be flexed for easy insertion into the openings defined between support members in the supporting grid system if inserted before becoming incompressible.

Figure 99:
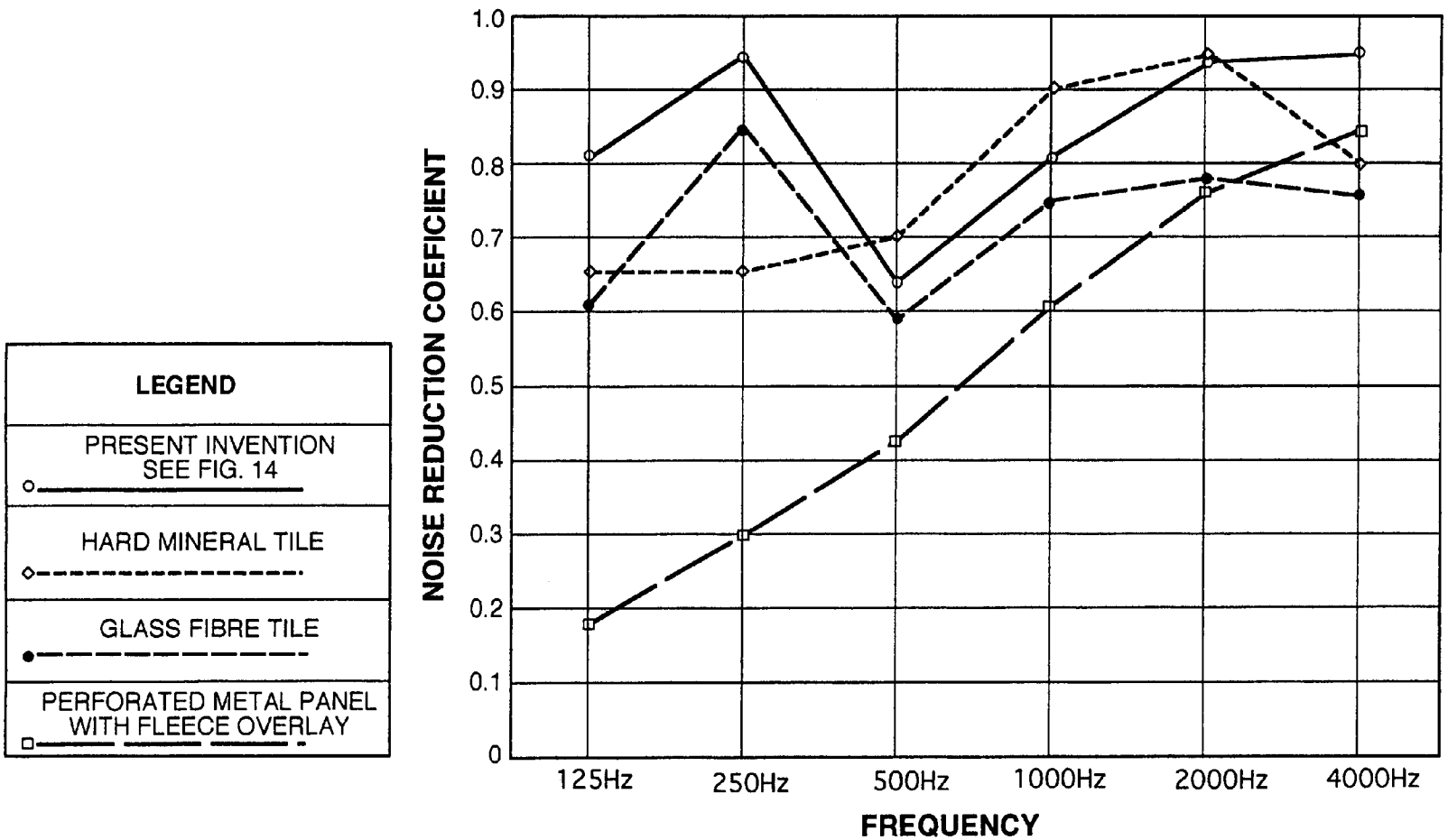
FIG. 99 is a graph illustrating acoustical comparisons between a panel in accordance with the present invention and other panels.

As mentioned previously, panels formed in accordance with the present invention have desired acoustical properties that can be varied according to various parameters. In comparing one embodiment of the present invention with conventional acoustical tiles, one can see the acoustical benefit obtained from a panel formed in accordance with the present invention. In FIG. 99, a graph comparing the panel of FIG. 14 of the present invention with other acoustical tiles is illustrated. The X-axis references frequency in hertz while the Y-axis references a noise reduction coefficient. The three panels compared to the panel formed in accordance with FIG. 14 of the present invention are a hard mineral acoustical tile panel manufactured by Armstrong under the trademark "Cirrus," a glass fiber tile of two-inch thickness manufactured by Ecophon of Sweden under the trademark "Focus," and a 0.7 mm metal panel with perforations and an overlying sheet of a non-woven fleece manufactured by Hunter Douglas of Rotterdam, Holland, under the designation Luxalon 300C.

As can be seen, the acoustical panel of FIG. 14 performs superiorly to the three compared panels at lower frequencies as well as at fairly high frequencies and performs comparably at intermediate frequencies.

Although the present invention has been described with a certain degree of particularity, it is understood that the present disclosure has been made by way of example, and changes in detail or structure may be made without departing from the spirit of the invention as defined in the appended claims.

The invention claimed is:

1. A compressible structural panel comprising in combination:

at least one outer sheet of material having an inner and outer face, a plurality of contiguous or closely adjacent side-by-side compressible dividers of elongated tubular construction formed from individual strips of material, said dividers being expanded in a resting condition and secured to and protruding from said inner face, and a connector means for securing said dividers together at locations distal from said outer sheet.

2. A compressible structural panel comprising in combination:

at least one outer sheet of material having an inner and outer face, a plurality of compressible dividers of elongated tubular construction formed from individual strips of material, said dividers being expanded in a resting condition and secured to and protruding from said inner face, each divider having a flat upper surface and a flat lower surface, said lower surface being secured to said inner face and being larger than said upper surface, and connector means for securing said dividers together along their upper surfaces.

3. A compressible structural panel comprising in combination:

at least one outer sheet of material having an inner and outer face, a plurality of compressible dividers of elongated tubular construction formed from individual strips of material, said dividers being expanded in a resting condition and secured to and protruding from said inner face, each divider having a pair of side walls with each side wall having a single longitudinal fold line defining an upper portion and a lower portion and wherein the upper portion is smaller than the lower portion, and connector means for securing said dividers together at locations distal from said outer sheet.

4. The panel of claim 1, 2 or 3 wherein said elongated tubes in cross section define a pair of stacked, inverted truncated triangles.

5. The panel of claim 1 or 2 wherein said strips, further include elongated fold lines.

6. The structural panel of claim 1 or 3 wherein said dividers are of elongated tubular construction having substantially flat upper and lower surfaces, said lower surface being secured to said outer sheet and said upper surface to said connector means.

7. The structural panel of claim 1 or 2 wherein said dividers have a pair of side partitions with each side partition having an inwardly folded fold line.

8. The structural panel of claim 6 wherein said upper surface is smaller than said lower surface.

9. The structural panel of claim 7 wherein each side partition has an upper portion above the fold line and a lower portion beneath the fold line and wherein said upper portion of each side wall is shorter than said lower portion.

10. The structural panel of claim 7 wherein each side partition has an upper portion above the fold line and a lower portion beneath the fold line and wherein said upper and lower portions are substantially the same length.

11. The panel of claim 2 wherein the lower surfaces of adjacent dividers are secured to said outer sheet in immediately adjacent or contiguous relationship with each other.

12. The panel of claim 2 wherein the lower surfaces of adjacent dividers are secured to said outer sheet in immediately adjacent or contiguous relationship with each other and said upper surfaces are connected to said connector means in spaced relationship from each other.

* * * * *